US009818252B2

(12) United States Patent
Nakajima et al.

(10) Patent No.: US 9,818,252 B2
(45) Date of Patent: Nov. 14, 2017

(54) PRODUCT DISCHARGING DEVICE

(71) Applicant: FUJI ELECTRIC CO., LTD., Kawasaki-shi, Kanagawa (JP)

(72) Inventors: Norio Nakajima, Yokkaichi (JP); Yoshio Yasaka, Yokkaichi (JP); Michihiko Makino, Yokkaichi (JP); Tsutomu Iwako, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 102 days.

(21) Appl. No.: 15/060,171

(22) Filed: Mar. 3, 2016

(65) Prior Publication Data

US 2016/0196710 A1 Jul. 7, 2016

Related U.S. Application Data

(63) Continuation of application No. PCT/JP2015/050398, filed on Jan. 8, 2015.

(30) Foreign Application Priority Data

Jan. 10, 2014 (JP) ..... 2014-003755
Jan. 10, 2014 (JP) ..... 2014-003767
(Continued)

(51) Int. Cl.
*G07F 11/24* (2006.01)

(52) U.S. Cl.
CPC ..... *G07F 11/24* (2013.01)

(58) Field of Classification Search
CPC ..... G07F 11/62
See application file for complete search history.

(56) References Cited

U.S. PATENT DOCUMENTS 6,467,648 B1 10/2002 Nishiyama et al.
9,710,993 B2 * 7/2017 Makino ..... G07F 11/24
2016/0155287 A1 6/2016 Yasaka et al.

FOREIGN PATENT DOCUMENTS

CN 1298163 A 6/2001
CN 105474279 A 4/2016
(Continued)

OTHER PUBLICATIONS

PCT, "International Search Report for International Application No. PCT/JP2015/050398".
(Continued)

*Primary Examiner* — Timothy Waggoner
*Assistant Examiner* — Ayodeji Ojofeitimi
(74) *Attorney, Agent, or Firm* — Manabu Kanesaka

(57) ABSTRACT

A product discharging device includes: a lower pedal that is swingably disposed in a base to move forward to and backward from a product storage passage storing input products in a vertical direction; an upper pedal that is swingably disposed in a base to move forward to and backward from the product storage passage in an area above the lower pedal; and a pedal link that links the lower pedal and the upper pedal. The upper pedal moves backward by causing the pedal link to move downward and the lower pedal moves forward to regulate downward movement of the product in a standby state, and the upper pedal moves forward to come in contact with a second lowest product and the lower pedal moves backward to discharge a lowest product downward by causing the pedal link to move upward, in an activated state.

9 Claims, 38 Drawing Sheets

(30) Foreign Application Priority Data

Jul. 18, 2014 (JP) ..... 2014-148215
Aug. 6, 2014 (JP) ..... 2014-160313

(56) References Cited

FOREIGN PATENT DOCUMENTS

| | | | | |
|---|---|---|---|---|
| JP | 06084056 | A | * | 3/1994 |
| JP | H06-314372 | A | | 11/1994 |
| JP | 2749917 | B2 | | 5/1998 |
| JP | 2001-188953 | A | | 7/2001 |
| JP | 02001188955 | A | * | 10/2001 |
| JP | 2001-351163 | A | | 12/2001 |
| JP | 02002288732 | A | * | 4/2002 |
| JP | 2013-196049 | A | | 9/2013 |
| JP | 2015-095235 | A | | 5/2015 |
| TW | 200417943 | A | | 9/2004 |

OTHER PUBLICATIONS

China Patent Office, "Office Action for Chinese Patent Application No. 201580001746.7," dated Jun. 2, 2017.

* cited by examiner

PRODUCT DISCHARGING DEVICE

CROSS-REFERENCE TO RELATED APPLICATION(S)

This application is a continuation of PCT international application Ser. No. PCT/JP2015/050398 filed on Jan. 8, 2015 which designates the United States, incorporated herein by reference, and which claims the benefit of priority from Japanese Patent Application No. 2014-003755, filed on Jan. 10, 2014, Japanese Patent Application No. 2014-003767, filed on Jan. 10, 2014, Japanese Patent Application No. 2014-148215, filed on Jul. 18, 2014, and Japanese Patent Application No. 2014-160313, filed on Aug. 6, 2014, the entire contents of all of which are incorporated herein by reference.

BACKGROUND

1. Field of the Disclosure

The present disclosure relates to a product discharging device.

2. Related Art

In the related art, in a vending machine vending product such as canned beverage or beverage in a plastic bottle, a product storage rack is disposed in a product storage in a main cabinet which is a main body of the vending machine. The product storage rack includes a product storage passage that extends in a vertical direction and a product discharging device that is disposed in a lower part of the product storage passage.

The product discharging device includes a lower pedal and an upper pedal. The lower pedal and the upper pedal are linked to an AC solenoid as an actuator via a link and move forward to and backward from a product storage passage by supplying power to the AC solenoid.

In the product discharging device, in a standby state, the upper pedal moves backward from the product storage passage, and the lower pedal moves forward to the product storage passage. Accordingly, the lower pedal comes in contact with a lowest product stored in the product storage passage to regulate downward movement of product stored in the product storage passage.

In the product discharging device in a lower part of the product storage passage storing the corresponding product, when a product discharge command is issued, the upper pedal moves forward to the product storage passage via the link by supplying power to the AC solenoid, and comes in contact with a second lowest product to regulate downward movement of the product and the products stored above the product. By supplying power to the AC solenoid, the lower pedal moves backward from the product storage passage, only the lowest product is discharged downward, and the lower pedal moves forward to the product storage passage by a biasing force of a spring when the lowest product gets out of the lower pedal. Thereafter, when the supply of power to the AC solenoid is stopped and the AC solenoid is switched to a non-powered state, the backward movement of the lower pedal having moved forward to the product storage passage is regulated and the upper pedal moves backward from the product storage passage, whereby the product discharging device is returned to the standby state (for example, see Japanese Laid-open Patent Publication No. 2001-188953).

In the product discharging device proposed in Japanese Laid-open Patent Publication No. 2001-188953, since the AC solenoid is used as the actuator, the following problems are caused. That is, when the supply of power is intercepted due to power outage or the like while the link is moving upward and the upper pedal is moving forward to the product storage passage, that is, while the upper pedal is moving forward, by supplying power to the AC solenoid, the AC solenoid is switched to the non-powered state. Accordingly, the link moves downward and the upper pedal moves backward. There is a possibility that plural products will be discharged until the link completely moves downward, that is, until the lower pedal moves forward to the product storage passage and the backward movement thereof is regulated.

There is a need for a product discharging device that can suppress discharging of plural products when supply of power is intercepted due to power outage or the like during discharge of a product.

SUMMARY

Our product discharging device includes: a lower pedal that is swingably disposed in a base to move forward to and backward from a product storage passage storing input products in a vertical direction; an upper pedal that is swingably disposed in a base to move forward to and backward from the product storage passage in an area above the lower pedal; and a pedal link that links the lower pedal and the upper pedal, wherein the upper pedal moves backward from the product storage passage by causing the pedal link to move downward and the lower pedal moves forward to the product storage passage to regulate downward movement of the product in a standby state, and the upper pedal moves forward to the product storage passage to come in contact with a second lowest product and the lower pedal moves backward from the product storage passage to discharge a lowest product downward by causing the pedal link to move upward, in an activated state, and the product discharging device further includes an output gear that is disposed in the base to be rotatable on its axis, is linked to a drive source via a worm gear, and rotates by a driving force of the drive source transmitted via the worm gear, and a link lever that is disposed in the base to be rotatable on its own axis, is maintained in an upward-rotated state to hold the pedal link in an upward-moved state when the link lever comes in sliding contact with a cam portion formed in the output gear, and allows the pedal link to move downward when the sliding contact with the cam portion is released.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

Hereinafter, a product discharging device according to an exemplary embodiment of the present disclosure will be described in detail with reference to the accompanying drawings.

Figure 1:
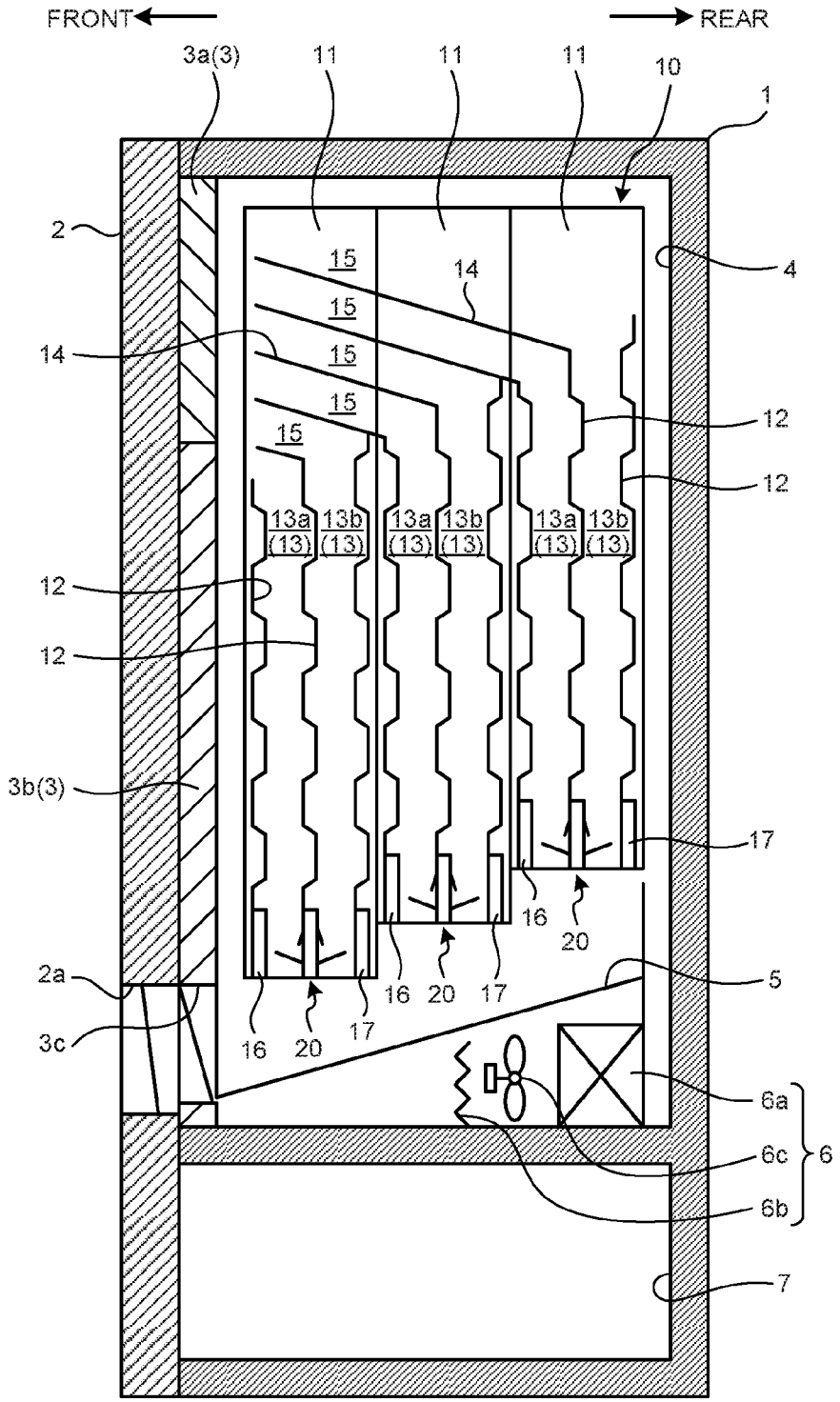
FIG. 1 is a cross-sectional side view illustrating an internal structure of a vending machine to which a product discharging device according to an embodiment of the present disclosure is applied when viewed from the right side.

FIG. 1 is a cross-sectional side view illustrating an internal structure of a vending machine to which the product discharging device according to an embodiment of the present disclosure is applied when viewed from the right side. The vending machine exemplified herein vends product in a cooled or heated state and includes a main cabinet 1, an outer door 2, and an inner door 3.

The main cabinet 1 has a rectangular parallelepiped shape of which a front surface is opened by appropriately combining plural steel sheets and includes a product storage 4 having a heat-insulating structure therein. The outer door 2 serves to cover the front opening of the main cabinet 1 and is disposed at one edge portion of the main cabinet 1 so as to be opened and closed. The front surface of the outer door 2 is provided with elements required for vending product such as a display window, a product selection button, a bill input port, a coin input port, a return lever, a built-in display, a coin return port, and a product output port 2*a*. The inner door 3 is a heat-insulating door which is divided into upper and lower parts to cover the front opening of the product storage 4, an upper heat-insulating door 3*a* is disposed at a position inside the outer door 2 at one edge portion of the outer door 2 so as to be opened and closed, and a lower heat-insulating door 3*b* is disposed at one edge portion of the main cabinet 1 so as to be opened and closed. A product discharge port 3*c* for discharging a product to the outside of the product storage 4 is disposed in a lower part of the lower heat-insulating door 3*b* of the inner door 3.

In the vending machine, a product chute 5 is disposed in the product storage 4, a temperature control unit 6 is disposed in an area below the product chute 5 (hereinafter, also referred to as a "heat exchange area"), and a product storage rack 10 is disposed in an area above the product chute 5 (hereinafter, also referred to as a "product storage area").

The product chute 5 is a plate-like member that guides a product discharged from the product storage rack 10 to the product discharge port 3*c* of the inner door 3 and is disposed to be gradually inclined downward toward the front side. Although not clearly illustrated in the drawing, plural vent holes (not illustrated) causing the heat exchange area and the product storage area to communicate with each other are formed in the product chute 5.

The temperature control unit 6 serves to maintain the internal atmosphere of the product storage 4 in a desired temperature state and includes an evaporator 6*a*, an electric heater 6*b*, and a blower fan 6*c* of a refrigeration cycle. In the temperature control unit 6, for example, when the blower fan 6*c* is driven in a state in which the refrigeration cycle operates, air cooled in the evaporator 6*a* is supplied upward through the vent holes of the product chute 5 and thus the product storage area can be maintained in a low-temperature state. On the other hand, when the blower fan 6*c* is driven in a state in which power is supplied to the electric heater 6*b*, air heated by the electric heater 6*b* is supplied upward through the vent holes of the product chute 5 and thus the product storage area can be maintained in a high-temperature state. Although not clearly illustrated in the drawing, a compressor, a condenser, and an expansion valve of the refrigeration cycle are all disposed in a machine room 7 outside the product storage 4.

The product storage racks 10 are arranged in three lines in the front-rear direction, includes plural (two in the illustrated example) product storage passages 13 which are disposed in a meandering shape in the vertical direction by disposing passage elements 12 between a pair of base side plates 11, and stores plural products with a sideways posture in the vertical direction in the product storage passages 13. More specifically, the passage elements 12 are appropriately disposed on the front side and the rear side of the product storage passages 13 so as to face each other and are fixed to the base side plate 11. Accordingly, in each product storage rack 10, two product storage passages 13 are disposed to be adjacent to each other in the front-rear direction. In the following description, the front product storage passage 13 in one product storage rack 10 is also referred to as a first product storage passage 13*a* and the rear product storage passage 13 is also referred to as a second product storage passage 13*b*.

The passage elements 12 are provided with flappers which are not clearly illustrated in the drawing. The flappers are swingably disposed in the passage elements 12 so as to move forward to and backward from the product storage passage 13. The flappers are biased by coil springs (not illustrated) and moves forward to the product storage passages 13 in a normal state. The flapper moves backward along the meandering product storage passage 13 against a bias force of the coil spring to correct the posture of a product by coming in contact with the product passing through the product storage passage 13.

In the product storage rack 10, a top tray 14 is disposed in the top of the product storage passage 13 and a product dispensing system 20 is disposed in the bottom of the product storage passage 13.

The top tray 14 is formed by bending a plate-like metal sheet, and the top tray is disposed between the base side plates 11 so as to be gradually inclined downward from the front side to the rear side. The top surface of the top tray 14 constitutes a product guide passage 15 that guides a product input through an input port to the product storage passage 13.

Figure 2:
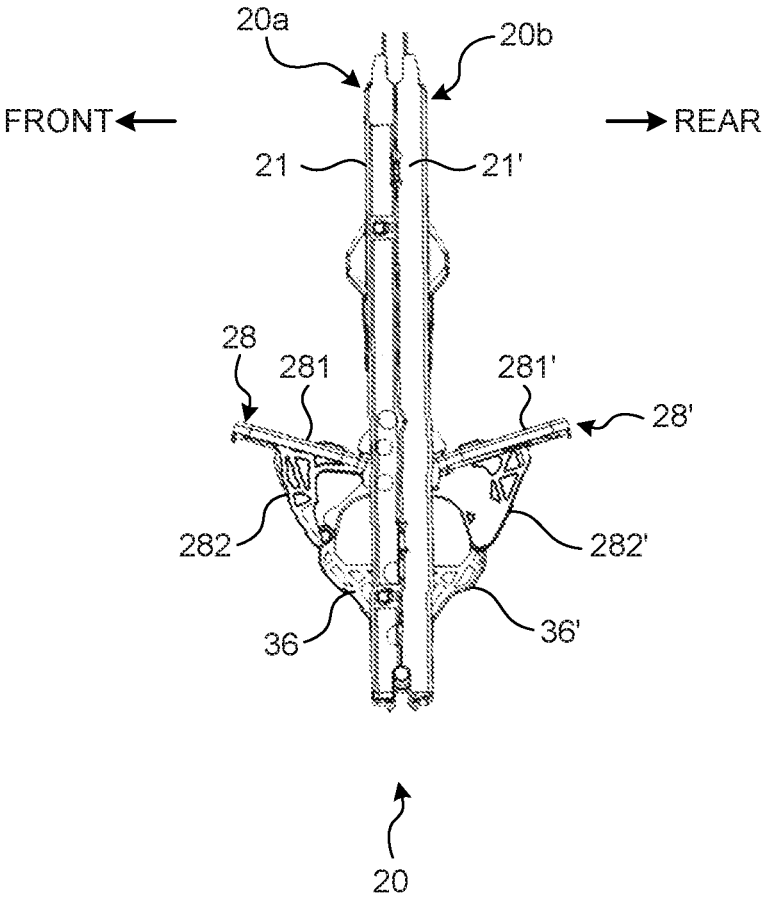
FIG. 2 is a side view illustrating the product dispensing system illustrated in FIG. 1 when viewed from the right side.
Figure 3:
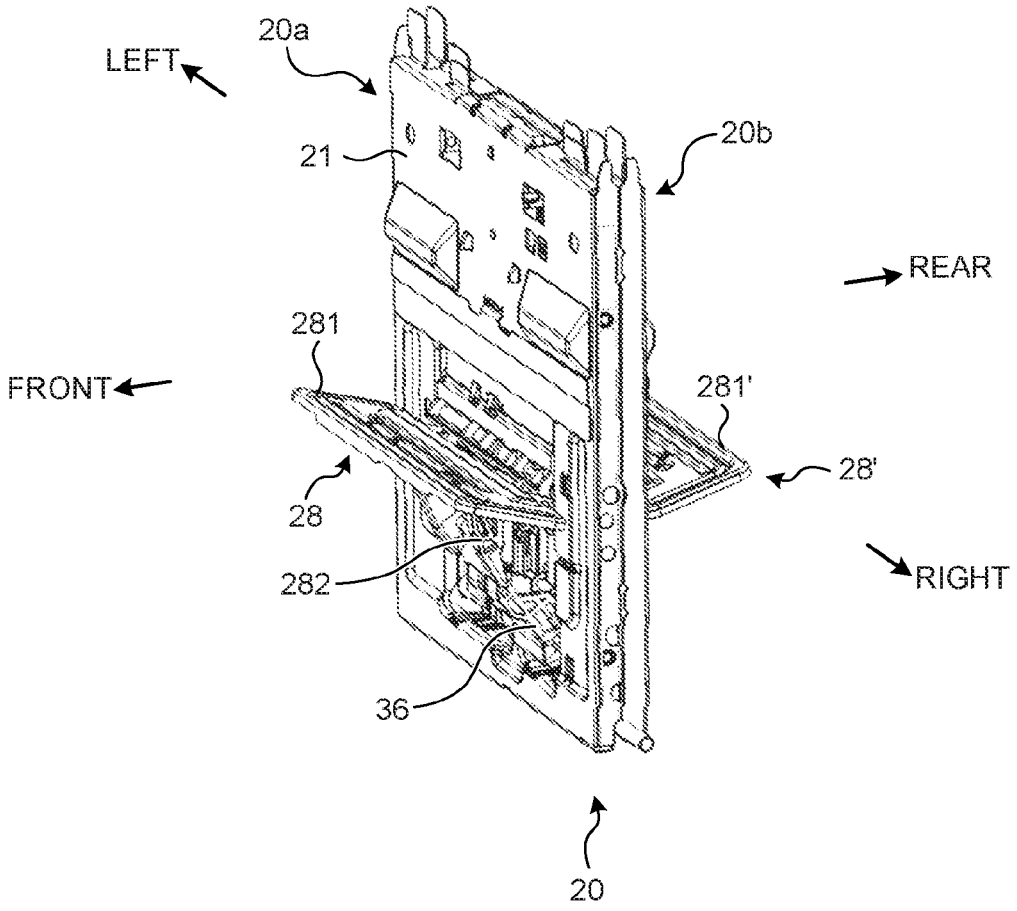
FIG. 3 is a perspective view illustrating the product dispensing system illustrated in FIG. 1 when viewed from the front-right side.
Figure 4:
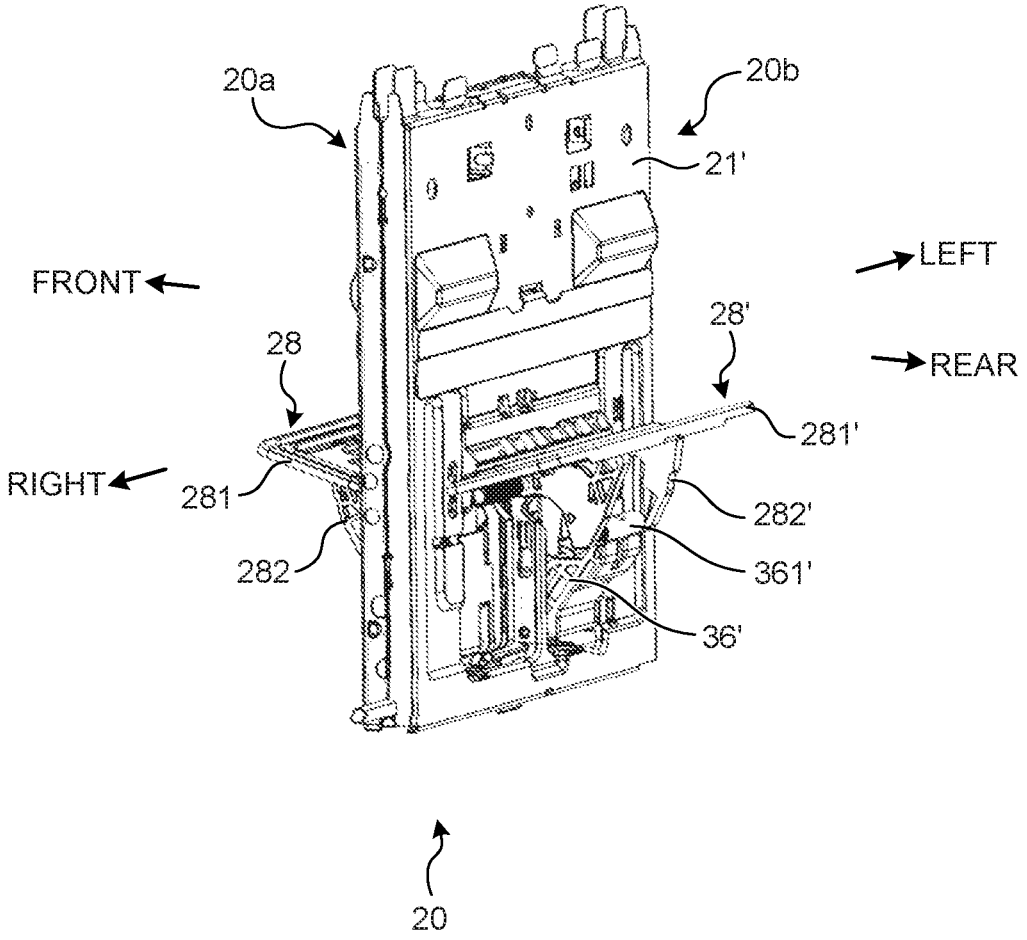
FIG. 4 is a perspective view illustrating the product dispensing system illustrated in FIG. 1 when viewed from the rear-right side.

FIGS. 2 to 4 illustrate a product dispensing system 20 illustrated in FIG. 1, where FIG. 2 is a side view when viewed from the right side, FIG. 3 is a perspective view when viewed from the front-right side, and FIG. 4 is a perspective view when viewed from the rear-right side.

As illustrated in FIGS. 2 to 4, the product dispensing system 20 includes one product discharging device (hereinafter, also referred to as a first product discharging device) 20*a* and the other product discharging device (hereinafter, also referred to as a second product discharging device) 20*b*, where the first product discharging device 20*a* and the second product discharging device 20*b* are coupled to each other back to back. FIGS. 2 to 4 illustrate a state in which both of the first product discharging device 20*a* and the second product discharging device 20*b* constituting the product dispensing system 20 store no product.

Figure 5:
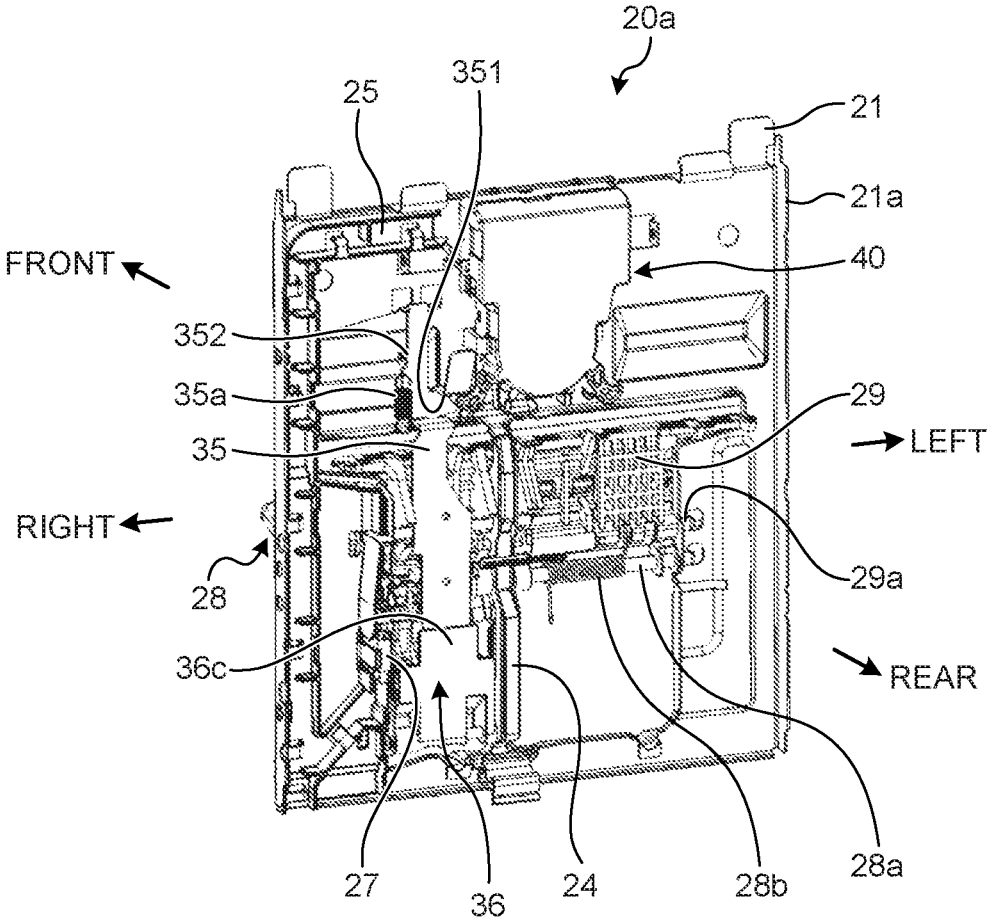
FIG. 5 is a perspective view illustrating a first product discharging device illustrated in FIGS. 2 to 4 when viewed from the rear-right side.

FIG. 5 is a perspective view illustrating the first product discharging device 20*a* illustrated in FIGS. 2 to 4 when viewed from the rear-right side. In the following description, the configuration of the first product discharging device 20*a* will be first described and then the second product discharging device 20*b* will be described.

Figure 6:
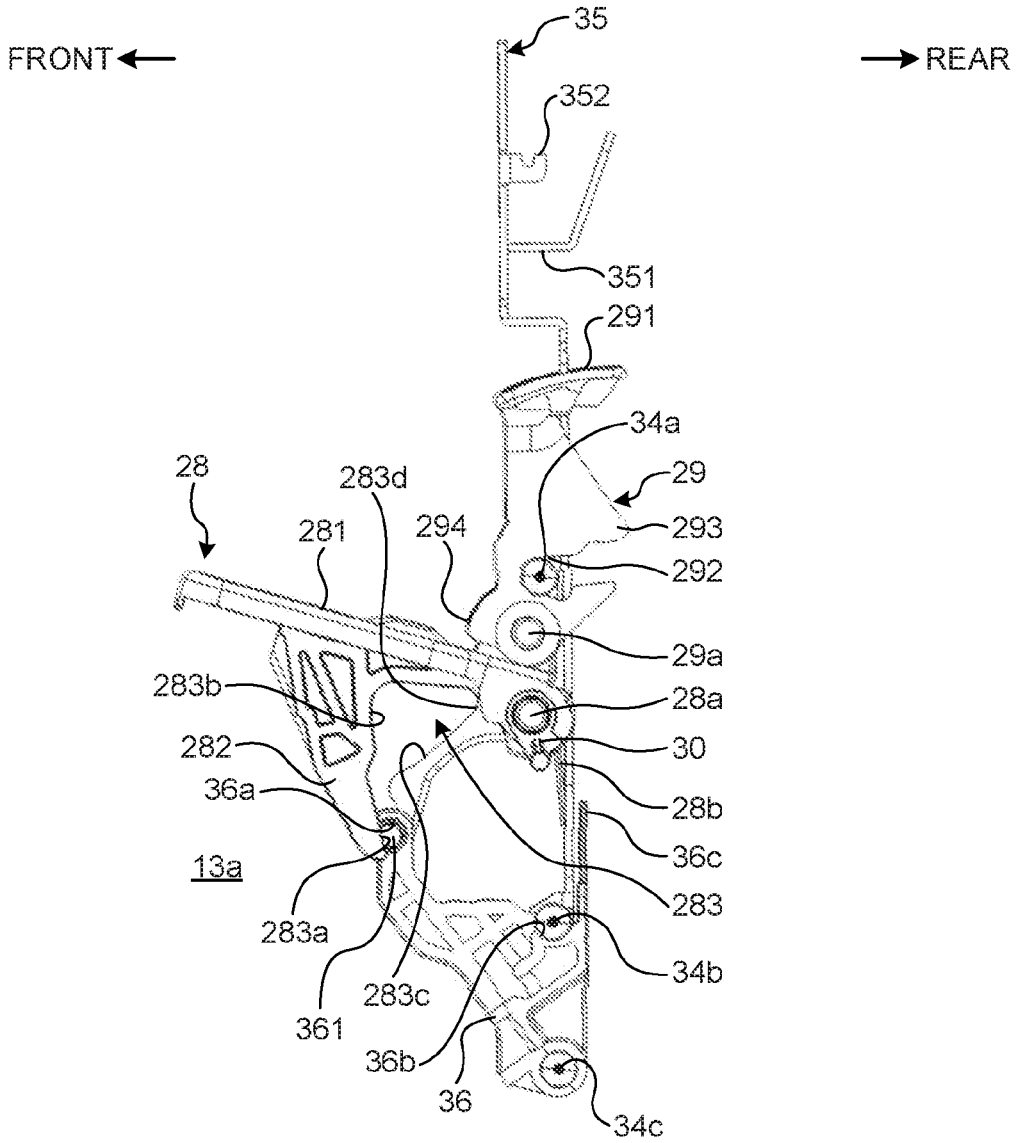
FIG. 6 is a diagram schematically illustrating a principal part of the first product discharging device illustrated in FIGS. 2 to 5 when viewed from the right side.
Figure 7:
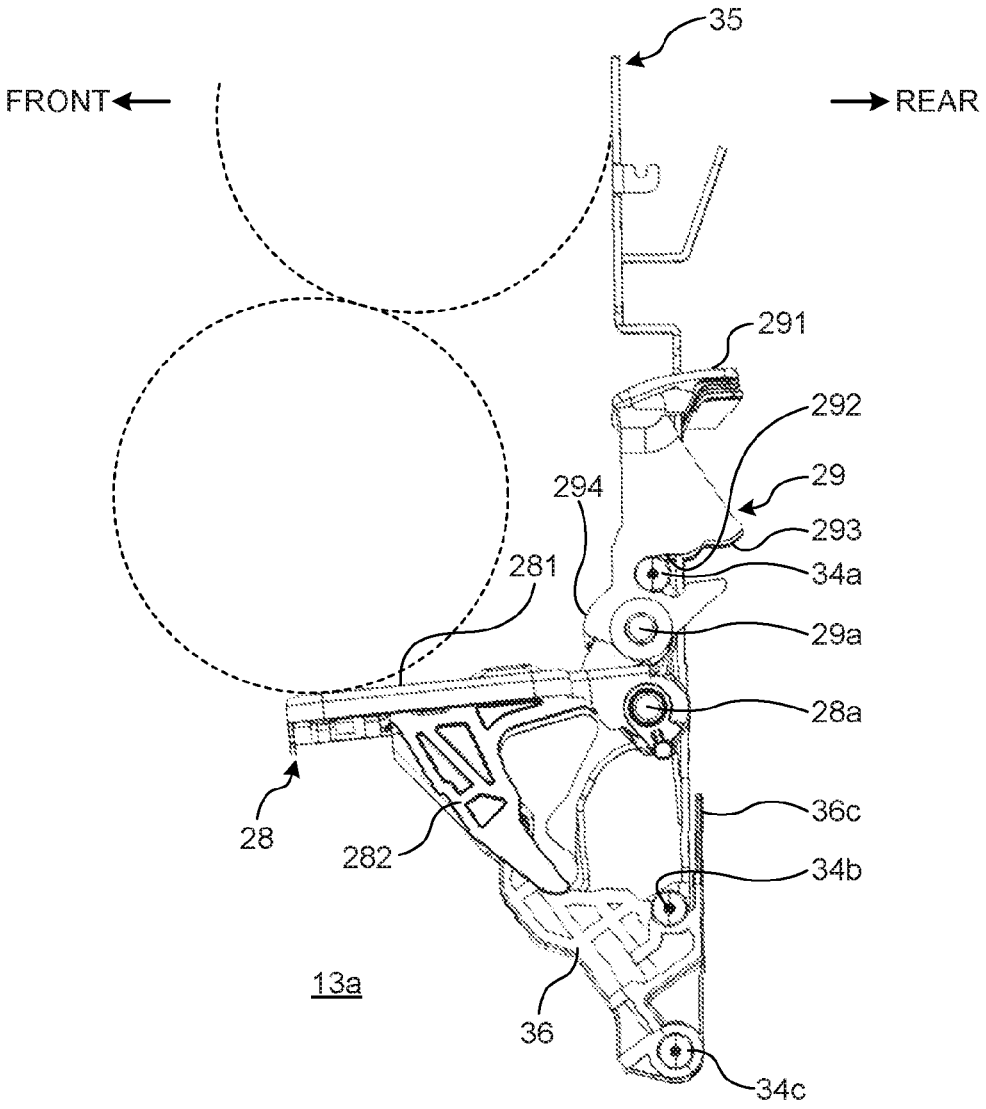
FIG. 7 is a diagram schematically illustrating a principal part of the first product discharging device illustrated in FIGS. 2 to 5 when viewed from the right side.
Figure 8:
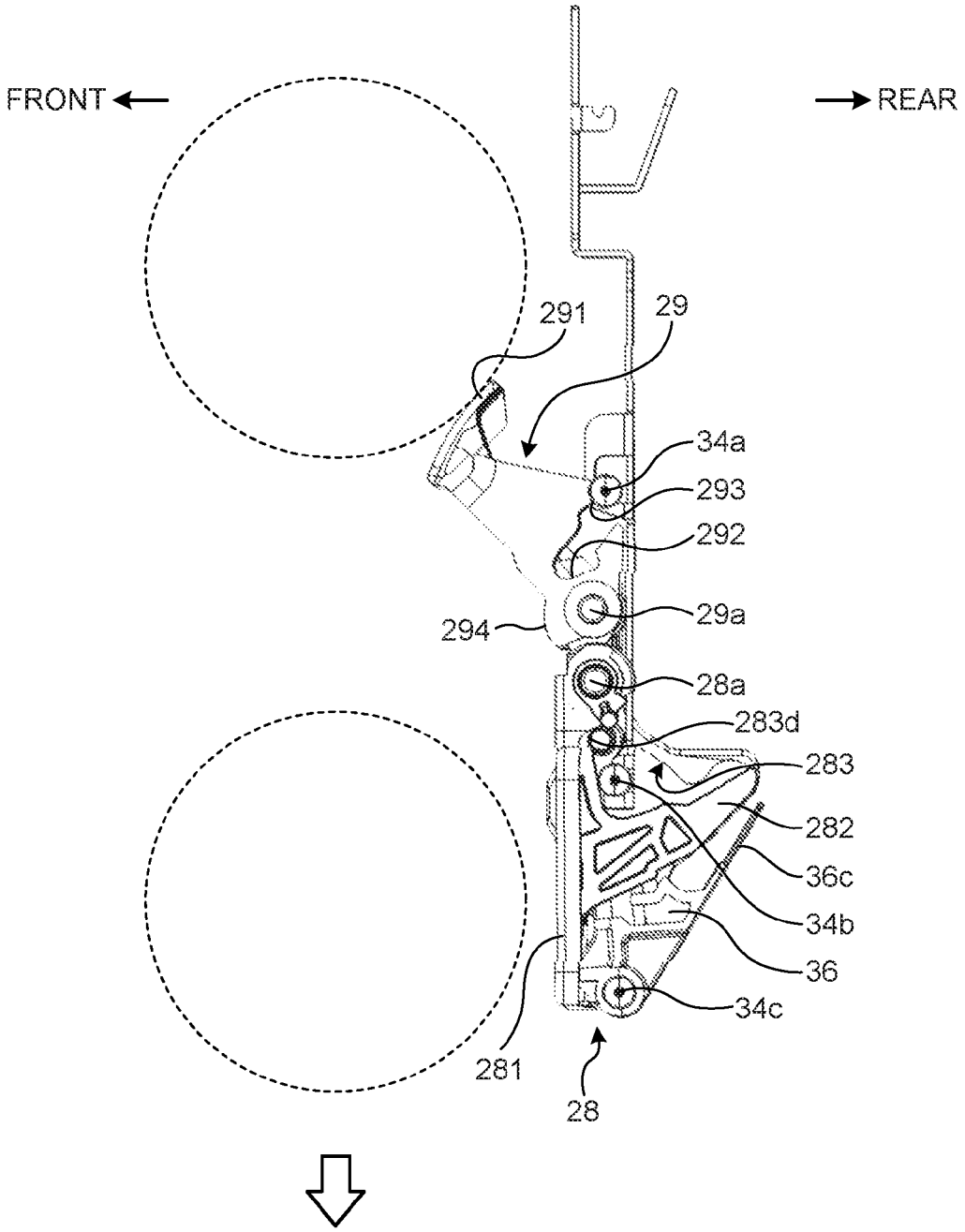
FIG. 8 is a diagram schematically illustrating a principal part of the first product discharging device illustrated in FIGS. 2 to 5 when viewed from the right side.

FIGS. 6 to 8 are diagrams schematically illustrating principal parts of the first product discharging device 20*a* illustrated in FIGS. 2 to 5 when viewed from the right side. In the following description, the configuration of the first product discharging device 20*a* will be described appropriately with reference to FIGS. 6 to 8.

The first product discharging device 20*a* is applied to the first product storage passage 13*a* and is disposed in the bottom of the first product storage passage 13*a*. The first product discharging device 20*a* serves to store products in the first product storage passage 13*a* in a standby state and to discharge a product to the product chute 5 in an activated state by controlling behavior of product between an opposite passage width defining plate 16 and the first product discharging device, and includes a base 21.

Figure 9:
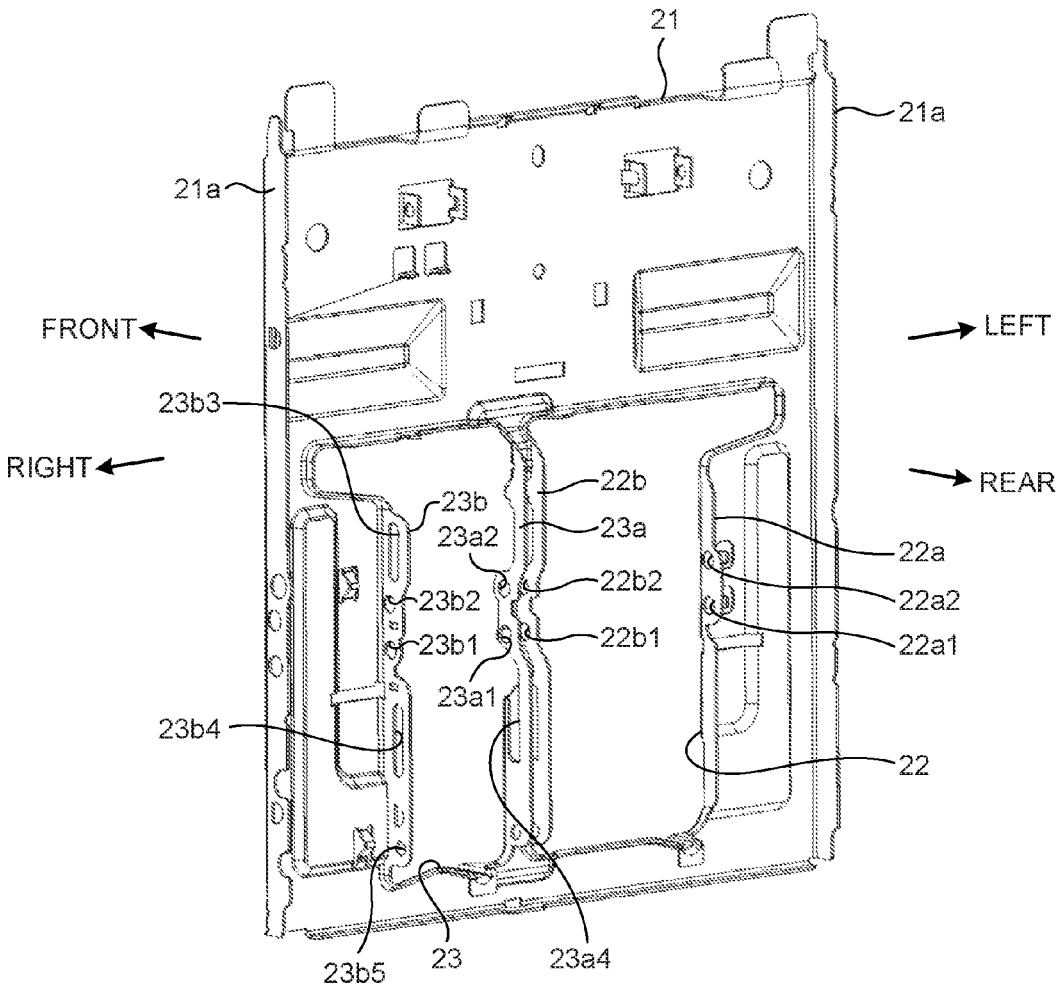
FIG. 9 is a perspective view illustrating a base of the first product discharging device illustrated in FIGS. 2 to 5.

As illustrated in FIG. 9, the base 21 is formed by performing a cutting process and a bending process on a steel sheet and is disposed to cause its own surface to face the passage width defining plate 16. A side wall 21*a* is formed by bending both sides of the base 21 and a first insertion hole 22 and a second insertion hole 23 are formed in an intermediate portion thereof. The circumferential edges of the first insertion hole 22 and the second insertion hole 23 are bent similarly to the side wall 21*a* to form a flange.

The first insertion hole 22 and the second insertion hole 23 are arranged in the right-left direction each other and have the same size in the vertical direction. Among the first insertion hole 22 and the second insertion hole 23, the first insertion hole 22 is located on the left side of the second insertion hole 23, and the width in the right-left direction of the first insertion hole 22 is larger than the width in the right-left direction of the second insertion hole 23. The first insertion hole 22 and the second insertion hole 23 are through-openings (concave portions for enabling a lower pedal 28 and an upper pedal 29 to be described later to move backward into the base 21) having a substantially rectangular shape as a whole, the top end of the first insertion hole 22 protrudes to the left side, and the top end of the second insertion hole 23 protrudes to the right side. A first left bearing piece 22*a* is disposed at the left edge portion of the first insertion hole 22, a first right bearing piece 22*b* is disposed at the right edge portion of the first insertion hole 22, a second left bearing piece 23*a* is disposed at the left edge portion of the second insertion hole 23, and a second right bearing piece 23*b* is disposed at the right edge portion of the second insertion hole 23. The first left bearing piece 22*a* and the second right bearing piece 23*b* correspond to the flange formed at the circumferential edges of the first insertion hole 22 and the second insertion hole 23. The first right bearing piece 22*b* and the second left bearing piece 23*a* are formed integrally with the base 21 in which a bearing portion 24 to be described later is fitted and supported, and are formed in shaft insertion flanges forming both U-shaped leg portions in a bearing support portion formed in a U-shaped cross-section (discontinuous). The bearing support portion has a function of maintaining the strength of the base 21 even when a through-opening including the first insertion hole 22 and the second insertion hole 23 which form a substantially rectangular shape as a whole is formed in the base 21.

Figure 10:
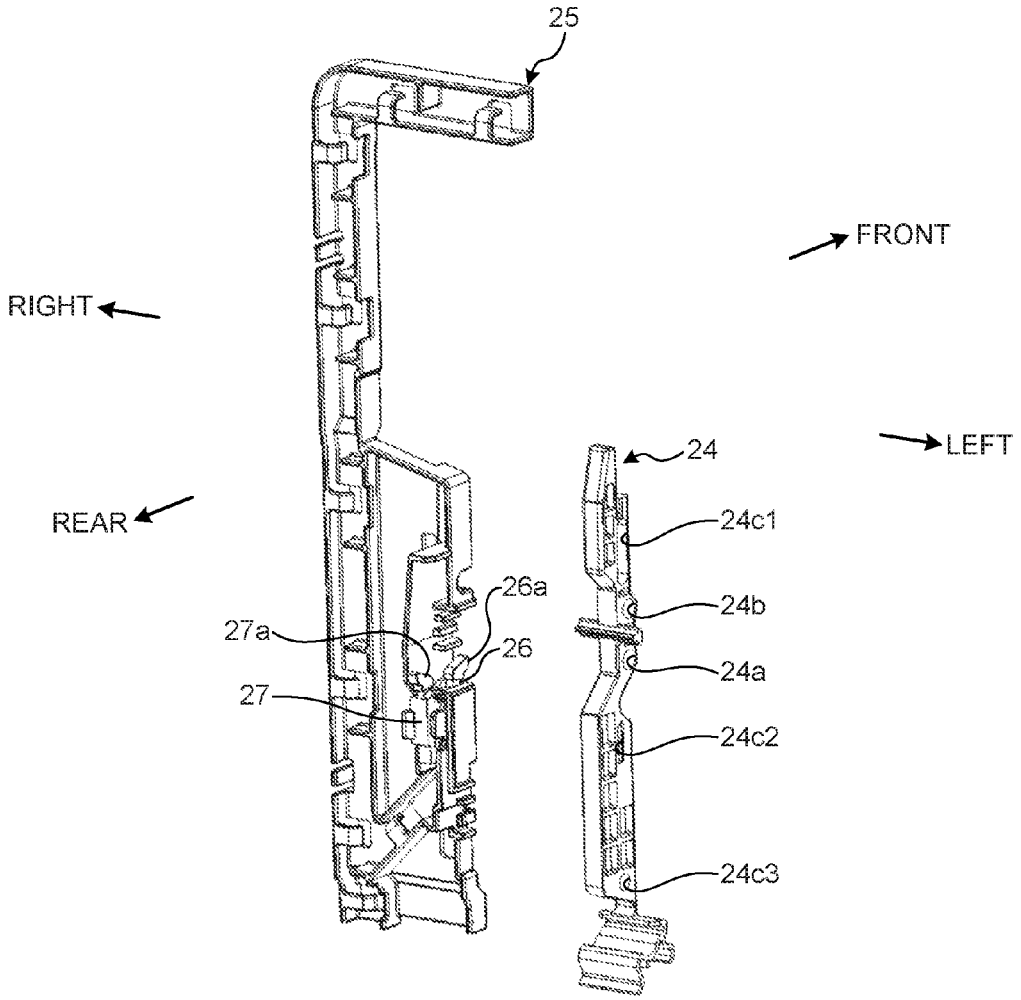
FIG. 10 is a perspective view illustrating a bearing portion and a harness guide attached to the base illustrated in FIG. 9.

As illustrated in FIG. 10, a bearing portion 24 and a harness guide 25 are attached to the base 21 having the above-mentioned configuration. The bearing portion 24 is formed of a resin material or the like and is interposed between the first right bearing piece 22*b* and the second left bearing piece 23*a*.

The harness guide 25 is formed of a resin material or the like similarly to the bearing portion 24 and is disposed along the right side wall 21*a* of the base 21 so as to be adjacent to the second right bearing piece 23*b*. The harness guide 25 serves to guide a harness of electronic components mounted on the first product discharging device 20*a*. The harness guide 25 also serves as a guide member when the first product discharging device 20*a* and the second product discharging device 20*b* are coupled to each other back to back.

The harness guide 25 is provided with a first sold-out detection switch 26 and a second sold-out detection switch 27.

The first sold-out detection switch 26 is arranged in the front-rear direction along with the second sold-out detection switch 27, and is located in front of the second sold-out detection switch 27. The first sold-out detection switch 26 is a so-called push type switch and includes a contactor 26*a* that is biased to rise upright by a spring not illustrated. The first sold-out detection switch 26 is switched to an OFF state to output an OFF signal to a dispensing control unit 110 to be described later when the contactor 26*a* is not pressed, and is switched to an ON state to output an ON signal to the dispensing control unit 110 when the contactor 26*a* is pressed and displaced against the biasing force of the spring.

In this embodiment, the first sold-out detection switch 26 is switched to the OFF state when the contactor 26*a* is not pressed and is switched to the ON state when the contactor 26*a* is pressed and displaced, but in the present disclosure, the first sold-out detection switch 26 may be switched to the ON state when the contactor 26*a* is not pressed and may be switched to the OFF state when the contactor 26*a* is pressed and displaced.

The second sold-out detection switch 27 is located in back of the first sold-out detection switch 26. The second sold-out detection switch 27 is a so-called push type switch and includes a contactor 27*a* that is biased to rise upright by a spring not illustrated. The second sold-out detection switch 27 is switched to an OFF state to output an OFF signal to the dispensing control unit 110 to be described later when the contactor 27*a* is not pressed, and is switched to an ON state to output an ON signal to the dispensing control unit 110 when the contactor 27*a* is pressed and displaced against the biasing force of the spring.

In this embodiment, the second sold-out detection switch 27 is switched to the OFF state when the contactor 27*a* is not pressed and is switched to the ON state when the contactor 27*a* is pressed and displaced, but in the present disclosure, the second sold-out detection switch 27 may be switched to the ON state when the contactor 27*a* is not pressed and may be switched to the OFF state when the contactor 27*a* is pressed and displaced.

The base 21 is provided with a first swing support shaft 28*a* and a second swing support shaft 29*a*. The first swing support shaft 28*a* is an axial member disposed to penetrate through-holes 22*a*1, 22*b*1, 23*a*1, 23*b*1, and 24*a* formed in the first left bearing piece 22*a*, the first right bearing piece 22*b*, the second left bearing piece 23*a*, the second right bearing piece 23*b*, and the bearing portion 24 so as to extend substantially in the horizontal direction, and supports the lower pedal 28 in the middle way thereof.

Figure 11:
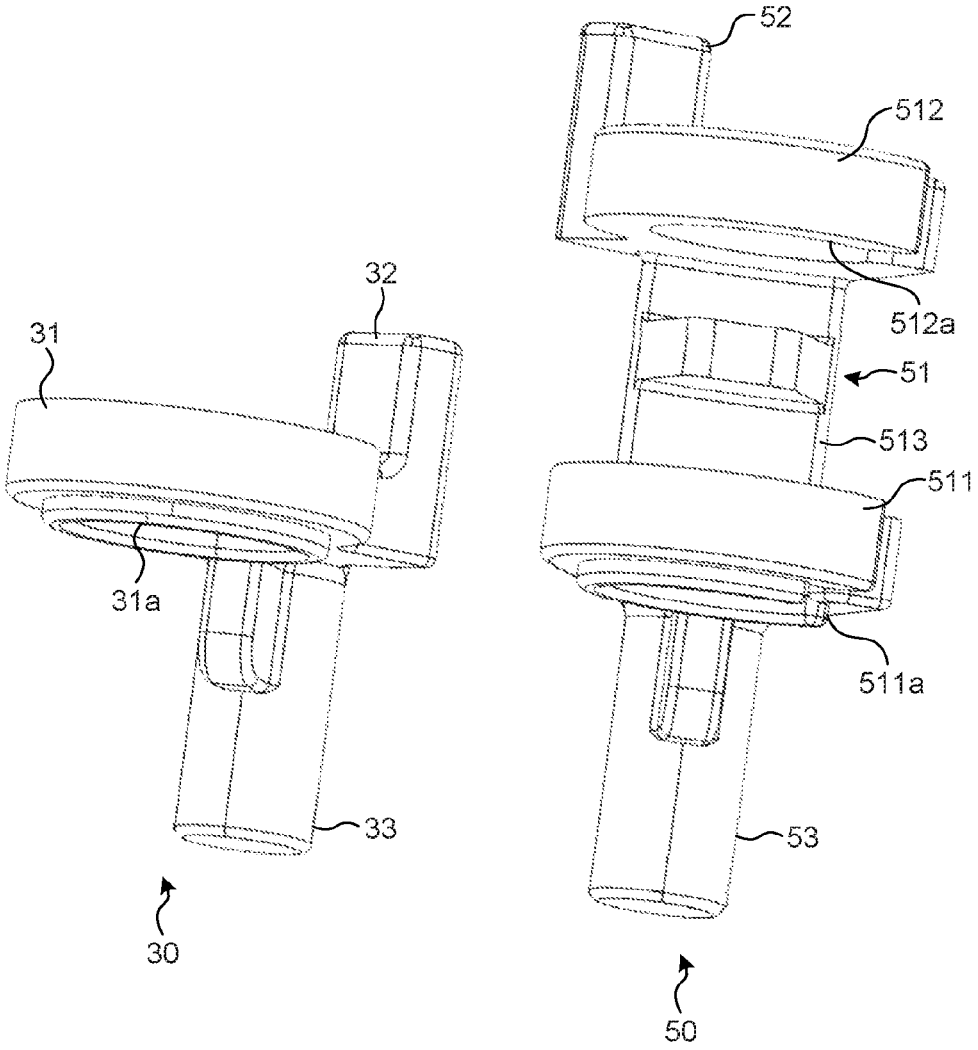
FIG. 11 is a perspective view illustrating a first sold-out link and a second sold-out link.

A first sold-out link 30 is disposed at the right end of the first swing support shaft 28*a*. As illustrated in FIG. 11, the first sold-out link 30 includes a first sold-out base portion 31, a first sold-out contact portion 32, and a first sold-out pressing portion 33. The first sold-out base portion 31 has a substantially disk-like shape and a penetration hole 31*a* penetrated by the right end of the first swing support shaft 28*a* is formed. The first sold-out contact portion 32 extends to the left side from the rear part of the first sold-out base portion 31. The first sold-out pressing portion 33 is formed to protrude to the right side from the bottom of the first sold-out base portion 31. The penetration hole 31*a* formed in the first sold-out base portion 31 is formed to be larger than the first swing support shaft 28*a* and is configured such that the first sold-out link 30 can freely move relative to the first swing support shaft 28*a*.

The second swing support shaft 29*a* is an axial member disposed to penetrate the through-holes 22*a*2, 22*b*2, 23*a*2, 23*b*2, and 24*b* formed in the first left bearing piece 22*a*, the first right bearing piece 22*b*, the second left bearing piece 23*a*, the second right bearing piece 23*b*, and the bearing portion 24 so as to extend in the substantially horizontal direction in an area above the first swing support shaft 28*a*, and supports the upper pedal 29 in the middle way thereof.

The lower pedal 28 is a plate-like member and is disposed to be swingable about the central axis of the first swing support shaft 28*a* by inserting the first swing support shaft 28*a* into the base end thereof.

The tip portion of the lower pedal 28 extends in an outer radial direction of the first swing support shaft 28*a*, and can move forward to and backward from the first product storage passage 13*a* via the first insertion hole 22 and the second insertion hole 23 when the lower pedal swings about the central axis of the first swing support shaft 28*a*. That is, the lower pedal 28 is swingably disposed to move forward to and backward from the first product storage passage 13*a*.

A lower pedal spring 28*b* is interposed between the lower pedal 28 and the base 21. The lower pedal spring 28*b* normally biases the lower pedal 28 in the forward moving direction to the first product storage passage 13*a*. More specifically, the lower pedal spring 28*b* causes the lower pedal 28 to take a standby posture (hereinafter, also referred to as a product-absent standby posture) such that the tip portion of the lower pedal 28 is located higher than the first swing support shaft 28*a* as illustrated in FIG. 6. When product is placed on the top surface of the lower pedal 28, the lower pedal spring 28*b* causes the lower pedal 28 to take a standby posture (hereinafter, also referred to as a product-present standby posture) such that the tip portion of the lower pedal 28 is located at the same height level as the first swing support shaft 28*a* as illustrated in FIG. 7.

Accordingly, in the product-absent standby posture, the tip portion of the lower pedal 28 is located higher than in the product-present standby posture.

Figure 12:
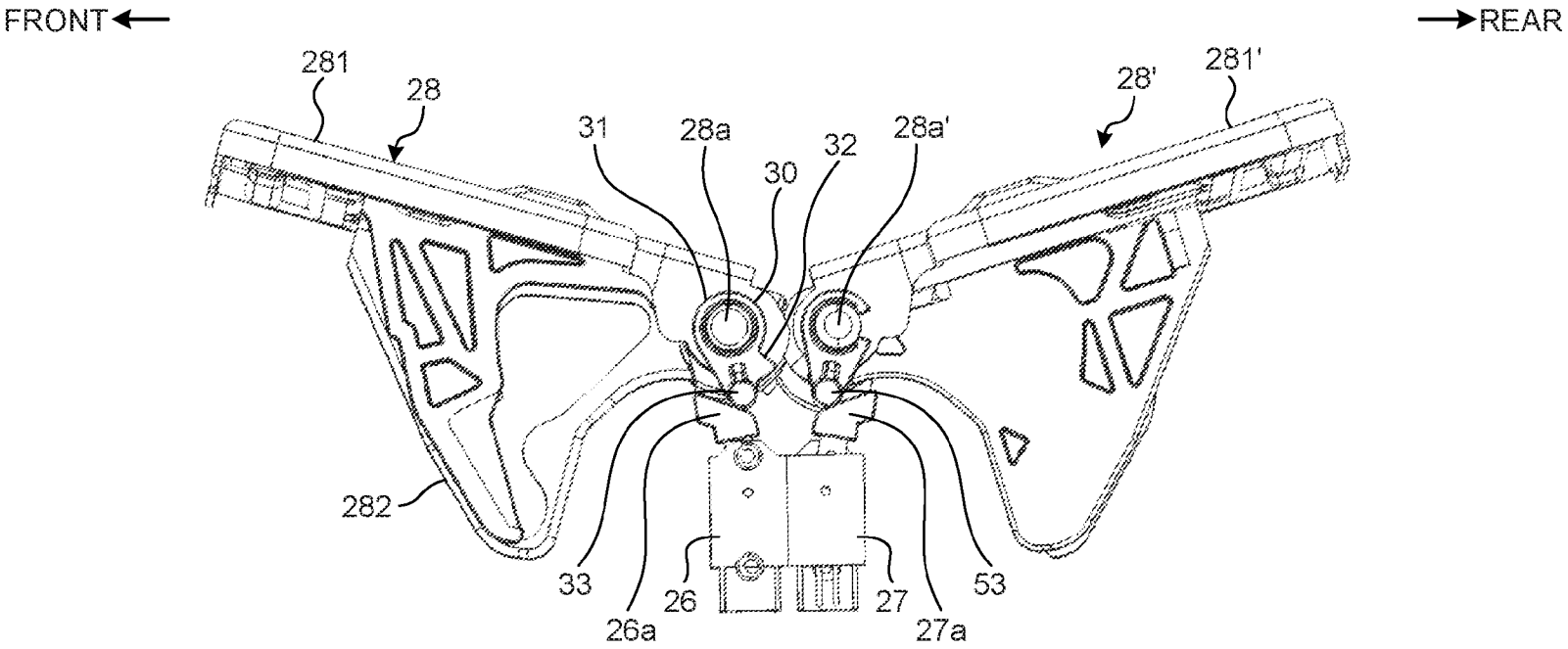
FIG. 12 is a side view illustrating a principal part of the product dispensing system illustrated in FIGS. 2 to 4.

When the lower pedal 28 takes the product-absent standby posture, the base end of the lower pedal 28 comes in contact with the first sold-out contact portion 32 in the first sold-out link 30 as illustrated in FIG. 12, thus the first sold-out link 30 rotates about the first swing support shaft 28*a*, and thus the first sold-out pressing portion 33 presses the contactor 26*a* of the first sold-out detection switch 26. Accordingly, in the first sold-out detection switch 26, the contactor 26*a* is pressed and displaced forward against the biasing force of the spring and is switched to the ON state, and thus an ON signal is output to the dispensing control unit 110.

Figure 13:
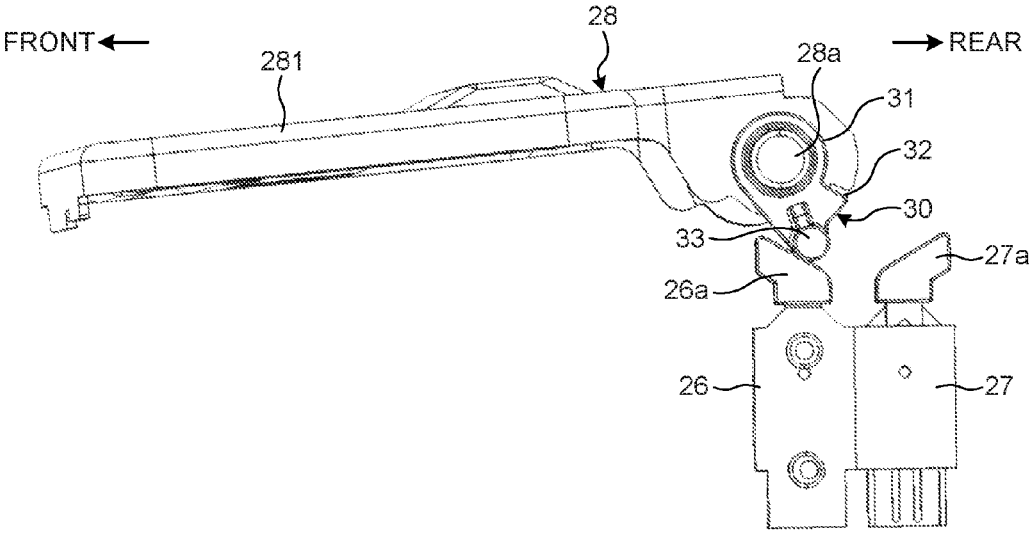
FIG. 13 is a side view illustrating a relationship of the first sold-out link and a first sold-out detection switch when a lower pedal is changed to a product-present standby posture.

On the other hand, when the lower pedal 28 takes the product-present standby posture, the base end of the lower pedal 28 is separated from the first sold-out contact portion 32 of the first sold-out link 30 as illustrated in FIG. 13 and thus the first sold-out link 30 is switched to a free state. Accordingly, in the first sold-out detection switch 26, the contactor 26*a* is biased by the spring to rise upright and is switched to the OFF state, and thus an OFF signal is output to the dispensing control unit 110. That is, the first sold-out link 30 switched to the free state rotates about the first swing support shaft 28*a* by pressing the first sold-out pressing portion 33 against the contactor 26*a*.

The lower pedal 28 includes a plate-like pedal body 281 and a pair of guide portions 282. The pair of guide portions 282 is disposed on the rear side of the pedal body 281. Each guide portion 282 is a plate-like member extending in the vertical direction and both guide portions are formed to face each other. A guide groove 283 is formed on the facing surfaces of the guide portions 282.

The guide groove 283 includes a fitting portion 283*a* which is located at the lowest position in a state in which the lower pedal 28 is disposed at a forward-moved position at which the lower pedal most moves forward to the first product storage passage 13*a* (the state illustrated in FIG. 6) and into which a pedal operating shaft 361 of a rotation stopper 36 to be described later is fitted, a contact portion 283*d* which is located at the highest position in a state in which the lower pedal 28 is disposed at a backward-moved position at which the lower pedal most moves backward from the first product storage passage 13*a* (the state illustrated in FIG. 8) and with which the pedal operating shaft 361 of the rotation stopper 36 comes in contact, and a first guide portion 283*b* and a second guide portion 283*c* which are continuously connected to the fitting portion 283*a* and the contact portion 283*d*.

The first guide portion 283*b* is formed in the guide portion 282 to be inclined obliquely upward from the fitting portion 283*a* so as to get away from the base 21, be inclined obliquely upward so as to get close to the base 21, and then reach the contact portion 283*d* in a state in which the lower pedal 28 is located at the position (forward-moved position) at which the lower pedal most moves forward to the first product storage passage 13*a*.

The second guide portion 283*c* is formed in the guide portion 282 to be inclined obliquely downward from the contact portion 283*d* so as to get away from the base 21 and then reach the fitting portion 283*a* in a state in which the lower pedal 28 is located at the position (forward-moved position) at which the lower pedal most moves forward to the first product storage passage 13*a*.

The length in the outer radial direction of the lower pedal 28 from the first swing support shaft 28*a* is set to a length with which a gap smaller than the maximum width of a product having a small maximum width can be secured between the passage width defining plate 16 and the lower pedal when the lower pedal is located at the position (forward-moved position) at which the lower pedal most moves forward to the first product storage passage 13*a*.

The upper pedal 29 is a plate-like member and is disposed in the base 21 so as to be swingable about the central axis of the second swing support shaft 29*a* by inserting the second swing support shaft 29*a* into the base end thereof.

The tip portion of the upper pedal 29 extends in an outer radial direction of the second swing support shaft 29*a*, and can move forward to and backward from the first product storage passage 13*a* via the first insertion hole 22 and the second insertion hole 23 when the upper pedal swings about the central axis of the second swing support shaft 29*a*. That is, the upper pedal 29 is swingably disposed to move forward to and backward from the first product storage passage 13*a*.

An upper pedal spring (not illustrated) is interposed between the upper pedal 29 and the base 21. The upper pedal spring normally biases the upper pedal 29 in the backward moving direction to the first product storage passage 13*a*.

The upper pedal 29 is provided with a pressing inclined surface 291, a concave portion 292, a stopper contact portion 293, and a protrusion 294. The pressing inclined surface 291 is disposed in the tip portion of the upper pedal 29 and is a curved inclined surface which is formed to be gradually lowered toward the first product storage passage 13*a* when the upper pedal 29 moves backward from the first product storage passage 13*a*. The concave portion 292 is disposed on the rear side of the upper pedal 29 and is a set of concave places extending substantially in the horizontal direction and being formed to be opened to both side surfaces of the upper pedal 29. The stopper contact portion 293 is a portion with which a stopper pin 34*a* to be described later comes in contact and is disposed to be inclined to the upper side of the concave portion 292 on the rear surface of the upper pedal 29.

The protrusion 294 is disposed at the base end of the upper pedal 29 so as to protrude toward the first product storage passage 13*a*.

The upper pedal 29 is biased to move backward from the first product storage passage 13*a* by a biasing force of the upper pedal spring, but the initial position thereof is set in a state in which the upper pedal moves backward from the first product storage passage 13*a* by bringing the stopper pin 34*a* into contact with the concave portion 292.

The upper pedal 29 is inclined to the front side with respect to the vertical plane passing through the second swing support shaft 29*a* in a state (the state illustrated in FIG. 8) in which the upper pedal is located at the position (forward-moved position) at which the upper pedal most moves forward to the first product storage passage 13*a*. The length in the outer radial direction of the upper pedal 29 from the second swing support shaft 29*a* is set to a length with which a gap smaller than the maximum width of a product having a small maximum width can be secured between the passage width defining plate 16 and the upper pedal in the state in which the upper pedal is inclined to the front side.

In the base 21, the stopper pin 34*a*, a pedal stopper pin 34*b*, and a stopper shaft 34*c* are disposed between the bearing portion 24 and the second right bearing piece 23*b*.

The stopper pin 34*a* is an axial member which is disposed substantially in the horizontal direction between the bearing portion 24 and the second right bearing piece 23*b*, where one end thereof is inserted into a stopper pin insertion hole 23*b*3 of the second right bearing piece 23*b* and the other end thereof is inserted into a stopper pin insertion hole 24*c*1 of the bearing portion 24 exposed from the second left bearing piece 23*a*. The stopper pin 34*a* is coupled to a pedal link 35 and is movable in the vertical direction in the stopper pin insertion holes 23*b*3 and 24*c*1 with the movement in the vertical direction of the pedal link 35. The stopper pin 34*a* comes in contact with the concave portion 292 of the upper pedal 29 located at the initial position.

The pedal stopper pin 34*b* is an axial member which is disposed substantially in the horizontal direction between the bearing portion 24 and the second right bearing piece 23*b*, where one end thereof is inserted into a pedal stopper pin support groove 24*c*2 of the bearing portion 24 (which is a long groove extending in the vertical direction similarly to the stopper pin insertion hole 24*c*1, which is closed by a groove bottom which is a drawn portion denoted by a reference sign 24*c*1, and which is not illustrated in FIG. 6) and the other end thereof is inserted into a pedal stopper pin support groove 23*b*4 of the second right bearing piece 23*b*. The second left bearing piece 23*a* is provided with an insertion groove 23*a*4 so as to expose a pedal stopper pin support groove 24*c*2. The pedal stopper pin 34*b* is coupled to the pedal link 35 and is movable in the vertical direction in the pedal stopper pin support grooves 23*b*4 and 24*c*2 with the movement in the vertical direction of the pedal link 35. The circumferential surface of the pedal stopper pin 34*b* slides in the pedal stopper pin support grooves 23*b*4 and 24*c*2 when the pedal link 35 moves in the vertical direction.

The stopper shaft 34*c* is an axial member which is disposed substantially in the horizontal direction between the bearing portion 24 and the second right bearing piece 23*b*, where one end thereof is inserted into a stopper shaft insertion hole 24*c*3 of the bearing portion 24 and the other end thereof is inserted into a through-hole 23*b*5 of the second right bearing piece 23*b*. The insertion hole of the stopper shaft 34*c* is formed in the second right bearing piece 23*b*. The stopper shaft 34*c* supports the rotation stopper 36 in the middle way thereof.

The rotation stopper 36 is disposed between the bearing portion 24 and the second right bearing piece 23*b* so as to insert the stopper shaft 34*c* into the insertion hole of the base end thereof and to be swingable about the central axis of the stopper shaft 34*c*.

The tip portion of the rotation stopper 36 extends in the outer radial direction of the stopper shaft 34*c* and is movable forward to and backward from the first product storage passage 13*a* via the second insertion hole 23 when the rotation stopper swings about the central axis of the stopper shaft 34*c*.

The rotation stopper 36 includes a pedal operating shaft 361 so as to insert the pedal operating shaft 361 into a through-hole 36*a* of the tip portion thereof. The pedal operating shaft 361 is an axial member which is disposed substantially in the horizontal direction and both ends thereof are fitted into the guide grooves 283 of the lower pedal 28.

A pedal operating spring (not illustrated) is interposed between the rotation stopper 36 and the base 21. The pedal operating spring normally biases the rotation stopper 36 in the forward moving direction to the first product storage passage 13*a*.

The rotation stopper 36 is biased in the forward moving direction to the first product storage passage 13*a* by the pedal operating spring, movement in the backward moving direction thereof is regulated by moving the pedal stopper pin 34*b* into a recessed portion 36*b* of the rotation stopper 36 to come in contact with the pedal stopper pin 34*b*, and the initial position thereof in the state in which the rotation stopper moves forward to the first product storage passage 13*a* is set. Since the lower pedal 28 is biased by the lower pedal spring 28*b*, the initial position of the rotation stopper 36 is set to a position at which both ends of the pedal operating shaft 361 are located in the fitting portion 283*a* of the guide grooves 283 and the lower pedal 28 moves forward to the first product storage passage 13*a*.

Figure 14:
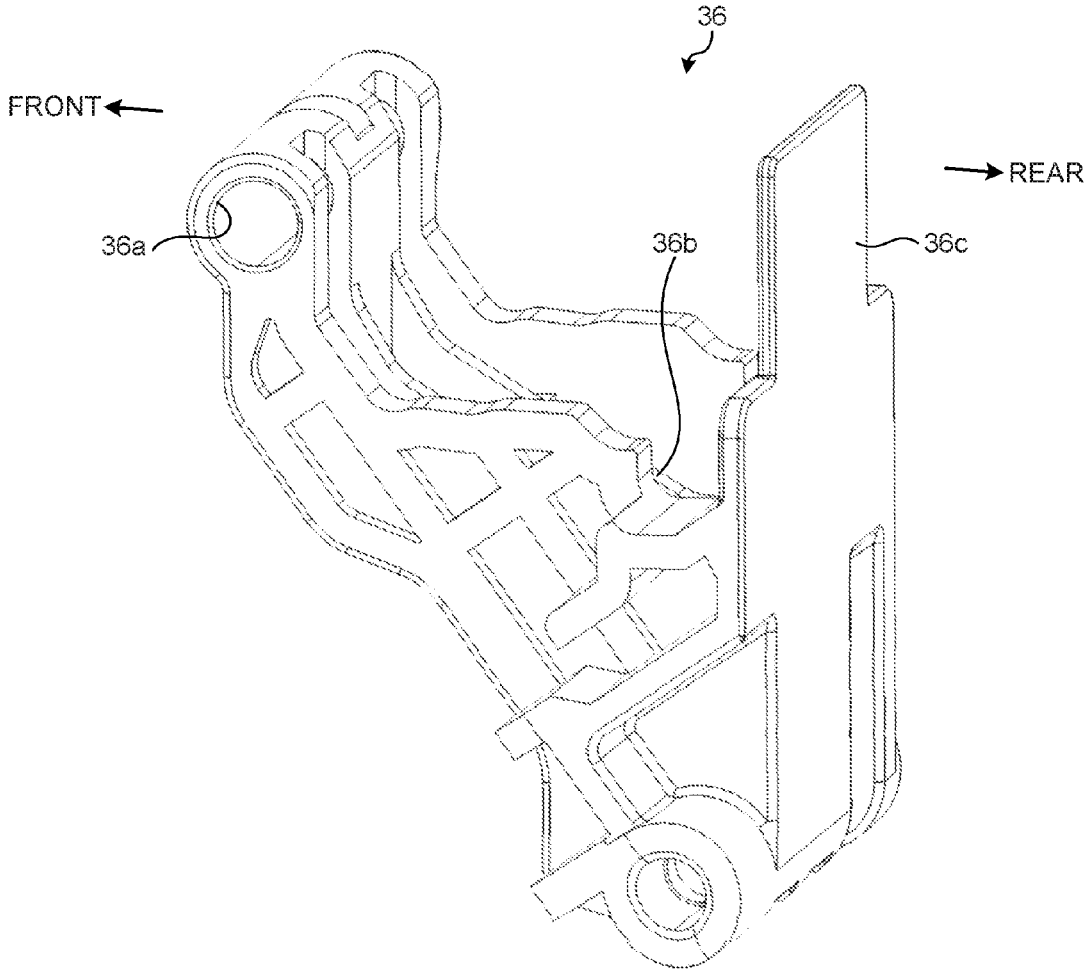
FIG. 14 is a perspective view of a rotation stopper constituting the first product discharging device illustrated in FIGS. 2 to 5.

As illustrated in FIG. 14, the rotation stopper 36 is provided with a panel-like blindfold portion 36*c* extending upward on the rear side thereof, that is, on the rear side of the recessed portion 36*b*. The blindfold portion 36*c* covers a part of the pedal stopper pin 34*b* opposite to the first product storage passage 13*a*. More specifically, the blindfold portion 36*c* covers the part, which is opposite to the first product storage passage 13*a*, of the pedal stopper pin 34*b* moving in the vertical direction.

The pedal link 35 is a long plate-like member extending in the vertical direction and an upper portion thereof is bent to the front side and then extends upward. The upper portion of the pedal link 35 is provided with a contact piece 351 extending backward and then extending obliquely upward and a locking portion 352 locking a link spring 35*a*. The link spring 35*a* is interposed between the pedal link 35 and the base 21 and normally biases the pedal link 35 downward.

In a state in which the pedal link 35 is biased by the link spring 35*a* and is located on the lower side, the stopper pin 34*a* is disposed at the lower ends of the stopper pin insertion holes 23*b*3 and 24*c*1 and the pedal stopper pin 34*b* is disposed at the lower ends of the stopper pin support grooves 23*b*4 and 24*c*2. In this state, the concave portion 292 of the upper pedal 29 disposed at the backward-moved position comes in contact with the stopper pin 34*a*. The rotation stopper 36 disposed at the forward-moved position comes in contact with the pedal stopper pin 34*b* to regulate the backward movement of the rotation stopper 36. The pedal operating shaft 361 of the rotation stopper 36 disposed at the forward-moved position is fitted into the fitting portion 283*a* of the lower pedal 28 to regulate the backward movement of the lower pedal 28 disposed at the forward-moved position.

On the other hand, in the state in which the pedal link 35 is located on the upper side against the biasing force of the link spring 35*a*, as illustrated in FIG. 8, the stopper pin 34*a* is disposed at the upper ends of the stopper pin insertion holes 23*b*3 and 24*c*1 and the pedal stopper pin 34*b* is disposed at the upper ends of the pedal stopper pin support grooves 23*b*4 and 24*c*2. In this state, the stopper contact portion 293 of the upper pedal 29 comes in contact with the stopper pin 34*a* to regulate the backward movement of the upper pedal 29, and the upper pedal 29 moves forward against the biasing force of the upper pedal spring and is disposed at the forward-moved position.

On the other hand, since the regulation of the backward movement due to the pedal stopper pin 34*b* is released, the regulation of the backward movement of the rotation stopper 36 with respect to the stopper shaft 34*c* is released. Here, the weight of a product coming in contact with the lower pedal 28 maintained at the forward-moved position by the rotation stopper 36 is applied to the rotation stopper 36, and the rotation stopper 36 starts its backward movement with releasing the regulation of the backward movement of the rotation stopper 36. When the backward movement of the rotation stopper 36 is started, the pedal operating shaft 361 departs from the fitting portion 283*a* of the lower pedal 28. Accordingly, the lower pedal 28 is allowed to move backward about the first swing support shaft 28*a* and moves backward against the elastic biasing force of the lower pedal spring 28*b* by the weight of the product (see FIG. 8).

Figure 15:
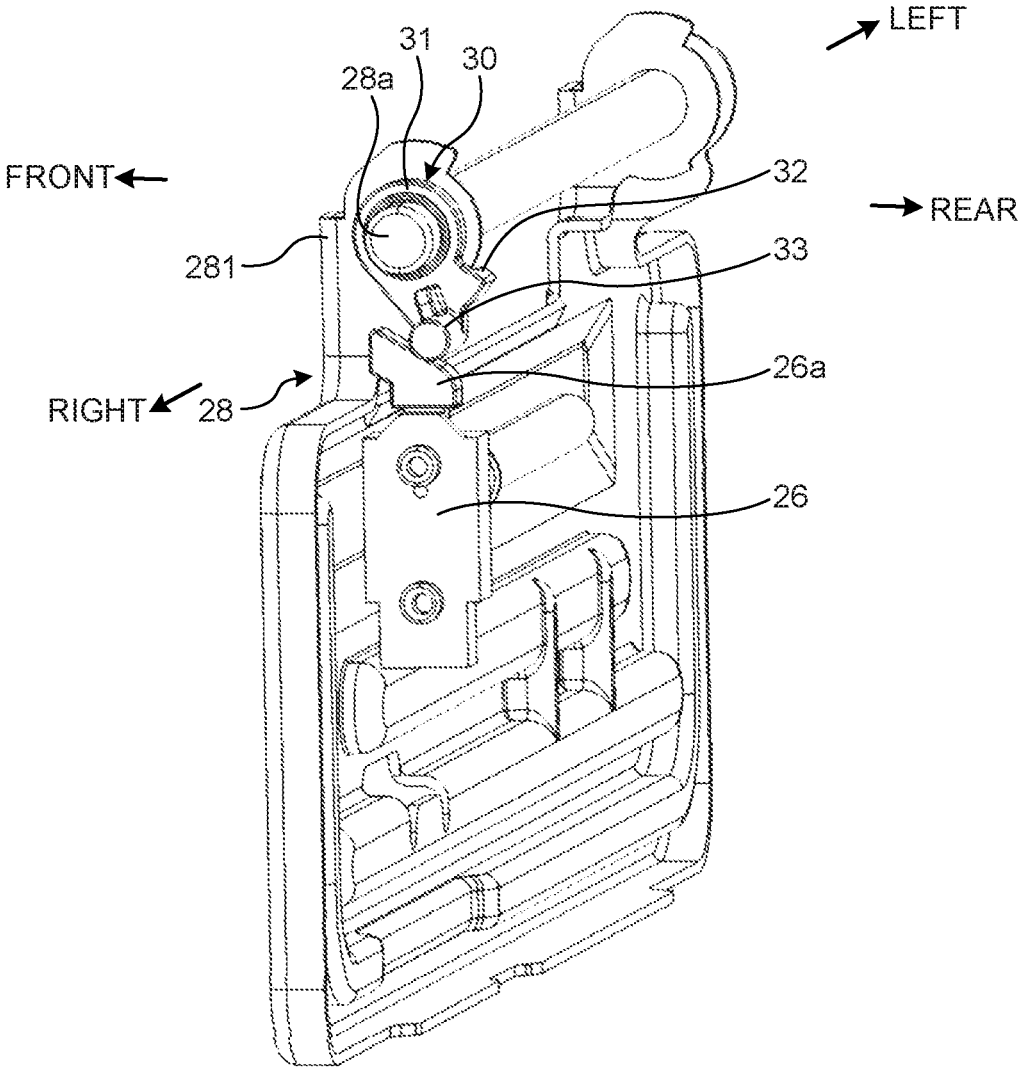
FIG. 15 is a perspective view illustrating a relationship of the first sold-out link and the first sold-out detection switch when the lower pedal moves backward.

When the lower pedal 28 moves backward in this way, as illustrated in FIG. 15, the base end of the lower pedal 28 is separated from the first sold-out contact portion 32 of the first sold-out link 30 and thus the first sold-out link 30 is switched to the free state. Accordingly, in the first sold-out detection switch 26, the contactor 26*a* is based by the spring to rise upright and thus to maintain the OFF state. That is, when the lower pedal 28 moves backward, similarly to the product-present standby posture, the first sold-out link 30 does not press the contactor 26*a* of the first sold-out detection switch 26.

The first product discharging device 20*a* having such a configuration includes a drive unit 40 in addition to the above-mentioned configuration.

Figure 16:
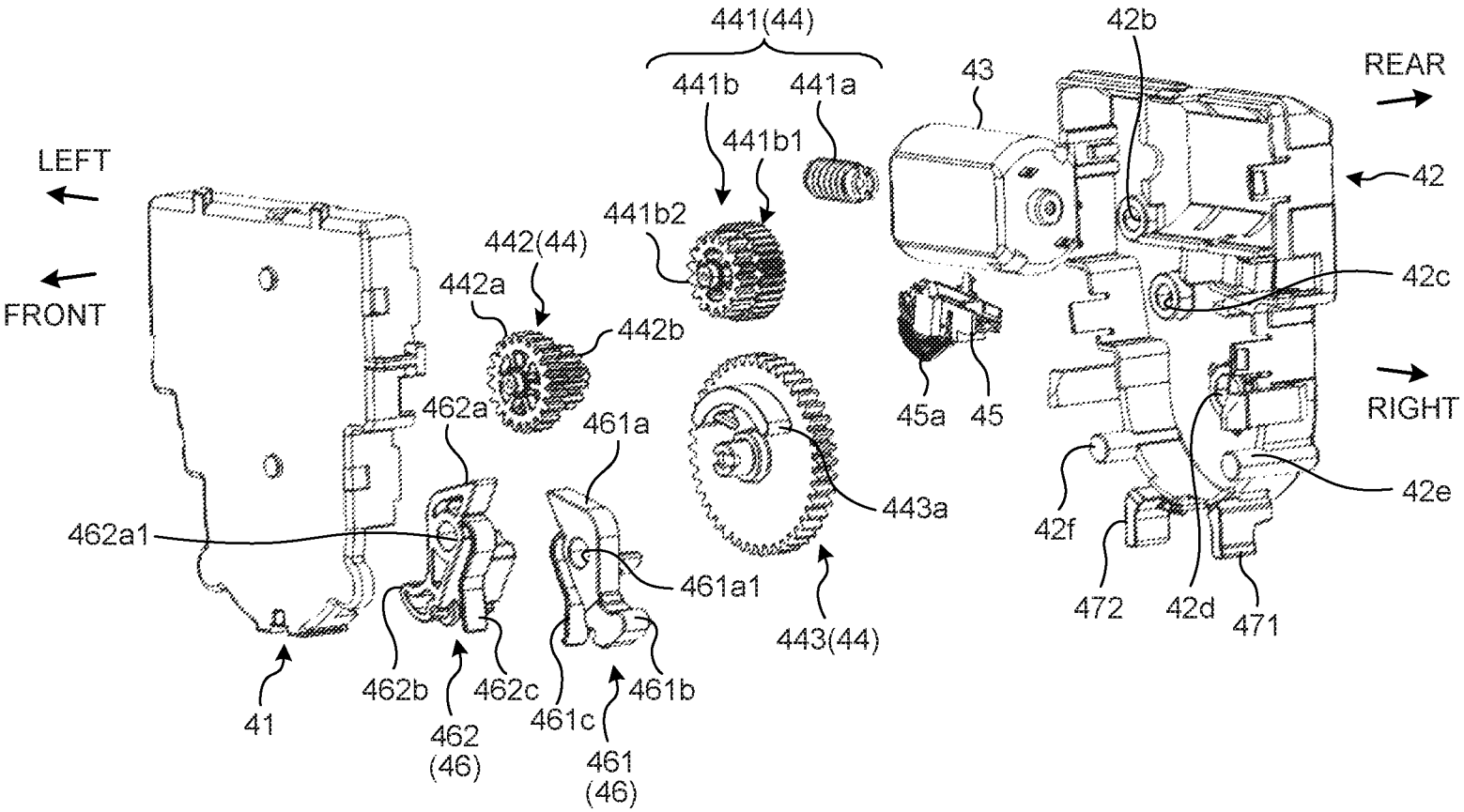
FIG. 16 is an exploded perspective view illustrating principal parts of a drive unit in the first product discharging device when viewed from the front-right side.
Figure 17:
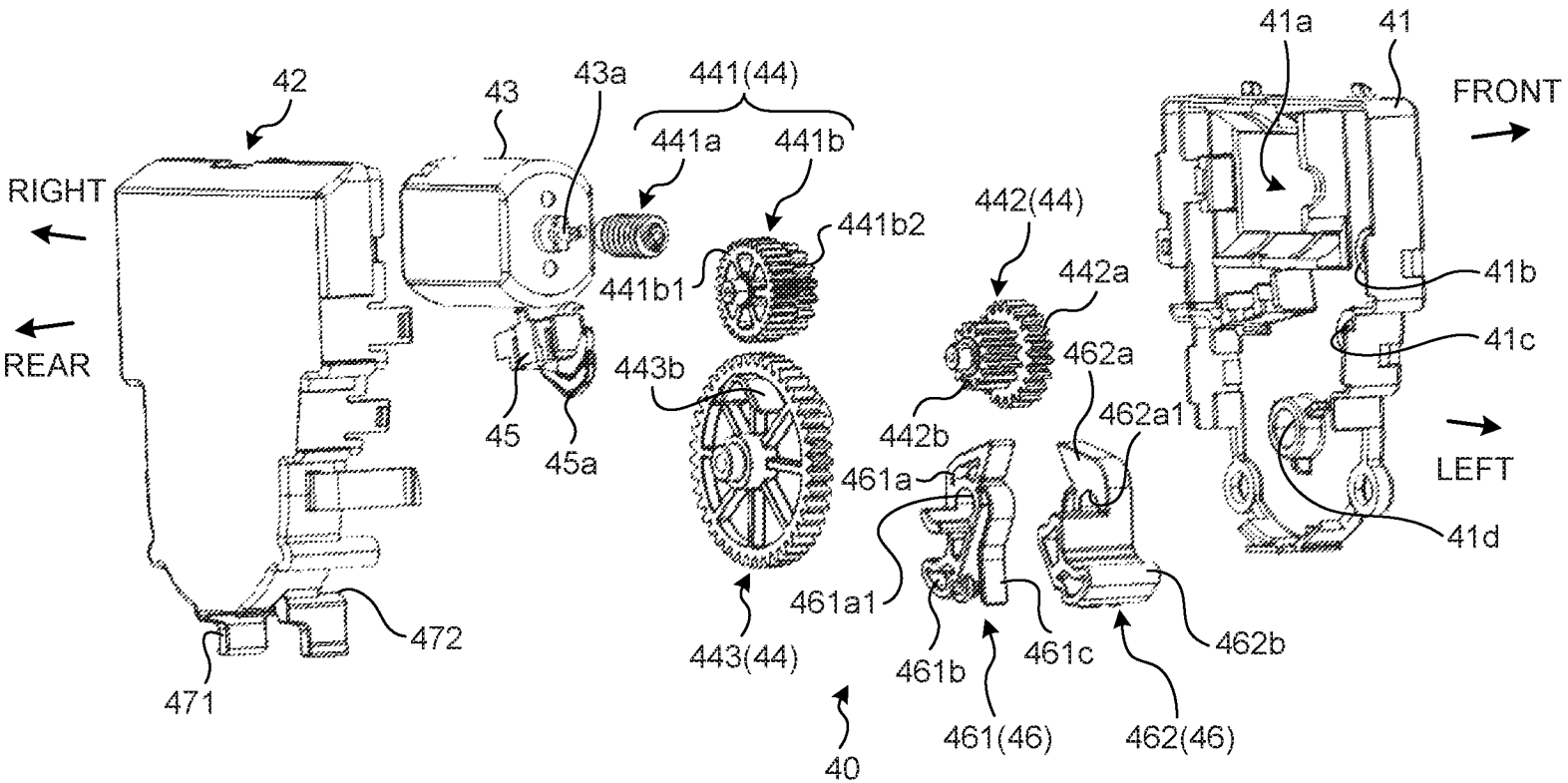
FIG. 17 is an exploded perspective view illustrating principal parts of the drive unit in the first product discharging device when viewed from the rear-left side.

FIGS. 16 and 17 illustrate principal parts of the drive unit 40 in the first product discharging device 20*a*, where FIG. 16 is an exploded perspective view thereof when viewed from the front-right side and FIG. 17 is an exploded perspective view thereof when viewed from the rear-left side.

The drive unit 40 is disposed in an upper center area of the rear side of the base 21. The drive unit 40 includes a unit base 41 which is attached to the rear surface of the base 21.

The unit base 41 is formed of, for example, a resin material and is formed in a box shape of which the rear surface is opened. In the unit base 41, the opening of the rear surface is closed by attaching a unit cover 42 formed of a resin thereto, thereby forming a storage space between the unit base and the unit cover 42. A motor 43, a gear member 44, a carrier switch 45, and a link lever 46 are stored in the storage space formed by the unit base 41 and the unit cover 42.

The motor 43 serves as a drive source and is a DC motor that is rotatable positively and reversely and that is driven in accordance with a command issued from the dispensing control unit 110 to be described later. The motor 43 is disposed in a state in which the motor is held by a motor holding portion 41*a* of the unit base 41.

The gear member 44 includes a worm gear 441, an intermediate gear 442, and an output gear 443. The worm gear 441 includes a worm 441*a* and a worm wheel 441*b*.

The worm 441*a* has a cylindrical shape and is attached to an output shaft 43*a* of the motor 43. The worm wheel 441*b* includes a first worm wheel 441*b*1 having a disk shape and a second worm wheel 441*b*2 having a disk shape.

In the first worm wheel 441*b*1, an axial portion protruding rearward is formed at the center thereof and a gear portion including plural teeth is formed on the circumferential surface thereof.

The second worm wheel 441*b*2 is located on the front side of the first worm wheel 441*b*1 and is formed such that an axial portion of which the central axis matches the central axis of the axial portion of the first worm wheel 441*b*1 protrudes to the front side. A gear portion including plural teeth is also formed on the circumferential surface of the second worm wheel 441*b*2.

The worm wheel 441*b* is disposed to be rotatable about the central axis of the axial portion by inserting the axial portion into concave portions 41*b* and 42*b* of the unit base 41 and the unit cover 42 in a state in which the gear portion of the first worm wheel 441*b*1 engages with the worm 441*a*.

The intermediate gear 442 includes a disk-like first intermediate gear 442*a* and a disk-like second intermediate gear 442*b*. In the first intermediate gear 442*a*, an axial portion protruding to the rear side is formed at the center thereof and a gear portion including plural teeth is formed on the circumferential surface thereof.

The second intermediate gear 442*b* is located on the rear side of the first intermediate gear 442*a* and is disposed such that an axial portion of which the central axis matches the central axis of the axial portion of the first intermediate gear 442*a* protrudes to the front side. A gear portion including plural teeth is also formed on the circumferential surface of the second intermediate gear 442*b*.

The intermediate gear 442 is disposed to be rotatable about the central axis of the axial portion by inserting the axial portion into concave portions 41*c* and 42*c* of the unit base 41 and the unit cover 42 in a state in which the gear portion of the first intermediate gear 442*a* engages with the gear portion of the second worm wheel 441*b*2.

The output gear 443 has a disk shape having a diameter larger than that of the worm wheel 441*b* or the intermediate gear 442. A gear portion including plural teeth is also formed on the circumferential surface of the output gear 443. An axial portion protruding in the front-rear direction is formed at the center of the output gear 443. A cam portion 443*a* is formed on the front surface of the output gear 443 and a pressing piece 443*b* is formed on the rear surface thereof.

The cam portion 443*a* has an arc shape and is formed to protrude to the front side. The cam portion 443*a* is formed such that the length of the arc shape thereof is set to a size sufficient for holding a state in which the pedal link 35 has moved upward.

The pressing piece 443*b* has a substantially V shape and is formed to protrude to the rear side on the rear surface opposite to the cam portion 443*a*.

The output gear 443 is disposed to be rotatable about the central axis of the axial portion by inserting the axial portion into concave portions 41*d* and 42*d* of the unit base 41 and the unit cover 42 in a state in which the gear portion engages with the gear portion of the second intermediate gear 442*b*.

The carrier switch 45 is a so-called push type switch and includes a contactor 45*a*. The carrier switch 45 is disposed in the unit base 41 in a state in which the carrier switch is held slightly above the area in which the output gear 443 is disposed. The carrier switch 45 is switched to an ON state to supply details thereof as an ON signal to the dispensing control unit 110 when the contactor 45*a* is pressed, and is switched to an OFF state to supply details thereof as an OFF signal to the dispensing control unit 110 when the contactor 45*a* is not pressed.

The link lever 46 includes a first link lever 461 and a second link lever 462. The first link lever 461 is formed of, for example, a resin material and a through-hole 461*a*1 is formed at a base end 461*a* thereof. The first link lever 461 has a hook shape in which a tip portion 461*b* extends obliquely downward to the right side from the base end 461*a* and is then curved obliquely upward to the right side. The base end 461*a* of the first link lever 461 is provided with a locking portion 461*c*. The locking portion 461*c* is a plate-like elastic member which extends downward from the left end of the base end 461*a* and which is elastically deformable.

The first link lever 461 is disposed to be rotatable about the central axis of a first link shaft 42*e* on the front side of the output gear 443 by inserting the first link shaft 42*e* disposed in the unit cover 42 into the through-hole 461*a*1 of the base end 461*a*. In this case, the first link lever 461 penetrates a right opening (not illustrated) formed by the unit base 41 and the unit cover 42 and the tip portion 461*b* is located outside the unit base 41 and the unit cover 42. The posture in the normal state of the first link lever 461 is determined by bringing the locking portion 461*c* into contact with a left edge portion 471 of the right opening.

The second link lever 462 is formed of, for example, a resin material and a through-hole 462*a*1 is formed at a base end 462*a* thereof. The second link lever 462 has a hook shape in which a tip portion 462*b* extends obliquely downward to the left side from the base end 462*a* and is then curved obliquely upward to the left side. The tip portion 462*b* of the second link lever 462 has a width in the front-rear direction larger than that of the tip portion 461*b* of the first link lever 461. The base end 462*a* of the second link lever 462 is provided with a locking portion 462*c*. The locking portion 462*c* is a plate-like elastic member which extends downward from the right end of the base end 462*a* and which is elastically deformable.

The second link lever 462 is disposed to be rotatable about the central axis of a second link shaft 42*f* on the front side of the output gear 443 by inserting the second link shaft 42*f* disposed in the unit cover 42 into the through-hole 462*a*1 of the base end 462*a*. In this case, the second link lever 462 penetrates a left opening (not illustrated) formed by the unit base 41 and the unit cover 42 and the tip portion 462*b* is located outside the unit base 41 and the unit cover 42. The posture in the normal state of the second link lever 462 is determined by bringing the locking portion 462*c* into contact with a right edge portion 472 of the left opening.

Figure 18:
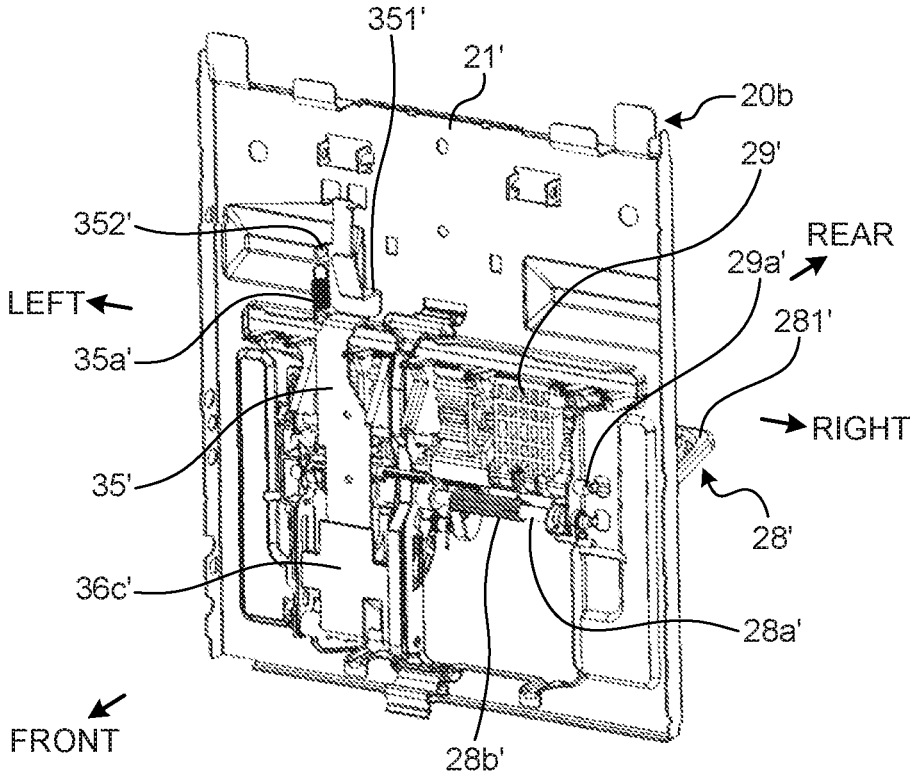
FIG. 18 is a perspective view illustrating a second product discharging device illustrated in FIGS. 2 to 4 when viewed from the front-right side.
Figure 19:
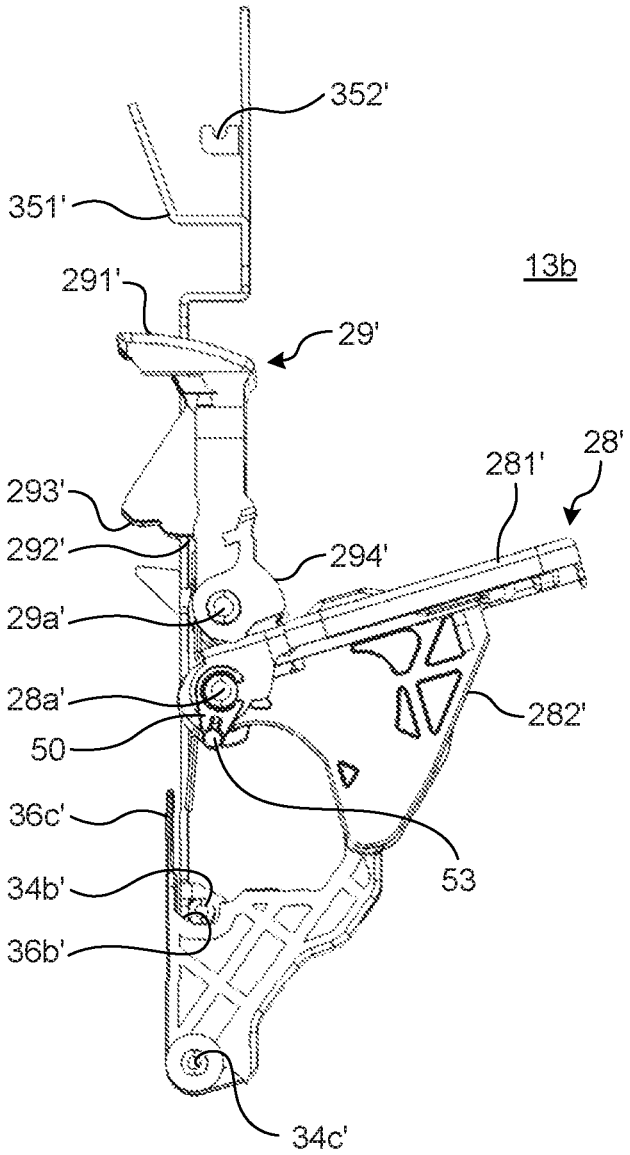
FIG. 19 is a diagram schematically illustrating a principal part of the second product discharging device illustrated in FIGS. 2 to 4 and FIG. 18 when viewed from the right side.

FIG. 18 is a perspective view illustrating the second product discharging device 20*b* illustrated in FIGS. 2 to 4 when viewed from the front-right side. FIG. 19 is a diagram schematically illustrating principal parts of the second product discharging device 20*b* illustrated in FIGS. 2 to 4 and FIG. 18 when viewed from the right side. The most elements of the second product discharging device 20*b* are common to the elements of the first product discharging device 20*a* and are different from the elements of the first product discharging device 20*a*, in that the front-rear direction is different and thus the right-left direction is reversed. Accordingly, in the description of the second product discharging device 20*b*, the elements will be appropriately omitted, and the elements of the second product discharging device 20*b* common to the elements of the first product discharging device 20*a* will be referenced by adding "'" to the reference signs in the first product discharging device 20*a* and will be described in brief.

The second product discharging device 20*b* is applied to the second product storage passage 13*b* and is disposed in the bottom of the second product storage passage 13*b*. The second product discharging device 20*b* serves to store products in the second product storage passage 13*b* in a standby state and to discharge a product to the product chute 5 in an activated state by controlling behavior of product between an opposite passage width defining plate 17 and the second product discharging device, and includes a base 21'.

Figure 20:
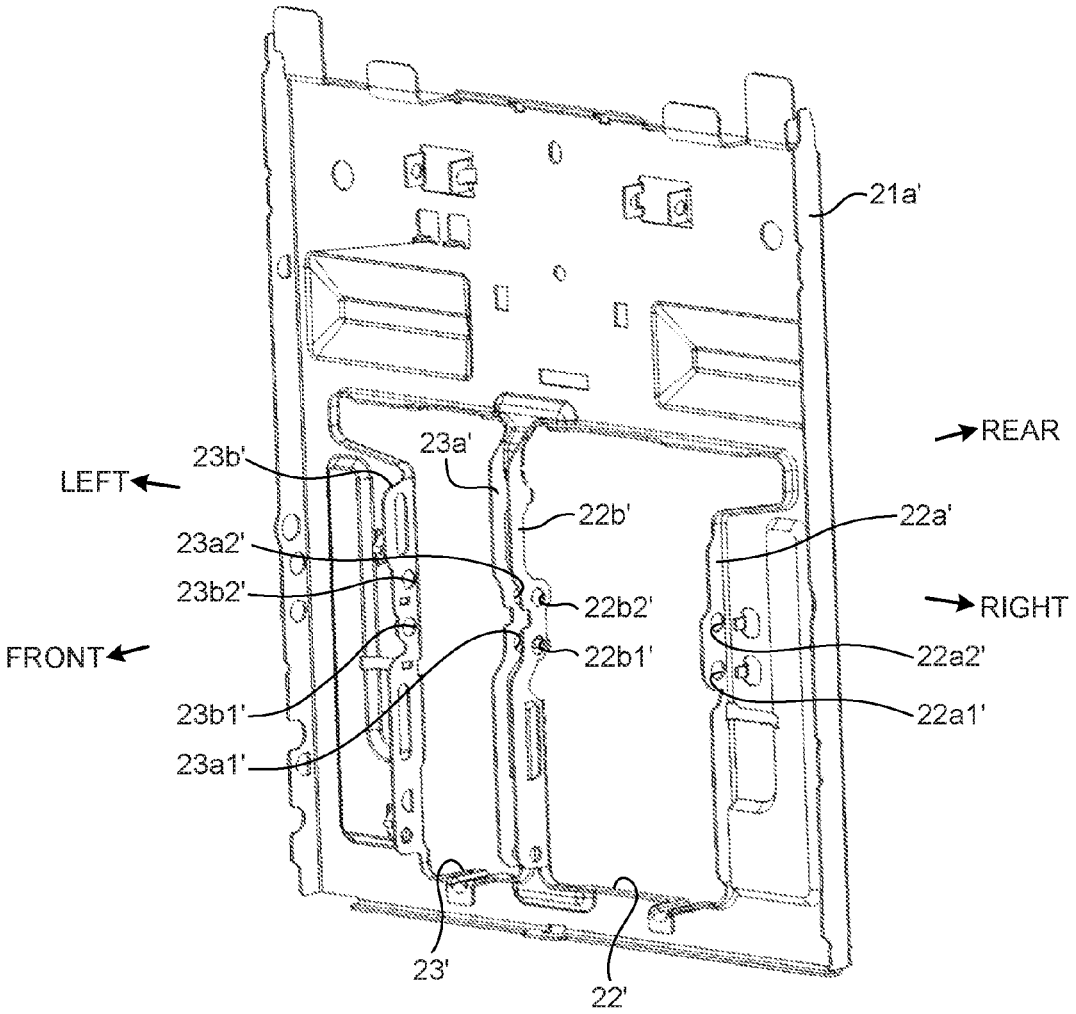
FIG. 20 is a perspective view illustrating a base of the second product discharging device illustrated in FIG. 18.

As illustrated in FIG. 20, the base 21' is formed by performing a cutting process and a bending process on a steel sheet and is disposed to cause its own surface to face the passage width defining plate 17. A side wall 21*a*' of the base 21' is formed by bending both sides and a first insertion hole 22' and a second insertion hole 23' are formed in an intermediate portion thereof. The circumferential edges of the first insertion hole 22' and the second insertion hole 23' are bent similarly to the side wall 21*a*' to form a flange.

The first insertion hole 22' and the second insertion hole 23' are arranged in the right-left direction and have the same size in the vertical direction. Among the first insertion hole 22' and the second insertion hole 23', the first insertion hole 22' is located on the right side of the second insertion hole 23', and the width in the right-left direction of the first insertion hole 22' is larger than the width in the right-left direction of the second insertion hole 23'. The first insertion hole 22' and the second insertion hole 23' are through-openings (concave portions for enabling the lower pedal 28' and the upper pedal 29' to be described later to move backward into the base 21') having a substantially rectangular shape as a whole, the top end of the first insertion hole 22' protrudes to the right side, and the top end of the second insertion hole 23' protrudes to the left side. A first right bearing piece 22*a*' is disposed at the right edge portion of the first insertion hole 22', a first left bearing piece 22*b*' is disposed at the left edge portion of the first insertion hole 22', a second right bearing piece 23*a*' is disposed at the right edge portion of the second insertion hole 23', and a second left bearing piece 23*b*' is disposed at the left edge portion of the second insertion hole 23'. The first left bearing piece 22*b*' and the second right bearing piece 23*a*' correspond to the flange formed at the circumferential edges of the first insertion hole 22' and the second insertion hole 23'. The first left bearing piece 22*b*' and the second right bearing piece 23*a*' are formed integrally with the base 21' in which a bearing portion 24' to be described later is fitted and supported, and are formed in shaft insertion flanges forming both U-shaped leg portions in a bearing support portion formed in a U-shaped cross-section (discontinuous). The bearing support portion has a function of maintaining the strength of the base 21' even when a through-opening including the first insertion hole 22' and the second insertion hole 23' which form a substantially rectangular shape as a whole is formed in the base 21'.

Figure 21:
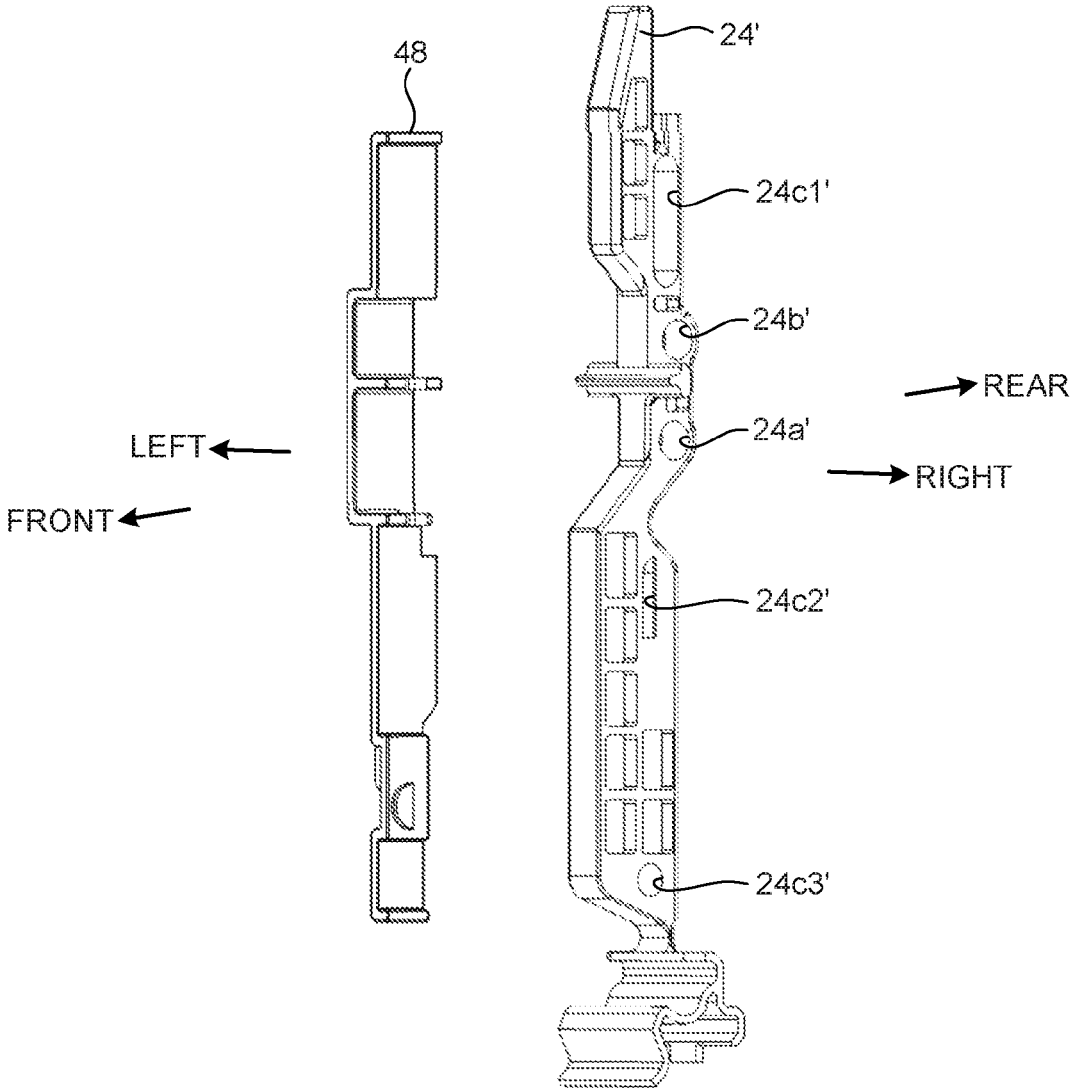
FIG. 21 is a perspective view illustrating a bearing portion and a guide attached to the base illustrated in FIG. 20.

As illustrated in FIG. 21, the bearing portion 24' and a guide 48 are attached to the base 21' having the above-mentioned configuration. The bearing portion 24' is formed of a resin material or the like and is interposed between the first left bearing piece 22*b*' and the second right bearing piece 23*a*'. The guide 48 is formed of a resin material or the like similarly to the bearing portion 24' and is disposed in the base 21' so as to be adjacent to the second left bearing piece 23*b*'.

The base 21' is provided with a first swing support shaft 28*a*' and a second swing support shaft 29*a*'. The first swing support shaft 28*a*' is an axial member disposed to penetrate through-holes 22*a*1', 22*b*1', 23*a*1', 23*b*1', and 24*a*' formed in the first right bearing piece 22*a*', the first left bearing piece 22*b*', the second right bearing piece 23*a*', the second left bearing piece 23*b*', and the bearing portion 24' so as to extend substantially in the horizontal direction, and supports the lower pedal 28' in the middle way.

A second sold-out link 50 is disposed at the right end of the first swing support shaft 28*a*'. As illustrated in FIG. 11, the second sold-out link 50 includes a second sold-out base portion 51, a second sold-out contact portion 52, and a second sold-out pressing portion 53. The second sold-out base portion 51 is formed, for example, by connecting the lower ends of two disc-shaped portions 511 and 512 having a C-shape to a connecting portion 513, and penetration holes 511*a* and 512*a* penetrated by the right end of the first swing support shaft 28*a*' are formed in the disc-shaped portions 511 and 512, respectively. The second sold-out contact portion 52 extends to the left side from the disc-shaped portion 512 of the left side of the second sold-out base portion 51. The second sold-out contact portion 52 is disposed on the left side of the first sold-out contact portion 32 constituting the first sold-out link 30 so as not to interfere with each other. The second sold-out pressing portion 53 is formed to protrude to the right side from the lower part of the right disc-shaped portion 511 of the second sold-out base portion 51. The penetration holes 511*a* and 512*a* formed in the second sold-out base portion 51 are formed to be larger than the first swing support shaft 28*a*' and are configured such that the second sold-out link 50 can freely move relative to the first swing support shaft 28*a*'.

The second swing support shaft 29*a*' is an axial member disposed to penetrate the through-holes 22*a*2', 22*b*2', 23*a*2', 23*b*2', and 24*b*' formed in the first right bearing piece 22*a*', the first left bearing piece 22*b*', the second right bearing piece 23*a*', the second left bearing piece 23*b*', and the bearing portion 24' so as to extend in the substantially horizontal direction in an area above the first swing support shaft 28*a*', and supports the upper pedal 29' in the middle way.

The lower pedal 28' is a plate-like member and is disposed to be swingable about the central axis of the first swing support shaft 28*a*' by inserting the first swing support shaft 28*a*' into the base end thereof.

The tip portion of the lower pedal 28' extends in an outer radial direction of the first swing support shaft 28*a*', and can move forward to and backward from the second product storage passage 13*b* via the first insertion hole 22' and the second insertion hole 23' when the lower pedal swings about the central axis of the first swing support shaft 28*a*'. That is, the lower pedal 28' is swingably disposed to move forward to and backward from the second product storage passage 13*b*.

A lower pedal spring 28*b*' is interposed between the lower pedal 28 and the base 21'. The lower pedal spring 28*b*' normally biases the lower pedal 28' in the forward moving direction to the second product storage passage 13*b*. More specifically, the lower pedal spring 28*b*' causes the lower pedal 28' to take a standby posture (hereinafter, also referred to as a product-absent standby posture) such that the tip portion of the lower pedal 28' is located higher than the first swing support shaft 28*a*' as illustrated in FIG. 19. When product is placed on the top surface of the lower pedal 28', the lower pedal spring 28*b*' causes the lower pedal 28' to take a standby posture (hereinafter, also referred to as a product-present standby posture) such that the tip portion of the lower pedal 28' is located at the same height level as the first swing support shaft 28*a*'.

Accordingly, in the product-absent standby posture, the tip portion of the lower pedal 28' is located higher than that of the product-present standby posture.

When the lower pedal 28' takes the product-absent standby posture, the base end of the lower pedal 28' comes in contact with the second sold-out contact portion 52 of the second sold-out link 50 as illustrated in FIG. 12, thus the second sold-out link 50 rotates about the first swing support shaft 28*a*', and thus the second sold-out pressing portion 53 presses the contactor 27*a* of the second sold-out detection switch 27. Accordingly, in the second sold-out detection switch 27, the contactor 27*a* is pressed and displaced backward against the biasing force of the spring and is switched to the ON state, and thus an ON signal is output to the dispensing control unit 110.

On the other hand, when the lower pedal 28' takes the product-present standby posture, the base end of the lower pedal 28' is separated from the second sold-out contact portion 52 of the second sold-out link 50 and thus the second sold-out link 50 is switched to a free state. Accordingly, in the second sold-out detection switch 27, the contactor 27*a* is biased by the spring to rise upright and is switched to the OFF state, and thus an OFF signal is output to the dispensing control unit 110. That is, the second sold-out link 50 switched to the free state rotates about the first swing support shaft 28*a*' by pressing the second sold-out pressing portion 53 against the contactor 27*a*.

The lower pedal 28' includes a plate-like pedal body 281' and a pair of guide portions 282'. The pair of guide portions 282' is disposed on the rear side of the pedal body 281'. Each guide portion 282' is a plate-like member extending in the vertical direction and both are formed to face each other. A guide groove (not illustrated) is formed on the facing surfaces of the guide portions 282'.

The guide groove includes a fitting portion which is located at the lowest position in a state in which the lower pedal 28' is disposed at a forward-moved position at which the lower pedal most moves forward to the second product storage passage 13*b* and into which a pedal operating shaft (not illustrated) of a rotation stopper 36' to be described later is fitted, a contact portion which is located at the highest position in a state in which the lower pedal 28' is disposed at a backward-moved position at which the lower pedal most moves backward from the second product storage passage 13*b* and with which the pedal operating shaft of the rotation stopper 36' comes in contact, and a first guide portion and a second guide portion which are continuously connected to the fitting portion and the contact portion.

The first guide portion is formed in the guide portion 282' to be inclined obliquely upward from the fitting portion so as to get away from the base 21', be inclined obliquely upward so as to get close to the base 21', and then reach the contact portion in a state in which the lower pedal 28' is located at the position (forward-moved position) at which the lower pedal most moves forward to the second product storage passage 13*b*.

The second guide portion is formed in the guide portion 282' to be inclined obliquely downward from the contact portion so as to get away from the base 21' and then reach the fitting portion in a state in which the lower pedal 28' is located at the position (forward-moved position) at which the lower pedal most moves forward to the second product storage passage 13*b*.

The length in the outer radial direction of the lower pedal 28' from the first swing support shaft 28*a*' is set to a length with which a gap smaller than the maximum width of a product having a small maximum width can be secured between the passage width defining plate 17 and the lower pedal when the lower pedal is located at the position (forward-moved position) at which the lower pedal most moves forward to the second product storage passage 13*b*.

The upper pedal 29' is a plate-like member and is disposed in the base 21' so as to be swingable about the central axis of the second swing support shaft 29*a*' by inserting the second swing support shaft 29*a*' into the base end thereof.

The tip portion of the upper pedal 29' extends in an outer radial direction of the second swing support shaft 29*a*', and can move forward to and backward from the second product storage passage 13*b* via the first insertion hole 22' and the second insertion hole 23' when the upper pedal swings about the central axis of the second swing support shaft 29*a*'. That is, the upper pedal 29' is swingably disposed to move forward to and backward from the second product storage passage 13*b*.

An upper pedal spring (not illustrated) is interposed between the upper pedal 29' and the base 21'. The upper pedal spring normally biases the upper pedal 29' in the backward moving direction to the second product storage passage 13*b*.

The upper pedal 29' is provided with a pressing inclined surface 291', a concave portion 292', a stopper contact portion 293', and a protrusion 294'. The pressing inclined surface 291' is disposed in the tip portion of the upper pedal 29' and is a curved inclined surface which is formed to be gradually lowered toward the second product storage passage 13*b* when the upper pedal 29' moves backward from the second product storage passage 13*b*. The concave portion 292' is disposed on the rear side of the upper pedal 29' and is a set of concave places extending substantially in the horizontal direction and being formed to be opened to both side surfaces of the upper pedal 29'. The stopper contact portion 293' is a portion with which a stopper pin to be described later comes in contact and is disposed to be inclined to the upper side of the concave portion 292' on the rear surface of the upper pedal 29'.

The protrusion 294' is disposed at the base end of the upper pedal 29' so as to protrude toward the second product storage passage 13*b*.

The upper pedal 29' is biased to move backward from the second product storage passage 13*b* by a biasing force of the upper pedal spring, but the initial position thereof is set in a state in which the upper pedal moves backward from the second product storage passage 13*b* by bringing the stopper pin into contact with the concave portion 292'.

The upper pedal 29' is inclined to the front side with respect to the vertical plane passing through the second swing support shaft 29*a'* in a state in which the upper pedal is located at the position (forward-moved position) at which the upper pedal most moves forward to the second product storage passage 13*b*. The length in the outer radial direction of the upper pedal 29' from the second swing support shaft 29*a'* is set to a length with which a gap smaller than the maximum width of a product having a small maximum width can be secured between the passage width defining plate 17 and the upper pedal in the state in which the upper pedal is inclined to the front side.

In the base 21', the stopper pin (not illustrated), the pedal stopper pin 34*b'*, and the stopper shaft 34*c'* are disposed between the bearing portion 24' and the second left bearing piece 23*b'*.

The stopper pin is an axial member which is disposed substantially in the horizontal direction between the bearing portion 24' and the second left bearing piece 23*b'*. The stopper pin is coupled to the pedal link 35' and is movable in the vertical direction with the movement in the vertical direction of the pedal link 35'. The stopper pin comes in contact with the concave portion 292' of the upper pedal 29' located at the initial position.

The pedal stopper pin 34*b'* is an axial member which is disposed substantially in the horizontal direction between the bearing portion 24' and the second left bearing piece 23*b'*. The pedal stopper pin 34*b'* is coupled to the pedal link 35' and is movable in the vertical direction with the movement in the vertical direction of the pedal link 35'.

The stopper shaft 34*c'* is an axial member which is disposed substantially in the horizontal direction between the bearing portion 24' and the second left bearing piece 23*b'* and supports the rotation stopper 36' in the middle thereof.

The rotation stopper 36' is disposed between the bearing portion 24' and the second left bearing piece 23*b'* so as to insert the stopper shaft 34*c'* into the insertion hole of the base end thereof and to be swingable about the central axis of the stopper shaft 34*c'*.

The tip portion of the rotation stopper 36' extends in the outer radial direction of the stopper shaft 34*c'* and is movable forward to and backward from the second product storage passage 13*b* via the second insertion hole 23' when the rotation stopper swings about the central axis of the stopper shaft 34*c'*.

The rotation stopper 36' includes a pedal operating shaft 361' so as to insert the pedal operating shaft 361' (see FIG. 4) into the through-hole (not illustrated) of the tip portion thereof. The pedal operating shaft 361' is an axial member which is disposed substantially in the horizontal direction and both ends thereof are fitted into the guide grooves of the lower pedal 28'.

A pedal operating spring (not illustrated) is interposed between the rotation stopper 36' and the base 21'. The pedal operating spring normally biases the rotation stopper 36' in the forward moving direction to the second product storage passage 13*b*.

The rotation stopper 36' is biased in the forward moving direction to the second product storage passage 13*b* by the pedal operating spring, movement in the backward moving direction thereof is regulated by moving the pedal stopper pin 34*b'* into a recessed portion 36*b'* of the rotation stopper 36' to come in contact with the pedal stopper pin 34*b'*, and the initial position thereof in the state in which the rotation stopper moves forward to the second product storage passage 13*b* is set. Since the lower pedal 28' is biased by the lower pedal spring 28*b'*, the initial position of the rotation stopper 36' is set to a position at which both ends of the pedal operating shaft 361' are located in the fitting portion of the guide grooves and the lower pedal 28' moves forward to the second product storage passage 13*b*.

The rotation stopper 36' is provided with a panel-like blindfold portion 36*c'* extending upward on the rear side thereof, that is, on the rear side of the recessed portion 36*b'*. The blindfold portion 36*c'* covers a part of the pedal stopper pin 34*b'* opposite to the second product storage passage 13*b*. More specifically, the blindfold portion 36*c'* covers the part, which is opposite to the second product storage passage 13*b*, of the pedal stopper pin 34*b'* moving in the vertical direction.

The pedal link 35' is a long plate-like member extending in the vertical direction and an upper portion thereof is bent to the rear side and then extends upward. The upper portion of the pedal link 35' is provided with a contact piece 351' extending forward and then extending obliquely upward and a locking portion 352' locking a link spring 35*a'*. The link spring 35*a'* is interposed between the pedal link 35' and the base 21' and normally biases the pedal link 35' downward.

In a state in which the pedal link 35' is biased by the link spring 35*a'* and is located on the lower side, the concave portion 292' of the upper pedal 29' disposed at the backward-moved position comes in contact with the stopper pin. The rotation stopper 36' disposed at the forward-moved position comes in contact with the pedal stopper pin 34*b'* to regulate the backward movement of the rotation stopper 36'. The pedal operating shaft 361' of the rotation stopper 36' disposed at the forward-moved position is fitted into the fitting portion of the lower pedal 28' to regulate the backward movement of the lower pedal 28' disposed at the forward-moved position.

On the other hand, in the state in which the pedal link 35' is located on the upper side against the biasing force of the link spring 35*a'*, the stopper contact portion 293' of the upper pedal 29' comes in contact with the stopper pin to regulate the backward movement of the upper pedal 29', and the upper pedal 29' moves forward against the biasing force of the upper pedal spring and is disposed at the forward-moved position.

On the other hand, since the regulation of the backward movement due to the pedal stopper pin 34*b*' is released, the regulation of the backward movement of the rotation stopper 36' with respect to the stopper shaft 34*c*' is released. Here, the weight of a product coming in contact with the lower pedal 28' maintained at the forward-moved position by the rotation stopper 36' is applied to the rotation stopper 36', and the rotation stopper 36' starts its backward movement with releasing the regulation of the backward movement of the rotation stopper 36'. When the backward movement of the rotation stopper 36' is started, the pedal operating shaft 361' departs from the fitting portion 283*a* of the lower pedal 28'. Accordingly, the lower pedal 28' is allowed to move backward about the first swing support shaft 28*a*' and moves backward against the elastic biasing force of the lower pedal spring 28*b*' by the weight of the product.

When the lower pedal 28' moves backward in this way, the base end of the lower pedal 28' is separated from a second sold-out contact portion 52 of the second sold-out link 50 and thus the second sold-out link 50 is switched to the free state. Accordingly, in the second sold-out detection switch 27, the contactor 27*a* is based by the spring to rise upright and thus to maintain the OFF state. That is, when the lower pedal 28' moves backward, similarly to the product-present standby posture, the second sold-out link 50 does not press the contactor 27*a* of the second sold-out detection switch 27.

The product dispensing system 20 is constituted by coupling the first product discharging device 20*a* and the second product discharging device 20*b* having the above-mentioned configurations to each other back to back using the harness guide 25 as a guide member. In this case, the tip of the first link lever 461 constituting the drive unit 40 is located in an area below the contact piece 351 of the pedal link 35, and the tip of the second link lever 462 is located in an area below the contact piece 351' of the pedal link 35'.

Figure 22:
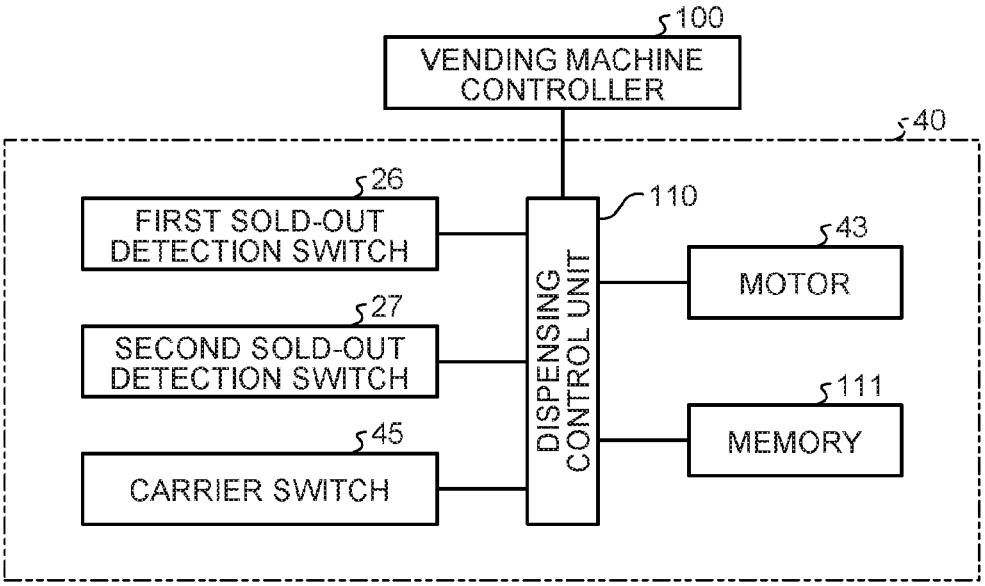
FIG. 22 is a block diagram illustrating a characteristic control system of the product dispensing system.

FIG. 22 is a block diagram illustrating a characteristic control system of the product dispensing system 20. As illustrated in FIG. 22, the product dispensing system 20 includes a dispensing control unit 110. The dispensing control unit 110 comprehensively controls the operations of the product dispensing system 20 on the basis of programs or data stored in a memory 111, and can communicate with a vending machine controller 100 that comprehensively controls the vending operation of the vending machine.

The product dispensing system 20 having the above-mentioned configuration operates as follows in the standby state.

In the drive unit 40 of the first product discharging device 20*a*, the cam portion 443*a* and the pressing piece 443*b* of the output gear 443 are located at the highest position and the pressing piece 443*b* presses the contactor 45*a* of the carrier switch 45. In this case, the carrier switch 45 is in the ON state. In this standby state, the tip portion 461*b* of the first link lever 461 constituting the drive unit 40 is located at a position separated downward from the contact piece 351 of the pedal link 35 and the tip portion 462*b* of the second link lever 462 is located at a position separated downward from the contact piece 351' of the pedal link 35'.

Figure 23:
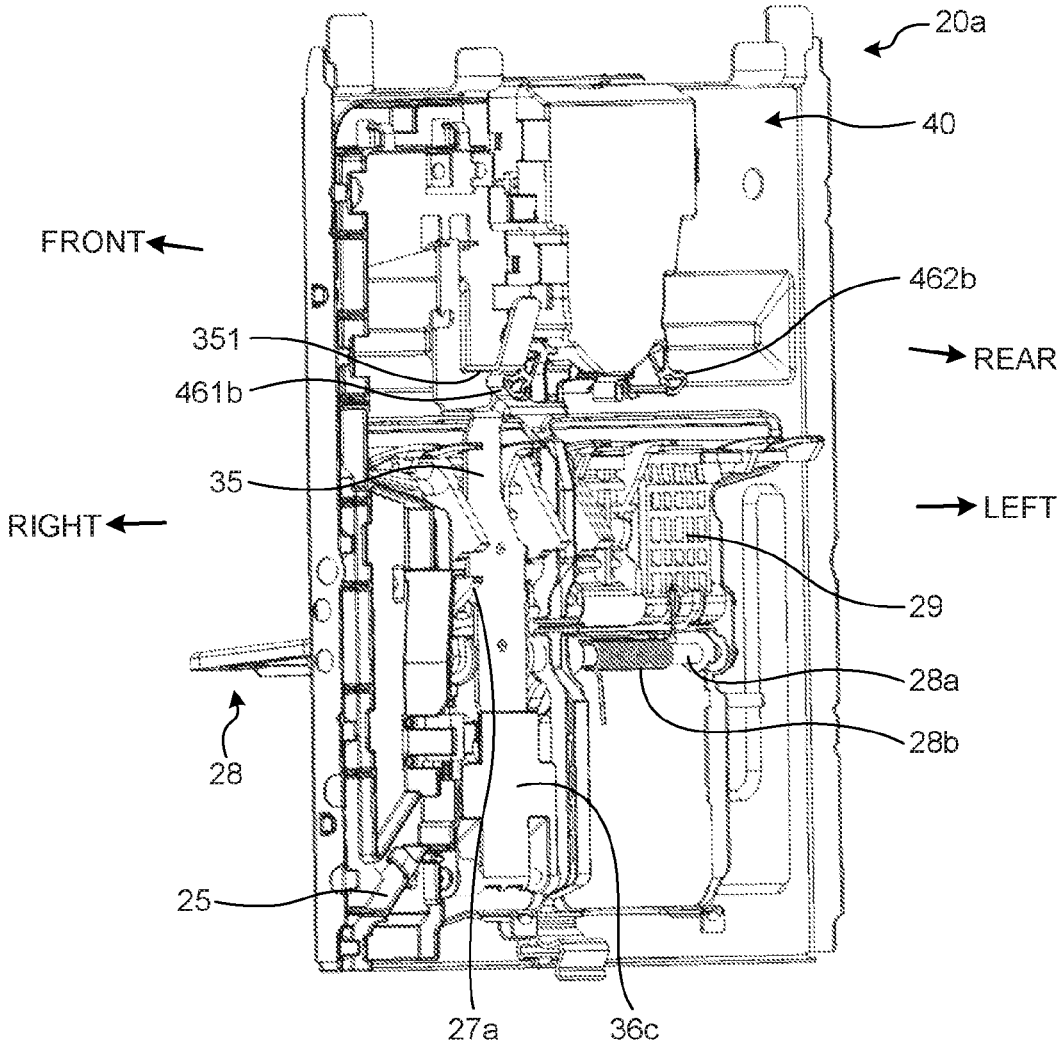
FIG. 23 is a perspective view illustrating the first product discharging device when viewed from the rear-right side.

Accordingly, in the first product discharging device 20*a*, as illustrated in FIG. 5 or 23, the pedal link 35 is disposed on the lower side. When a product is placed on the top surface of the lower pedal 28 due to the products input to the first product storage passage 13*a*, the lower pedal 28 takes the product-present standby posture and the upper pedal 29 takes the posture in which the upper pedal moves backward from the first product storage passage 13*a*. In this way, since the lower pedal 28 takes the product-present standby posture, the first sold-out detection switch 26 takes the posture in which the contactor 26*a* rises upright and is in the OFF state.

In the second product discharging device 20*b*, the pedal link 35' is disposed on the lower side, the lower pedal 28' takes the product-present standby posture, and the upper pedal 29' takes the posture in which the upper pedal moves backward from the second product storage passage 13*b*. In this way, since the lower pedal 28' takes the product-present standby posture, the second sold-out detection switch 27 takes the posture in which the contactor 27*a* rises upright and is in the OFF state.

Figure 24:
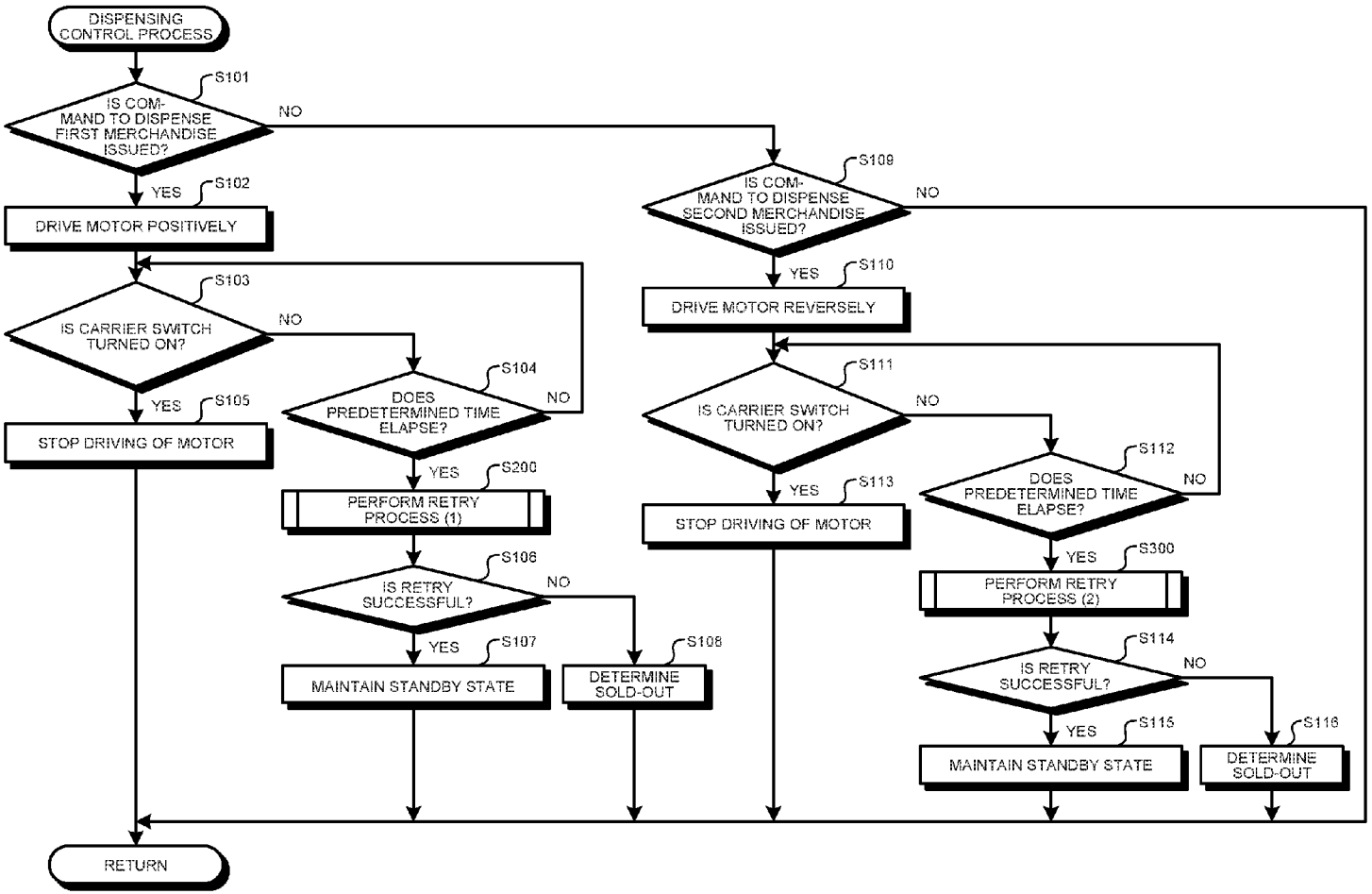
FIG. 24 is a flowchart illustrating process details of a dispensing control process which is performed by a dispensing control unit.

FIG. 24 is a flowchart illustrating processing details of a dispensing control process which is performed by the dispensing control unit 110. The operation of the product dispensing system 20 will be described below while describing the dispensing control process. In the following description, the product stored in the first product storage passage 13*a* is also referred to as "first product", and the product stored in the second product storage passage 13*b* is also referred to as "second product".

In the dispensing control process, when a command to discharge the first product is issued from the vending machine controller 100 (YES in step S101), the dispensing control unit 110 drives the motor 43 positively (step S102).

When the motor 43 is driven positively, the output gear 443 to which the driving force of the motor 43 is transmitted via the worm gear 441 and the intermediate gear 442 rotates clockwise in a front view.

When the output gear 443 rotates clockwise in a front view, the pressing piece 443*b* of the output gear 443 departs from the contactor 45*a* of the carrier switch 45. Accordingly, the contactor 45*a* of the carrier switch 45 is released from the pressed state and is switched to the OFF state.

Figure 25:
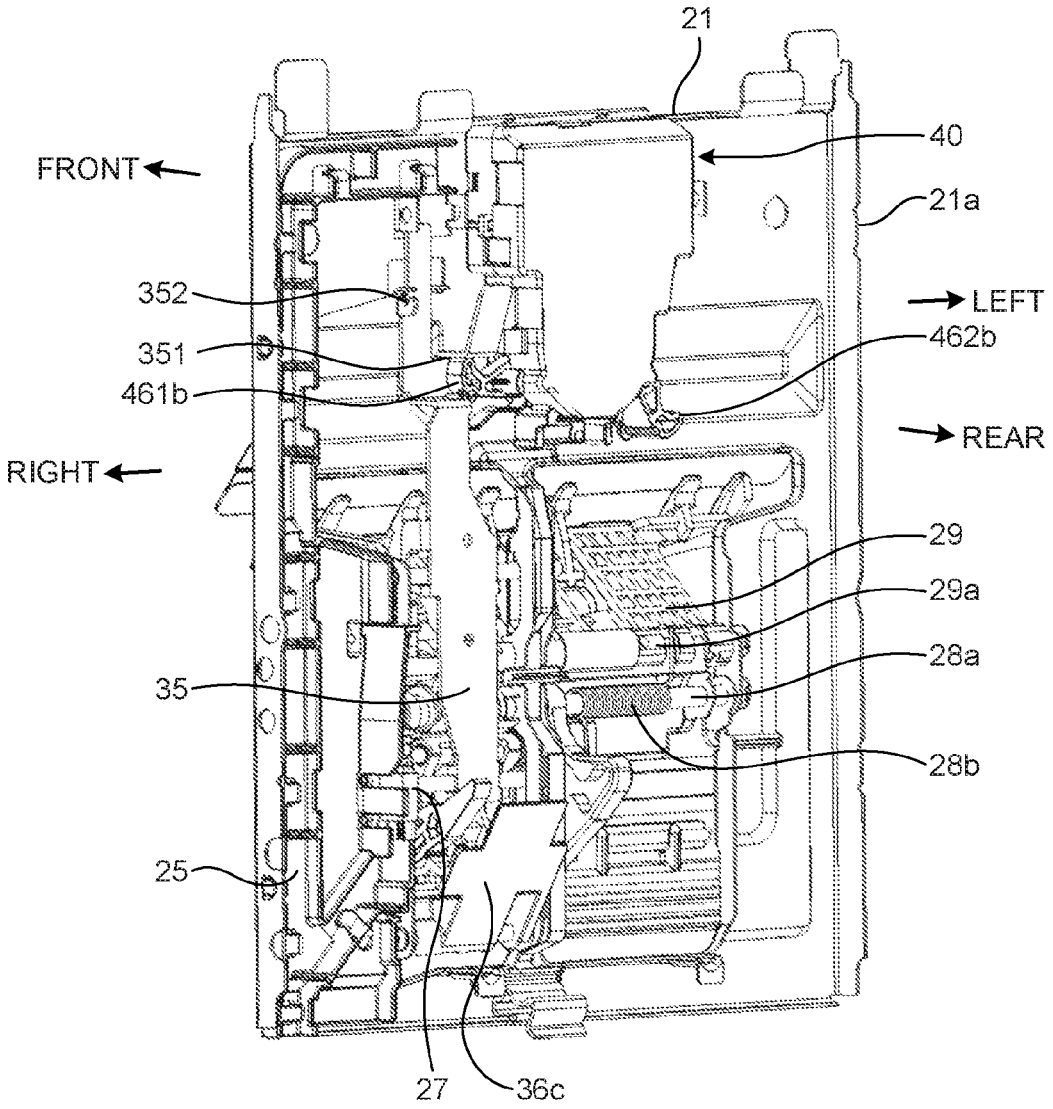
FIG. 25 is a perspective view illustrating the first product discharging device when viewed from the rear-right side.
Figure 26:
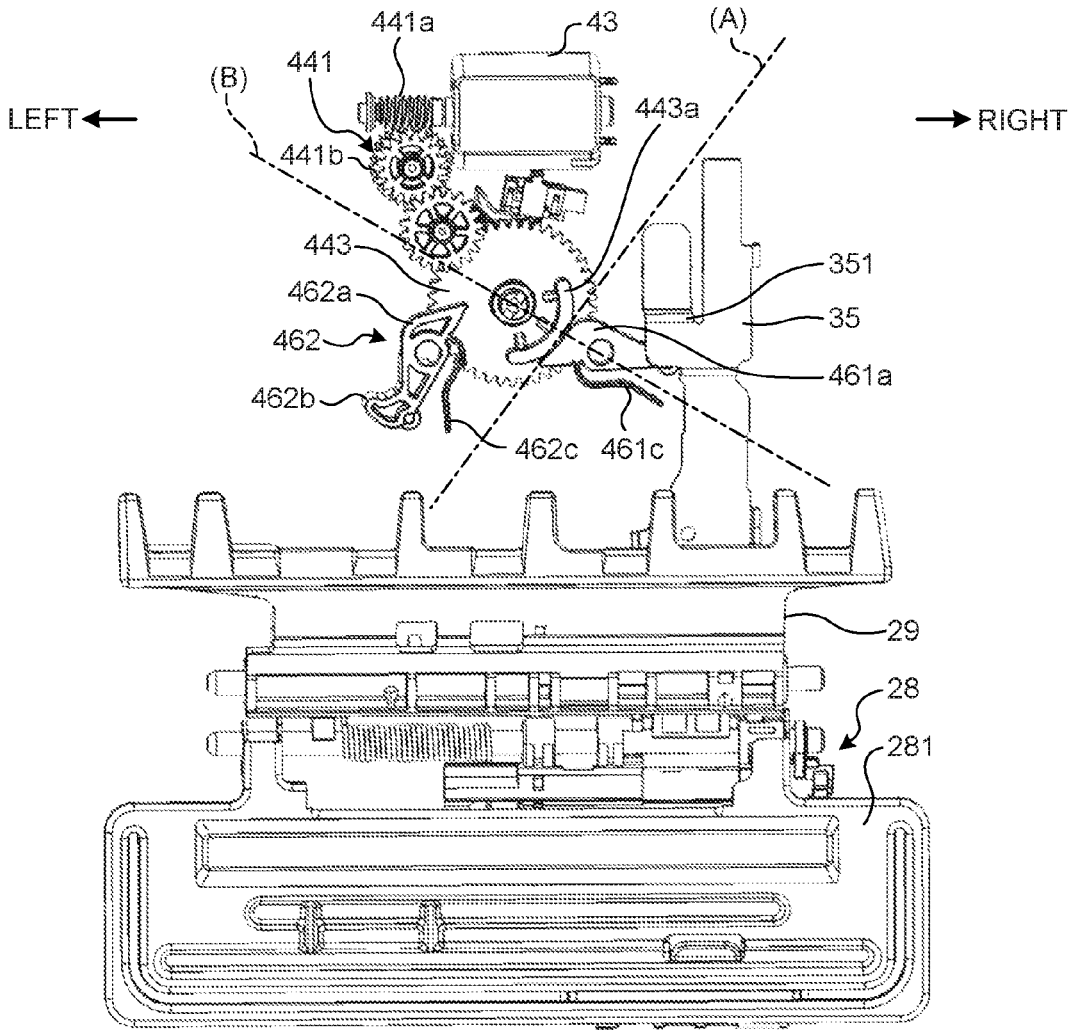
FIG. 26 is a diagram illustrating operations of the principal parts of the drive unit when viewed from the front side.
Figure 27:
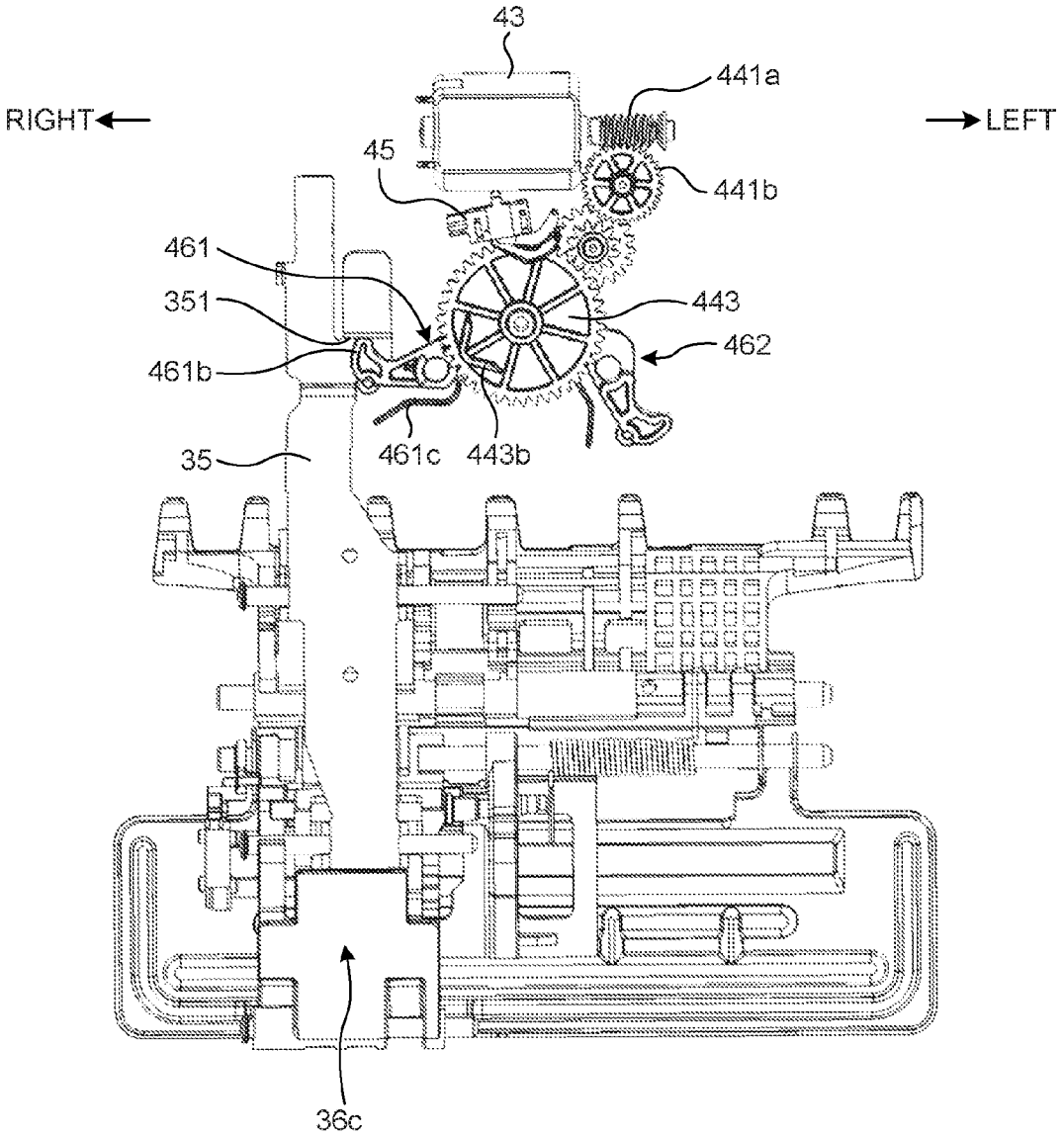
FIG. 27 is a diagram illustrating the operations of the principal parts of the drive unit when viewed from the rear-front side.

When the cam portion 443*a* comes in contact with the base end 461*a* of the first link lever 461 from the upper side with the rotation of the output gear 443, the first link lever 461 rotates counterclockwise in the front view. When the first link lever 461 rotates counterclockwise, the tip portion 461*b* moves upward. When the tip portion 461*b* moves upward in this way, as illustrated in FIGS. 25 to 27, the tip portion comes in contact with the contact piece 351 of the pedal link 35, the pedal link 35 can move upward by a predetermined distance against the biasing force of the link spring 35*a*, and the pedal link 35 can be held in the state in which the pedal link moves upward by the predetermined distance while the cam portion 443*a* comes in sliding contact with the base end 461*a*.

In this case, when the first link lever 461 comes in sliding contact with the cam portion 443*a*, the first link lever is adjusted such that the plane (A) including the portion coming in sliding contact with the cam portion 443*a* is substantially perpendicular to the plane (B) including its central axis (the central axis of the first link shaft 42*e*) and a central axis of the output gear 443.

With the upward movement of the pedal link 35, the stopper pin 34*a* moves upward from the bottom ends of the stopper pin insertion holes 23*b*3 and 24*c*1 and the pedal stopper pin 34*b* moves upward from the bottom ends of the pedal stopper pin support grooves 23*b*4 and 24*c*2.

At this time, since the stopper pin 34*a* moves upward while coming in contact with the edge wall of the concave portion 292 of the upper pedal 29, the upper pedal 29 moves forward from the initial position against the biasing force of the upper pedal spring. The forward movement of the upper pedal 29 is performed along with the upward movement of the stopper pin 34*a*. At the time at which the stopper pin 34*a* reaches the top ends of the stopper pin insertion holes 23*b*3 and 24*c*1, the stopper pin comes in contact with the stopper contact portion 293 to regulate the backward movement of the upper pedal 29.

The upper pedal 29 moving forward comes in contact with a second lowest piece of first product (hereinafter, also referred to as a next product) to regulate downward movement of the next product.

On the other hand, since the weight of the product coming in contact with the lower pedal 28 maintained at the forward-moved position is applied to the rotation stopper 36, the rotation stopper 36 starts its backward movement by releasing the regulation of the backward movement due to the upward movement of the pedal stopper pin 34*b*.

When the rotation stopper 36 starts the backward movement in this way, the pedal operating shaft 361 departs from the fitting portion 283*a* and the lower pedal 28 starts its backward movement against the biasing force of the lower pedal spring 28*b* with the weight of the product. The pedal operating shaft 361 of the rotation stopper 36 departing from the fitting portion 283*a* moves to a position at which the first guide portion 283*b* and the second guide portion 283*c* intersect each other along the first guide portion 283*b*.

Thereafter, the lower pedal 28 moves backward with the weight of the lowest product, the downward movement of the lowest product is allowed, and the lowest product is discharged downward (see FIG. 8). The discharged product is guided to the product discharge port 3*c* via the product chute 5 and can be taken out via the product output port 2*a*.

When the lowest product passes through the lower pedal 28, the lower pedal 28 moves to the forward-moved position with the elastic biasing force of the lower pedal spring 28*b* and the rotation stopper 36 also moves to the forward-moved position with the elastic biasing force of the pedal operation spring. When the lower pedal 28 and the rotation stopper 36 move to the forward-moved position, the pedal operating shaft 361 held at the position at which the first guide portion 283*b* and the second guide portion 283*c* intersect each other moves to the fitting portion 283*a* along the second guide portion 283*c*, and the lower pedal 28 and the rotation stopper 36 are returned to the forward-moved position.

In the meantime, the pedal link 35 moves upward, the stopper pin 34*a* is located at the top ends of the stopper pin insertion holes 23*b*3 and 24*c*1, and the pedal stopper pin 34*b* is located at the top ends of the pedal stopper pin support grooves 23*b*4 and 24*c*2.

Thereafter, when the contact of the cam portion 443*a* with the base end 462*a* is released with the rotation of the output gear 443, the pedal link 35 is biased to move downward by the link spring 35*a*.

With the downward movement of the pedal link 35, the stopper pin 34*a* moves downward from the top ends of the stopper pin insertion holes 23*b*3 and 24*c*1 and the pedal stopper pin 34*b* moves downward from the top ends of the pedal stopper pin support grooves 23*b*4 and 24*c*2.

When the pedal stopper pin 34*b* moves to the bottom ends of the pedal stopper pin support grooves 23*b*4 and 24*c*2, the pedal stopper pin 34*b* comes in contact with the recessed portion 36*b* on the rear side of the rotation stopper 36 returned to the forward-moved position. Accordingly, the movement in the backward moving direction is regulated and the lower pedal 28 is returned to the product-absent standby posture in which the lower pedal moves forward to the first product storage passage 13*a* by the biasing force of the lower pedal spring 28*b*.

On the other hand, the upper pedal 29 is biased by the upper pedal spring and moves backward with the downward movement of the stopper pin 34*a*. Accordingly, the downward movement of the next product is allowed, and then the next product comes in contact with the forward-moved lower pedal 28 to regulate the downward movement thereof, and the lower pedal 28 transitions to the product-present standby posture and is returned to the standby state.

In the drive unit 40, the cam portion 443*a* comes in contact with the base end 462*a* of the second link lever 462 with the clockwise rotation of the output gear 443 in a front view. In this case, since the locking portion 462*c* comes in contact with the right edge portion 472 of the left opening, the rotation of the second link lever 462 about the central axis is regulated. Accordingly, the locking portion 462*c* is elastically deformed to bring the base end 462*a* close to the locking portion 462*c*, thereby not interfering with the movement of the cam portion 443*a* due to the rotation of the output gear 443.

Thereafter, when the cam portion 443*a* is returned to the position of the standby state with the rotation of the output gear 443, the pressing piece 443*b* presses the contactor 45*a* of the carrier switch 45 to switch the carrier switch 45 to the ON state. Immediately after the pressing piece 443*b* presses the contactor 45*a* of the carrier switch 45, the cam portion 443*a* departs from the base end 462*a* of the second link lever 462 and the second link lever 462 is returned to the original state by the locking portion 462*c*.

In the above-mentioned positive driving of the motor 43 in step S102, the dispensing control unit 110 monitors whether the carrier switch 45 is switched to the ON state within a predetermined time (steps S103 and S104). That is, it is monitored whether the output gear 443 rotates by one turn within a predetermined time.

When it is determined that the carrier switch 45 is switched to the ON state within the predetermined time (YES in step S103 and NO in step S104), the dispensing control unit 110 stops the positive driving of the motor 43 (step S105), returns the control flow, and ends the process. As a result, it is possible to reliably discharge the first product for which a discharge command is issued as described above.

When the carrier switch 45 is not switched to the ON state within the predetermined time, that is, when the ON signal is not output from the carrier switch 45 within the predetermined time (NO in step S103 and YES in step S104), the dispensing control unit 110 performs a retry process (1) (step S200).

Figure 28:
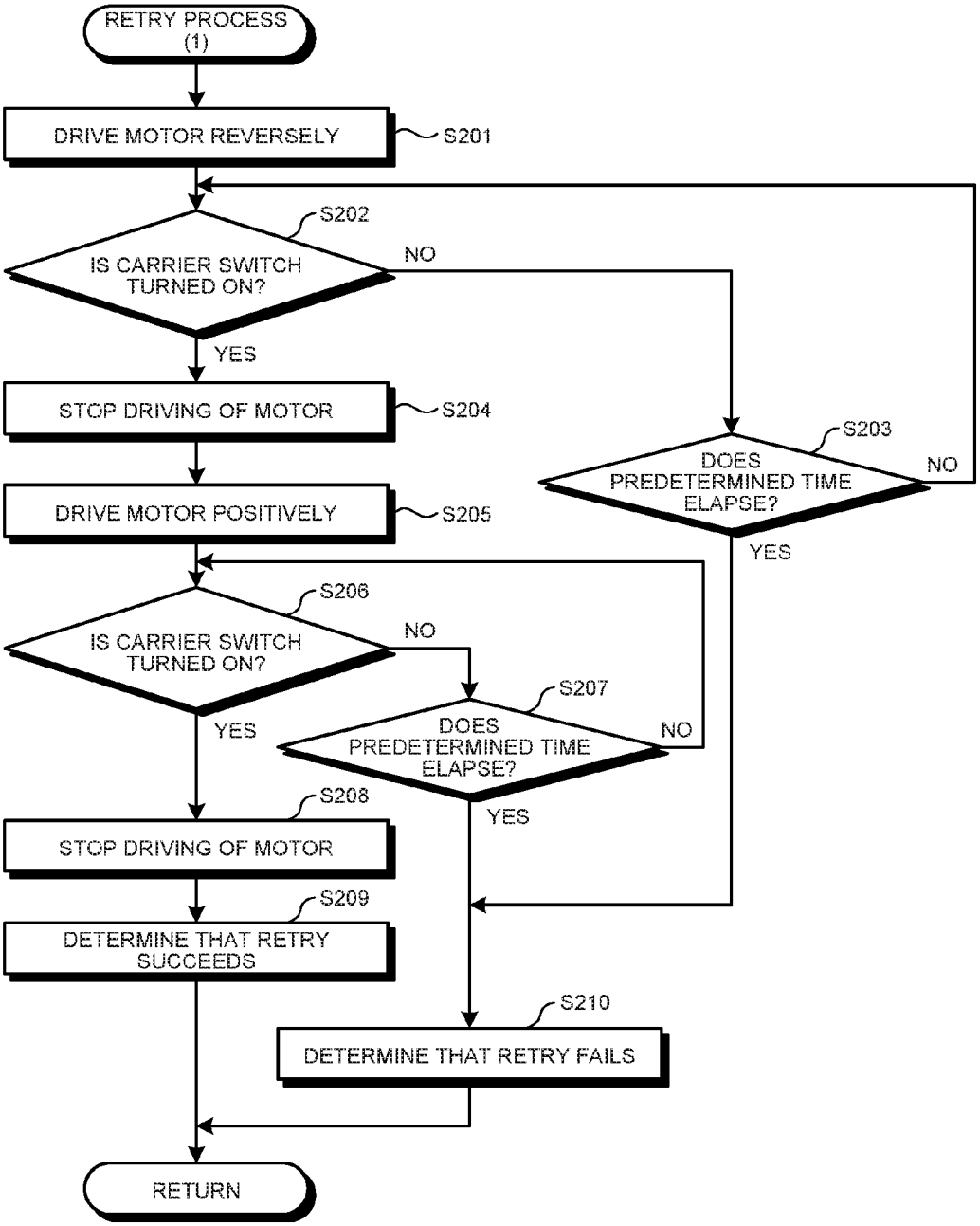
FIG. 28 is a flowchart illustrating process details of a retry process (1) in the dispensing control process illustrated in FIG. 24.

FIG. 28 is a flowchart illustrating processing details of the retry process (1) in the dispensing control process illustrated in FIG. 24.

In the retry process (1), the dispensing control unit 110 drives the motor 43 reversely and monitors whether the carrier switch 45 is switched to the ON state within a predetermined time (steps S201, S202, and S203). When the motor 43 is driven reversely, the output gear 443 to which the driving force of the motor 43 is transmitted via the worm gear 441 and the intermediate gear 442 rotates counterclockwise in a front view. When the motor 43 is driven reversely, at least the cam portion 443*a* of the output gear 443 does not come in contact with the base end 462*a* of the second link lever 462, that is, the cam portion 443*a* does not pass through the base end 462*a*. Accordingly, even when the motor 43 is driven reversely, the second link lever 462 is not adversely affected (the second product is not discharged from the second product discharging device 20*b*).

When it is determined that the carrier switch 45 is switched to the ON state within the predetermined time (YES in step S202 and NO in step S203), the dispensing control unit 110 stops the reverse driving of the motor 43 (step S204) and drives the motor 43 positively again (step S205). Then, it is monitored whether the carrier switch 45 is switched to the ON state within the predetermined time (steps S206 and S207).

Thereafter, when the carrier switch 45 is switched to the ON state within the predetermined time (YES in step S206 and NO in step S207), that is, when the output gear 443 rotates by one turn clockwise in a front view within the predetermined time, it is considered that the first product is discharged as described above, the driving of the motor 43 is stopped, it is determined that the retry is successful (steps S208 and S209), the control flow is returned, and the retry process (1) is ended.

On the other hand, when the carrier switch 45 is not switched to the ON state within the predetermined time (NO in step S206 and YES in step S207), the dispensing control unit 110 considers that a problem occurs, determines that the retry fails (step S210), returns the control flow, and ends the retry process (1). When it is determined in step S201 that the carrier switch 45 is not switched to the ON state within the predetermined time (NO in step S202 and YES in step S203), the dispensing control unit 110 determines that the retry fails (step S210), returns the control flow, and ends the retry process (1).

When the retry succeeds (YES in step S106), the dispensing control unit 110 having performed the retry process (1) holds the standby state (step S107), then returns the control flow, and ends the dispensing control process. As a result, by issuing a new command to discharge the first product, discharging of the first product is enabled.

On the other hand, when the retry fails (NO in step S106), the dispensing control unit considers and determines that the first product in the first product storage passage 13*a* is sold out (step S108), then returns the control flow, and ends the process. Accordingly, it is determined that the first product is sold out, and thus a sold-out lamp or the like can be lighted to stop vending of the first product.

On the other hand, when a command to discharge the second product is issued from the vending machine controller 100 (NO in step S101 and YES in step S109), the dispensing control unit 110 drives the motor 43 reversely (step S110).

When the motor 43 is driven reversely in this way, the output gear 443 to which the driving force of the motor 43 is transmitted via the worm gear 441 and the intermediate gear 442 rotates counterclockwise in a front view.

When the output gear 443 rotates counterclockwise in a front view, the pressing piece 443*b* of the output gear 443 departs from the contactor 45*a* of the carrier switch 45. Accordingly, the contactor 45*a* of the carrier switch 45 is released from the pressed state and is switched to the OFF state.

When the cam portion 443*a* comes in contact with the base end 462*a* of the second link lever 462 from the upper side with the rotation of the output gear 443, the second link lever 462 rotates clockwise in the front view. When the second link lever 462 rotates clockwise, the tip portion 462*b* moves upward. When the tip portion 462*b* moves upward in this way, the tip portion comes in contact with the contact piece 351' of the pedal link 35', the pedal link 35' can move upward by a predetermined distance against the biasing force of the link spring 35*a'*, and the pedal link 35' can be held in the state in which the pedal link moves upward by the predetermined distance while the cam portion 443*a* comes in sliding contact with the base end 462*a*.

In this case, when the second link lever 462 comes in sliding contact with the cam portion 443*a*, not clearly illustrated in the drawing, the second link lever is adjusted such that the plane including the portion coming in sliding contact with the cam portion 443*a* is substantially perpendicular to the plane including its central axis (the central axis of the second link shaft 42*f*) and the central axis of the output gear 443.

With the upward movement of the pedal link 35', the stopper pin moves upward and the pedal stopper pin 34*b'* also moves upward.

At this time, since the stopper pin moves upward while coming in contact with the edge wall of the concave portion 292' of the upper pedal 29', the upper pedal 29' moves forward from the initial position against the biasing force of the upper pedal spring. The forward movement of the upper pedal 29' is performed along with the upward movement of the stopper pin. At the time at which the stopper pin reaches the top end of the stopper pin insertion hole, the stopper pin comes in contact with the stopper contact portion 293' to regulate the backward movement of the upper pedal 29'.

The upper pedal 29' moving forward comes in contact with a second lowest piece of second product (hereinafter, also referred to as a next product) to regulate downward movement of the next product.

On the other hand, since the weight of the product coming in contact with the lower pedal 28' maintained at the forward-moved position is applied to the rotation stopper 36', the rotation stopper 36' starts its backward movement by releasing the regulation of the backward movement due to the upward movement of the pedal stopper pin 34*b'*.

When the rotation stopper 36' starts the backward movement in this way, the pedal operating shaft 361' departs from the fitting portion and the lower pedal 28' starts its backward movement against the biasing force of the lower pedal spring 28*b'* with the weight of the product. The pedal operating shaft 361' of the rotation stopper 36' departing from the fitting portion moves to a position at which the first guide portion and the second guide portion intersect each other along the first guide portion.

Thereafter, the lower pedal 28' moves backward with the weight of the lowest product, the downward movement of the lowest product is allowed, and the lowest product is discharged downward. The discharged product is guided to the product discharge port 3*c* via the product chute 5 and can be taken out via the product output port 2*a*.

When the lowest product passes through the lower pedal 28', the lower pedal 28' moves to the forward-moved position with the elastic biasing force of the lower pedal spring 28*b'* and the rotation stopper 36' also moves to the forward-moved position with the elastic biasing force of the pedal operation spring. When the lower pedal 28' and the rotation stopper 36' move to the forward-moved position, the pedal operating shaft 361' held at the position at which the first guide portion and the second guide portion intersect each other moves to the fitting portion along the second guide portion, and the lower pedal 28' and the rotation stopper 36' are returned to the forward-moved position.

Thereafter, when the contact of the cam portion 443*a* with the base end 462*a* is released with the rotation of the output gear 443, the pedal link 35' is biased to move downward by the link spring 35*a'*.

With the downward movement of the pedal link 35', the stopper pin moves downward and the pedal stopper pin 34*b*' also moves downward.

When the pedal stopper pin 34*b*' moves downward to the bottom end of the pedal stopper pin support groove, the pedal stopper pin 34*b*' comes in contact with the recessed portion 36*b*' on the rear side of the rotation stopper 36' returned to the forward-moved position. Accordingly, the movement in the backward moving direction is regulated and the lower pedal 28' is returned to the product-absent standby posture in which the lower pedal moves forward to the second product storage passage 13*b* by the biasing force of the lower pedal spring 28*b*'.

On the other hand, the upper pedal 29' is biased by the upper pedal spring and moves backward with the downward movement of the stopper pin. Accordingly, the downward movement of the next product is allowed, then the next product comes in contact with the forward-moved lower pedal 28' to regulate the downward movement thereof, and the lower pedal 28' transitions to the product-present standby posture and is returned to the standby state.

In the drive unit 40, the cam portion 443*a* comes in contact with the base end 461*a* of the first link lever 461 with the counterclockwise rotation of the output gear 443 in a front view. In this case, since the locking portion 461*c* comes in contact with the left edge portion 471 of the right opening, the rotation of the first link lever 461 about the central axis is regulated. Accordingly, the locking portion 461*c* is elastically deformed to bring the base end 461*a* close to the locking portion 461*c*, thereby not interfering with the movement of the cam portion 443*a* due to the rotation of the output gear 443.

Then, when the cam portion 443*a* is returned to the position of the standby state with the rotation of the output gear 443, the pressing piece 443*b* presses the contactor 45*a* of the carrier switch 45 to switch the carrier switch 45 to the ON state.

In the above-mentioned reverse driving of the motor 43 in step S110, the dispensing control unit 110 monitors whether the carrier switch 45 is switched to the ON state within a predetermined time (steps S111 and S112). That is, it is monitored whether the output gear 443 rotates by one turn within a predetermined time.

When it is determined that the carrier switch 45 is switched to the ON state within the predetermined time (YES in step S111 and NO in step S112), the dispensing control unit 110 stops the reverse driving of the motor 43 (step S113), returns the control flow, and ends the process. As a result, it is possible to reliably discharge the second product for which a discharge command is issued as described above.

When the carrier switch 45 is not switched to the ON state within the predetermined time, that is, when the ON signal is not output from the carrier switch 45 within the predetermined time (NO in step S111 and YES in step S112), the dispensing control unit 110 performs a retry process (2) (step S300).

Figure 29:
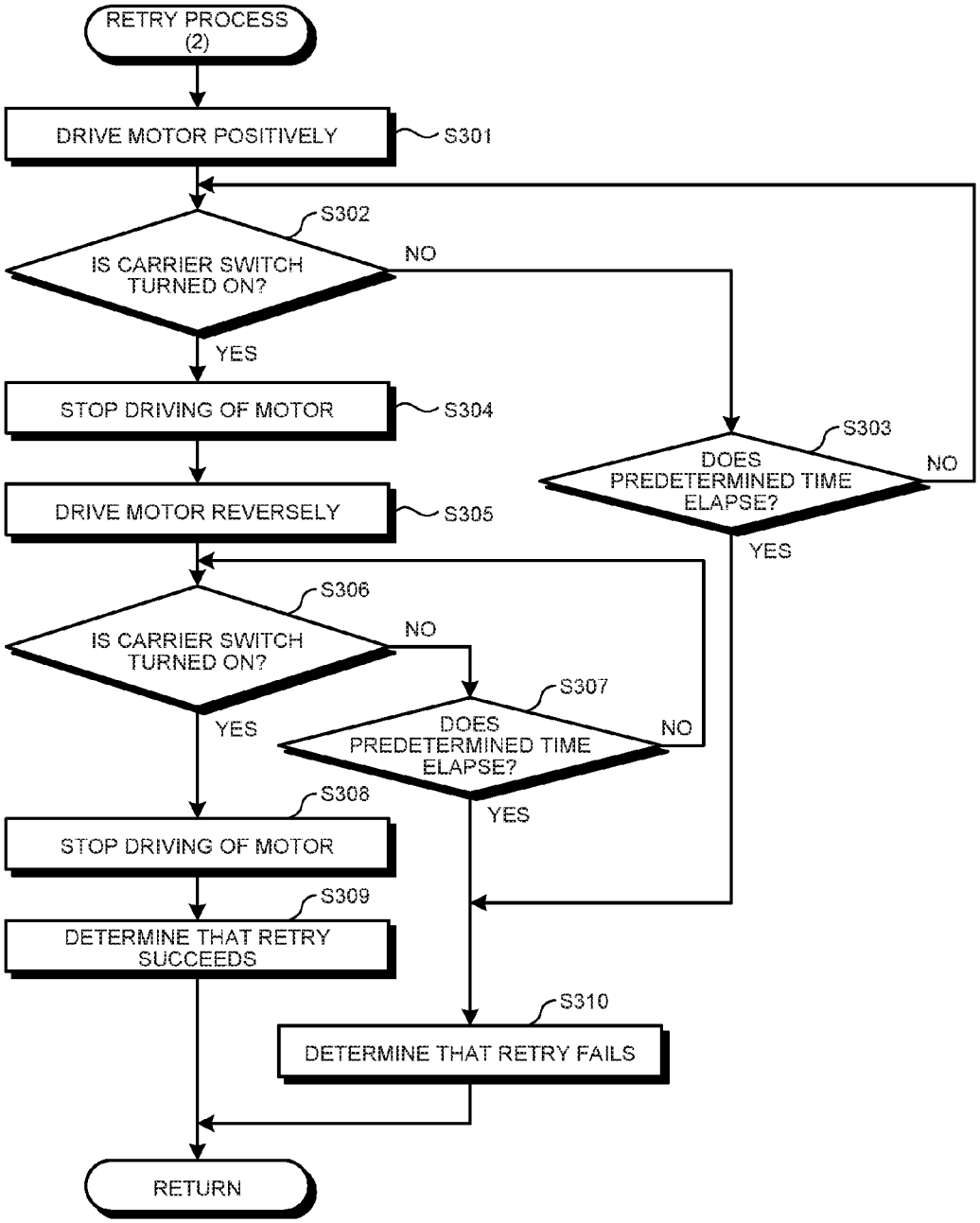
FIG. 29 is a flowchart illustrating process details of a retry process (2) in the dispensing control process illustrated in FIG. 24.

FIG. 29 is a flowchart illustrating processing details of the retry process (2) in the dispensing control process illustrated in FIG. 24.

In the retry process (2), the dispensing control unit 110 drives the motor 43 positively and monitors whether the carrier switch 45 is switched to the ON state within a predetermined time (steps S301, S302, and S303). When the motor 43 is driven positively, the output gear 443 to which the driving force of the motor 43 is transmitted via the worm gear 441 and the intermediate gear 442 rotates clockwise in a front view.

When it is determined that the carrier switch 45 is switched to the ON state within the predetermined time (YES in step S302 and NO in step S303), the dispensing control unit 110 stops the positive driving of the motor 43 (step S304) and drives the motor 43 reversely again (step S305). Then, it is monitored whether the carrier switch 45 is switched to the ON state within the predetermined time (steps S306 and S307).

Thereafter, when the carrier switch 45 is switched to the ON state within the predetermined time (YES in step S306 and NO in step S307), that is, when the output gear 443 rotates by one turn counterclockwise in a front view within the predetermined time, it is considered that the second product is discharged as described above, the driving of the motor 43 is stopped, it is determined that the retry is successful (steps S308 and S309), the control flow is returned, and the retry process (2) is ended.

On the other hand, when the carrier switch 45 is not switched to the ON state within the predetermined time (NO in step S306 and YES in step S307), the dispensing control unit 110 considers that a problem occurs, determines that the retry fails (step S310), returns the control flow, and ends the retry process (2). When it is determined in step S301 that the carrier switch 45 is not switched to the ON state within the predetermined time (NO in step S302 and YES in step S303), the dispensing control unit 110 determines that the retry fails (step S310), returns the control flow, and ends the retry process (2).

When the retry succeeds (YES in step S114), the dispensing control unit 110 having performed the retry process (2) holds the standby state (step S115), then returns the control flow, and ends the dispensing control process. As a result, by issuing a new command to discharge the second product, discharging of the second product is enabled.

On the other hand, when the retry fails (NO in step S114), the dispensing control unit considers and determines that the second product in the second product storage passage 13*b* is sold out (step S116), then returns the control flow, and ends the process. Accordingly, it is determined that the second product is sold out, and thus a sold-out lamp or the like can be lighted to stop vending of the second product.

For example, when the product in the first product storage passage 13*a* is sold out, the lower pedal 28 of the first product discharging device 20*a* is biased by the lower pedal spring 28*b* and is switched to the product-absent standby posture. In this case, as illustrated in FIG. 12, the base end of the lower pedal 28 comes in contact with the first sold-out contact portion 32 of the first sold-out link 30 and thus the first sold-out link 30 rotates about the first swing support shaft 28*a* to cause the first sold-out pressing portion 33 to press the contactor 26*a* of the first sold-out detection switch 26. Accordingly, in the first sold-out detection switch 26, the contactor 26*a* is pressed and displaced forward against the biasing force of the spring into the ON state, and outputs the ON signal to the dispensing control unit 110. Accordingly, the dispensing control unit 110 can consider that the first product is sold out and thus can light a sold-out lamp or the like.

For example, when the product in the second product storage passage 13*b* is sold out, the base end of the lower pedal 28' comes in contact with the second sold-out contact portion 52 of the second sold-out link 50 and thus the second sold-out link 50 rotates about the first swing support shaft 28*a*' to cause the second sold-out pressing portion 53 to press the contactor 27*a* of the second sold-out detection switch 27. Accordingly, in the second sold-out detection switch 27, the contactor 27*a* is pressed and displaced backward against the biasing force of the spring into the ON state, and outputs the ON signal to the dispensing control unit 110. Accordingly, the dispensing control unit 110 can consider that the second product is sold out and thus can light a sold-out lamp or the like.

The dispensing control unit 110 may be configured to determine that the product is sold out when the ON signal of the first sold-out detection switch 26 or the second sold-out detection switch 27 is maintained for a certain time or more. Accordingly, it is possible to prevent an erroneous operation when the lower pedal 28 (28') is returned to the product-absent standby posture every vending or an erroneous operation due to chattering which occurs by bound or the like when the lower pedal 28 is returned.

The product discharging device and the product dispensing system 20 which have been described above exhibit the following operational advantages.

In the first product discharging device 20*a*, the first sold-out detection switch 26 switches its state to detect presence or absence of the first product in the first product storage passage 13*a* when the lower pedal 28 transitions to the product-absent standby posture and the product-present standby posture, and the second sold-out detection switch 27 switches its state to detect presence or absence of the second product in the second product storage passage 13*b* when the lower pedal 28' transitions to the product-absent standby posture and the product-present standby posture. Accordingly, it is possible to reliably recognize that no product is present in the product storage passages 13 and to match the number of sales opportunities of product with the number of products in the product storage passages 13. Accordingly, according to the first product discharging device 20*a*, it is possible to increase the number of product sales opportunities.

In the first product discharging device 20*a* and the second product discharging device 20*b*, since the rotation stoppers 36 and 36' include the blindfold portions 36*c* and 36*c'* covering the sides of the pedal stopper pins 34*b* and 34*b'* opposite to the product storage passages 13, a blindfold plate as in the related art is not necessary and it is possible to retain the antitheft capability while decreasing the number of components. As a result, according to the first product discharging device 20*a* and the second product discharging device 20*b*, it is possible to achieve a decrease in manufacturing cost and to improve the antitheft capability.

In the first product discharging device 20*a*, the output gear 443 constituting the drive unit 40 is linked to the motor 43 via the worm gear 441 and rotates by the driving force of the motor 43 transmitted via the worm gear 441. The first link lever 461 and the second link lever 462 constituting the drive unit 40 causes the upper pedals 29 and 29' to move forward to the product storage passage 13 and to come in contact with the second lowest product and causes the lower pedals 28 and 28' to move backward from the product storage passage 13 to discharge the lowest product downward by staying in the upward-rotated state and maintaining the pedal links 35 and 35' in the upward-moved state when the link levers come in sliding contact with the cam portion 443*a* disposed in the output gear 443, and causes the upper pedals 29 and 29' to move backward from the product storage passage 13 and causes the lower pedals 28 and 28' to move forward to the product storage passage 13 to regulate downward movement of the products by allowing the pedal links 35 and 35' to move downward when the sliding contact with the cam portion 443*a* is released. In the first product discharging device 20*a*, the worm gear 441 is interposed between the output gear 443 and the motor 43 even when the supply of power is intercepted due to power outage or the like during driving of the motor 43, and thus the output gear 443 does not rotate reversely but can maintain its state even when the motor 43 is stopped, whereby the pedal links 35 and 35' can be maintained in the upward-moved state. Accordingly, since the upper pedals 29 and 29' can be maintained in the forward-moved state, the phenomenon in the related art using the AC solenoid in which the AC solenoid is switched to a non-powered state and the pedal link moves downward due to interception of the supply of power due to power outage or the like does not occur. As a result, according to the first product discharging device 20*a*, it is possible to prevent plural products from being discharged when supply of power is intercepted due to power outage or the like at the time of discharging of a product. The first link lever 461 and the second link lever 462 are configured to be substantially perpendicular to the surface (A) including a part coming in sliding contact with the cam portion 443*a* and the plane (B) including the own axes and the axis of the output gear 443 when the link levers come in sliding contact with the cam portion 443*a*. Accordingly, the output gear 443 can reliably hold the pedal links 35 and 35' in the upward-moved state without receiving a load in the rotating direction.

According to the above-mentioned product dispensing system 20, since the first product discharging device 20*a* includes the motor 43 serving as a drive source for the first product discharging device 20*a* and the second product discharging device 20*b* and the drive unit 40 that alternatively selects the first product discharging device 20*a* and the second product discharging device 20*b* in accordance with a discharge command and applies the driving force from the motor 43 to the selected discharging device when the discharge command is issued, it is possible to decrease the number of drive sources in comparison with the number of discharge mechanisms and to decrease the manufacturing cost. Since the first product discharging device 20*a* includes the drive unit 40 including the motor 43, it is also possible to use only the first product discharging device 20*a*. That is, the present disclosure can be applied to a product storage rack 10 in which an odd number of product storage passages 13 are arranged in the front-rear direction as well as the product storage rack 10 in which an even number of product storage passages 13 are arranged in the front-rear direction. Accordingly, it is possible to achieve a decrease in manufacturing cost and to flexibly work depending on the number of product storage passages 13 adjacent in the front-rear direction.

According to the product dispensing system 20, since the motor 43 as a drive source is a DC motor, the motor is not easily affected by a local voltage or a frequency fluctuation and can be disposed at various locations.

According to the product dispensing system 20, since the first product discharging device 20*a* is provided with the first sold-out detection switch 26 and the second sold-out detection switch 27, it may be possible to use only the first product discharging device 20*a*. Accordingly, it is possible to flexibly work depending on the number of product storage passages 13 adjacent in the front-rear direction. In addition, since electrical components are disposed in only the first product discharging device 20*a*, harnesses can be integrated in the first product discharging device 20*a*.

According to the product dispensing system 20, since the postures of the first link lever 461 and the second link lever 462 in the normal state are determined by bringing the elastically deformable locking portions 461*c* and 462*c* formed therein into contact with predetermined parts (471 and 472), it is possible to easily attach the unit cover 42 to the unit base 41.

According to the product dispensing system 20, when the product discharging device 20*a* or 20*b* which is alternatively selected and is supplied with the driving force by the drive unit 40 is not driven within a predetermined time, the dispensing control unit 110 considers that only the product discharging device 20*a* or 20*b* is out of order and performs sold-out processing of determining that the product in the product storage passage 13 of the product discharging device 20*a* or 20*b*. Accordingly, even when any one of the first product discharging device 20*a* and the second product discharging device 20*b* is subjected to vending stop by the sold-out processing, the other can continue to discharge the product and it is thus possible to perform moderate operation corresponding to each product storage passage 13.

According to the product dispensing system 20, since the first sold-out detection switch 26 and the second sold-out detection switch 27 are disposed in the harness guide 25, it is possible to preferably protect the harness and the sold-out detection switches 26 and 27 when the first product discharging device 20*a* and the second product discharging device 20*b* are attached and detached.

While the exemplary embodiment of the present disclosure has been described above, the present disclosure is not limited to the exemplary embodiment and can be modified in various forms.

Figure 30:
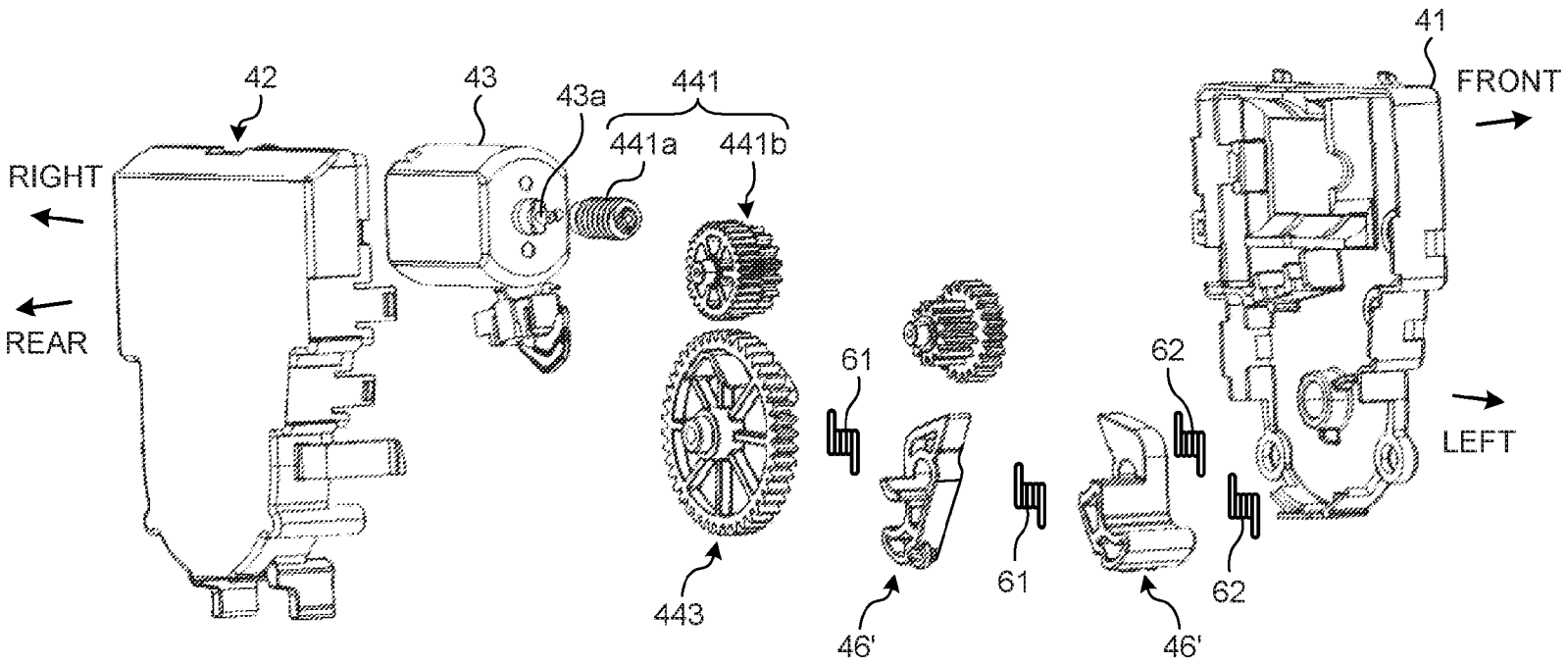
FIG. 30 is an exploded perspective view illustrating a modified example of the drive unit.

In the above-mentioned embodiment, the postures of the first link lever 461 and the second link lever 462 in the normal state are determined by bringing the elastically deformable locking portions 462*c* formed therein into contact with a predetermined part, but in the present disclosure, a spring 61 biasing the link lever 46' clockwise in a front view and a spring 62 biasing the link lever 46' counterclockwise in a front view may be interposed therebetween as illustrated in FIG. 30, whereby these springs 61 and 62 serve as torsion springs to determine the posture of the link lever 46' in the normal state by the biasing forces thereof.

Figure 31:
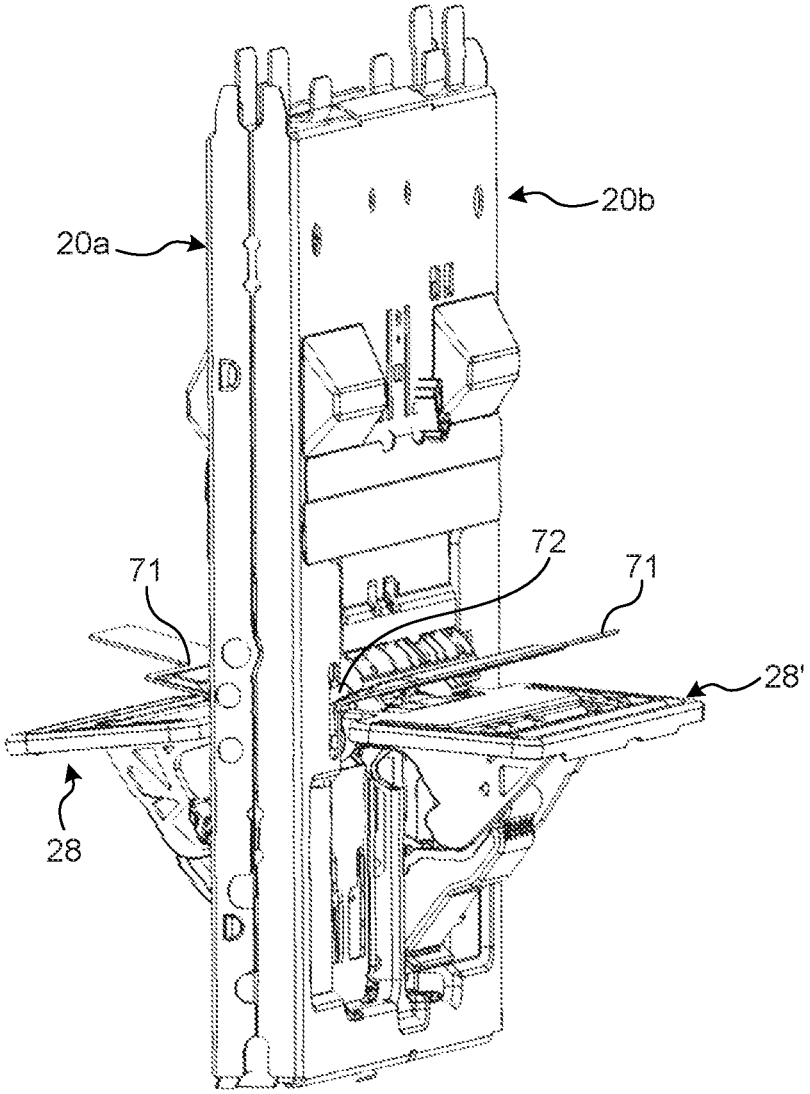
FIG. 31 is a perspective view illustrating a modified example of the product dispensing system.

In the above-mentioned embodiment, the first sold-out link 30 or the second sold-out link 50 is disposed in the first swing support shafts 28*a* and 28*a'* of the lower pedals 28 and 28' and the first sold-out detection switch 26 and the second sold-out detection switch 27 are switched to the ON state by switching the lower pedals 28 and 28' to the product-absent standby posture, but in the present disclosure, a lower lever member 71 that is swingable to move forward to and backward from the product storage passage 13 may be disposed in an area above the lower pedals 28 and 28' as illustrated in FIG. 31. Similarly to the lower pedals 28 and 28', the lower lever member 71 is biased to move forward to the product storage passage 13 by a lever spring not illustrated, and is changed to a posture in which the tip thereof extends upward to be separated from the top surfaces of the lower pedals 28 and 28' when no product is placed on the top surface, and a part of the lower lever member 71 presses a contactor 72 of a sold-out detection switch 27 not illustrated to turn on the sold-out detection switch 27. On the other hand, when the top surface is pressed by product input to the product storage passage 13, the lower lever member 71 is changed to a posture in which the tip thereof comes in contact with the top surfaces of the lower pedals 28 and 28', the part pressing the contactor 72 of the sold-out detection switch is separated from the contactor 72 to turn off the sold-out detection switch 27. According to this configuration, it is possible to satisfactorily recognize that no product is present in the product storage passage 13 and to match the number of sales opportunities of product with the number of products in the product storage passages 13. As a result, it is possible to increase the number of product sales opportunities.

In the above-mentioned embodiment, the antitheft capability is retained by providing the rotation stoppers 36 and 36' with the blindfold portions 36*c* and 36*c'*, but in the present disclosure, the antitheft capability may be retained by providing an antitheft link mechanism that regulates upward movement of the pedal link in the normal state and departs from the area above the pedal link to allow movement of the pedal link when the pedal link is made to move upward by the driving of the drive unit.

In the above-mentioned embodiment, the first product discharging device 20*a* corresponds to the first product storage passage 13*a* and the second product discharging device 20*b* corresponds to the second product storage passage 13*b*, but the present disclosure is not limited to this configuration. One product discharging device may correspond to the other product storage passage and the other product discharging device may correspond to one product storage passage.

In the above-mentioned product dispensing system according to the embodiment may employ the same configurations as follows.

Figure 32:
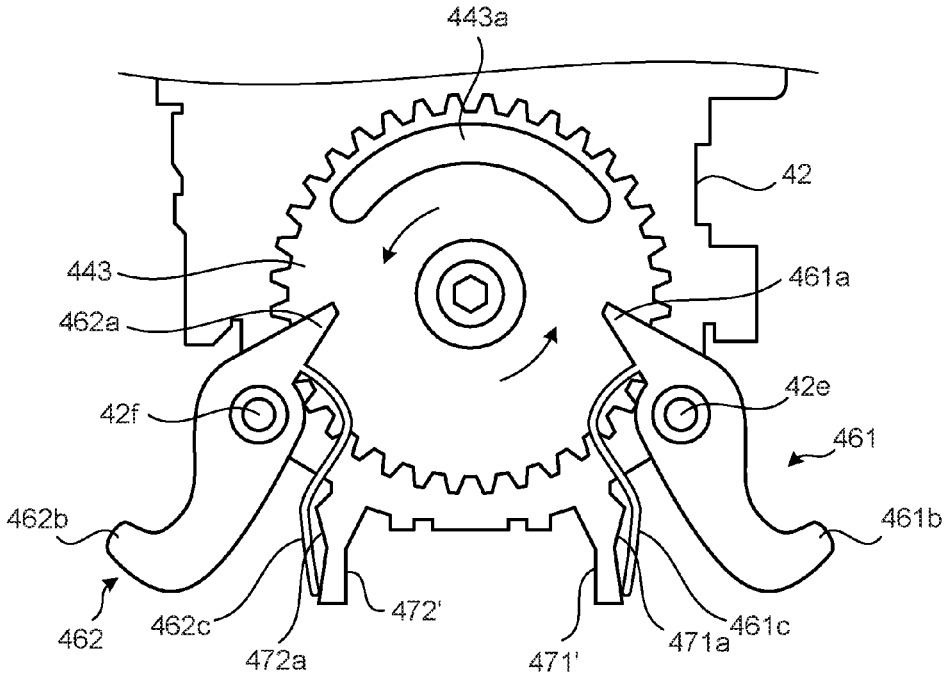
FIG. 32 is a diagram illustrating principal parts in another modified example of the drive unit when viewed from the front side.

As illustrated in FIG. 32, the locking portion 461*c* of the first link lever 461 is disposed in the base end 461*a* of the first link lever 461 and is disposed in a part separated from a first link shaft 42*e* serving as an axis of the first link lever 461. Here, the connection part of the locking portion 461*c* to the base end 461*a* is offset obliquely upward to the left side from the first link shaft 42*e*. A concave portion 471*a* is formed in the left edge portion 471' with which the locking portion 461*c* comes in contact. The concave portion 471*a* is gradually inclined to the left side from the bottom of the left edge portion 471' as it goes upward and is then gradually inclined to the right side as it goes upward.

The locking portion 462*c* of the second link lever 462 is disposed in the base end 462*a* of the second link lever 462 and is disposed in a part separated from a second link shaft 42*f* serving as an axis of the second link lever 462. Here, the connection part of the locking portion 462*c* to the base end 462*a* is offset obliquely upward to the right side from the second link shaft 42*f*. A concave portion 472*a* is formed in the right edge portion 472' with which the locking portion 462*c* comes in contact. The concave portion 472*a* is gradually inclined to the right side from the bottom of the right edge portion 472' as it goes upward and is then gradually inclined to the left side as it goes upward.

According to this configuration, as illustrated in FIG. 32, the output gear 443 rotates counterclockwise in a front view to first cause the second link lever 462 to rotate clockwise in a front view. Accordingly, by causing the pedal link 35' to move upward, discharging of product is performed by the second product discharging device 20*b*.

Figure 33:
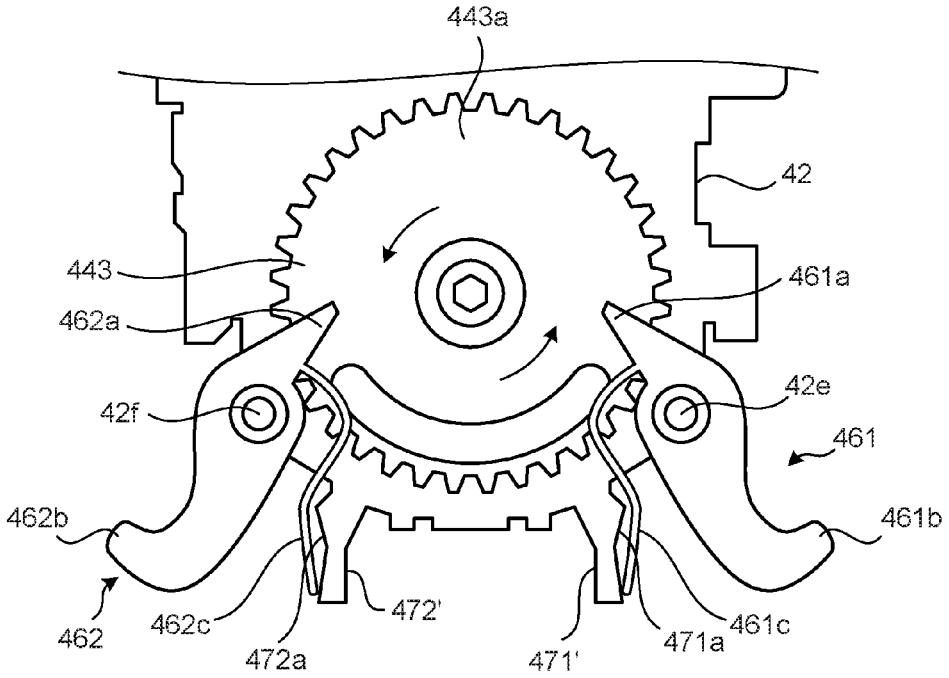
FIG. 33 is a diagram illustrating operation states of the principal parts illustrated in FIG. 32.
Figure 34:
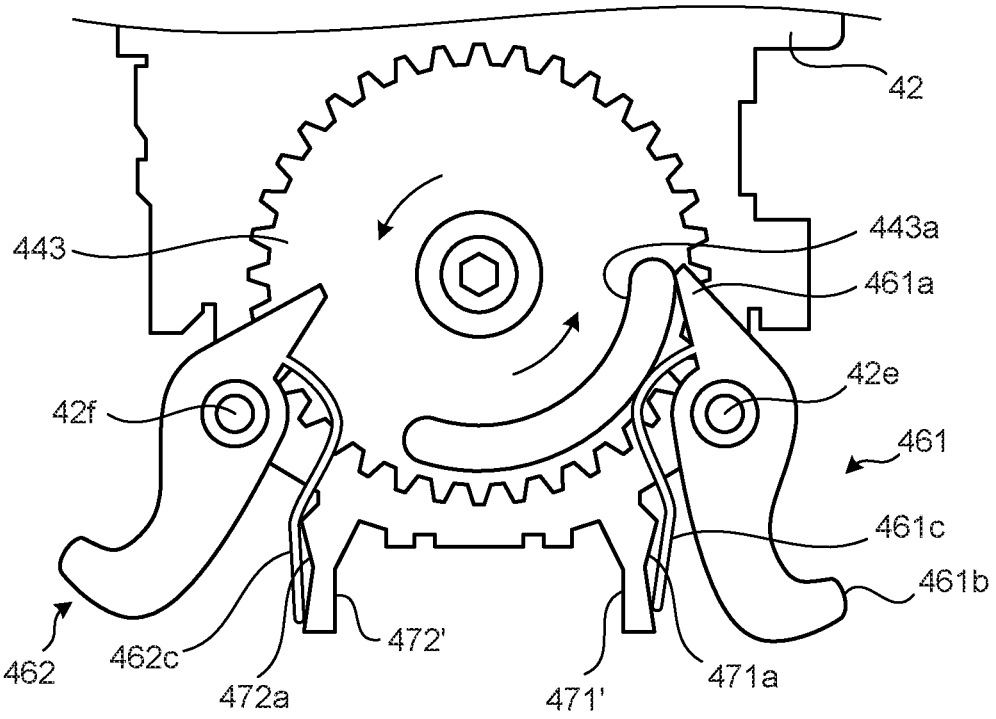
FIG. 34 is a diagram illustrating the operation states of the principal parts illustrated in FIG. 32.

After the second link lever 462 rotates in this way, the cam portion 443*a* comes in contact with the base end 461*a* of the first link lever 461 as illustrated in FIG. 33 with the rotation of the output gear. In this case, since the locking portion 461*c* comes in contact with the left edge portion 471' of the right opening, the rotation of the first link lever 461 about the axis is regulated. Accordingly, as illustrated in FIG. 34, the first link lever 461 is elastically deformed to allow the base end 461*a* to approach the locking portion 461*c* and does not interfere with the movement of the cam portion 443*a* based on the rotation of the output gear 443.

When the first link lever 461 is elastically deformed in this way, the locking portion 461*c* is connected to the base end 461*a* at a position offset obliquely upward to the left side from the first link shaft 42*e* and thus comes in upward sliding contact with the left edge portion 471'. Since the concave portion 471*a* is formed in the left edge portion 471', it is possible to suppress a degree of deformation of the locking portion 461*c* when the first link lever 461 is elastically deformed.

According to this configuration, since it is possible to suppress a degree of deformation of the locking portion 461*c* when the first link lever 461 is elastically deformed, it is possible to reduce a stress generated in the first link lever 461 and to achieve extension of a life span. The first link lever 461 has been described above, but since a concave portion 472*a* is formed in the right edge portion 472' in the second link lever 462, it is also possible to achieve extension of a life span.

Figure 35:
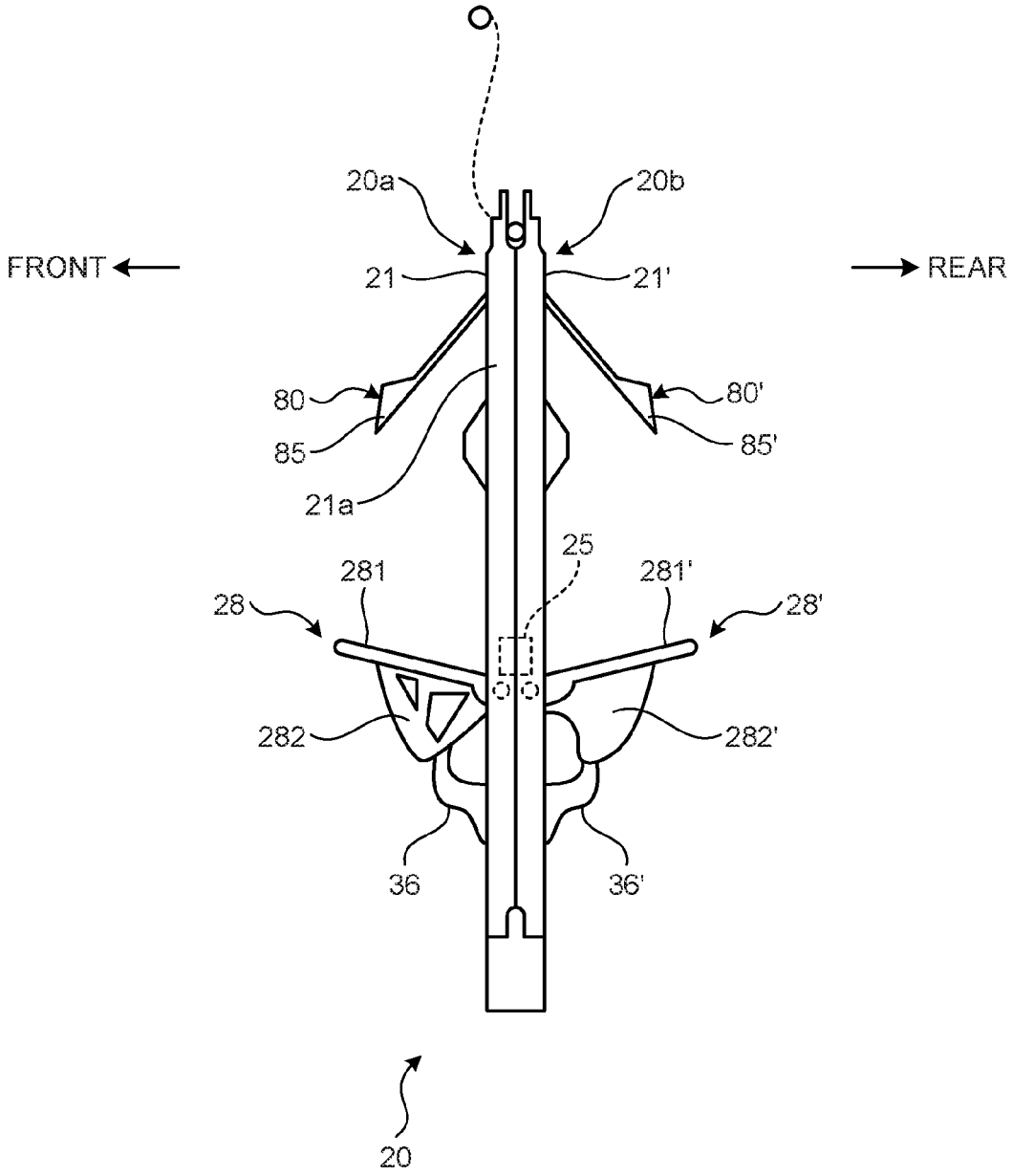
FIG. 35 is a side view schematically illustrating another modified example of the product dispensing system when viewed from the right side.

FIG. 35 is a side view schematically illustrating another modified example of the product dispensing system when viewed from the right side. As illustrated in FIG. 35, the first product discharging device 20*a* may include a lever member 80 and the second product discharging device 20*b* may include a lever member 80'.

Figure 36:
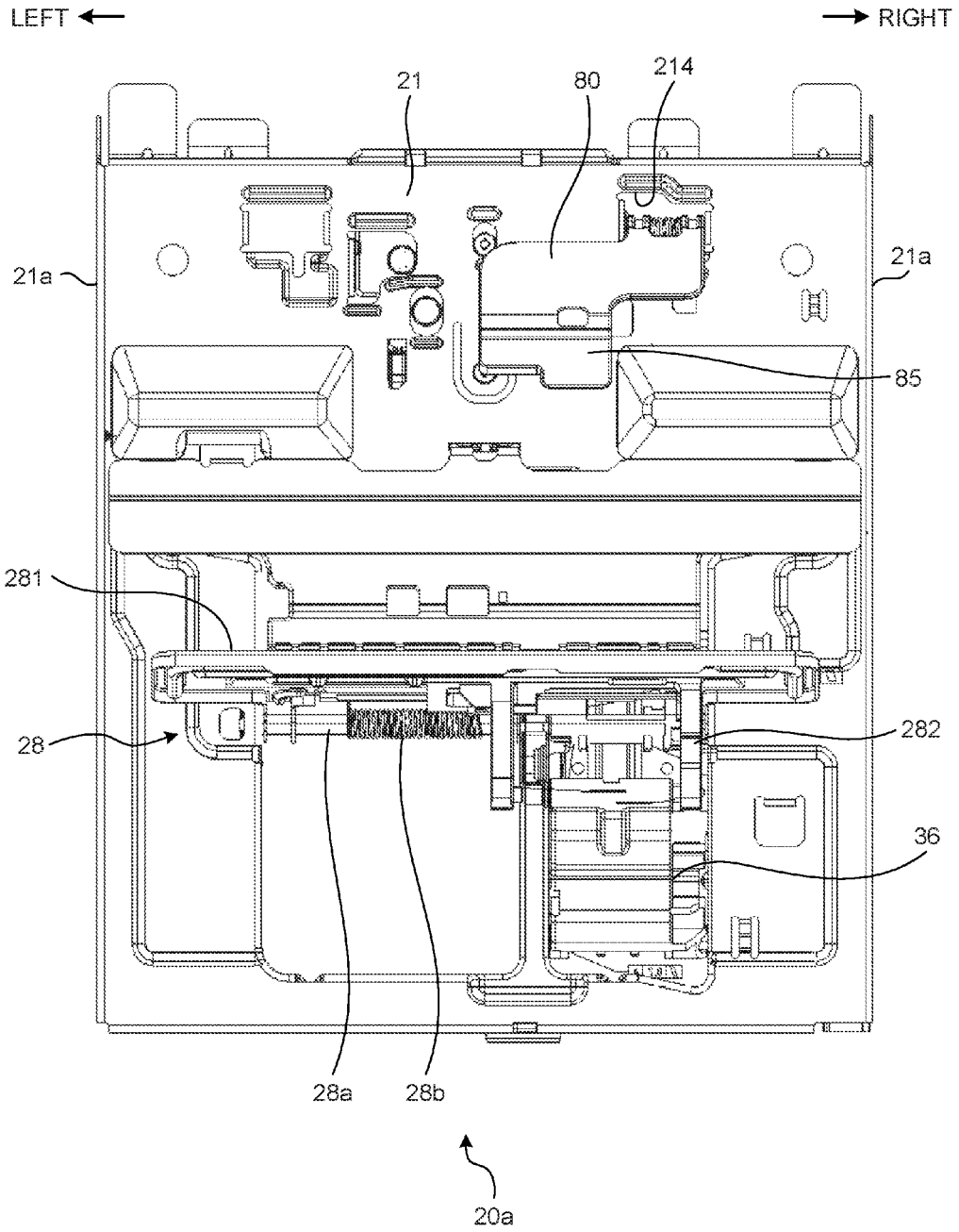
FIG. 36 is a front view of a first product discharging device illustrated in FIG. 35.
Figure 37:
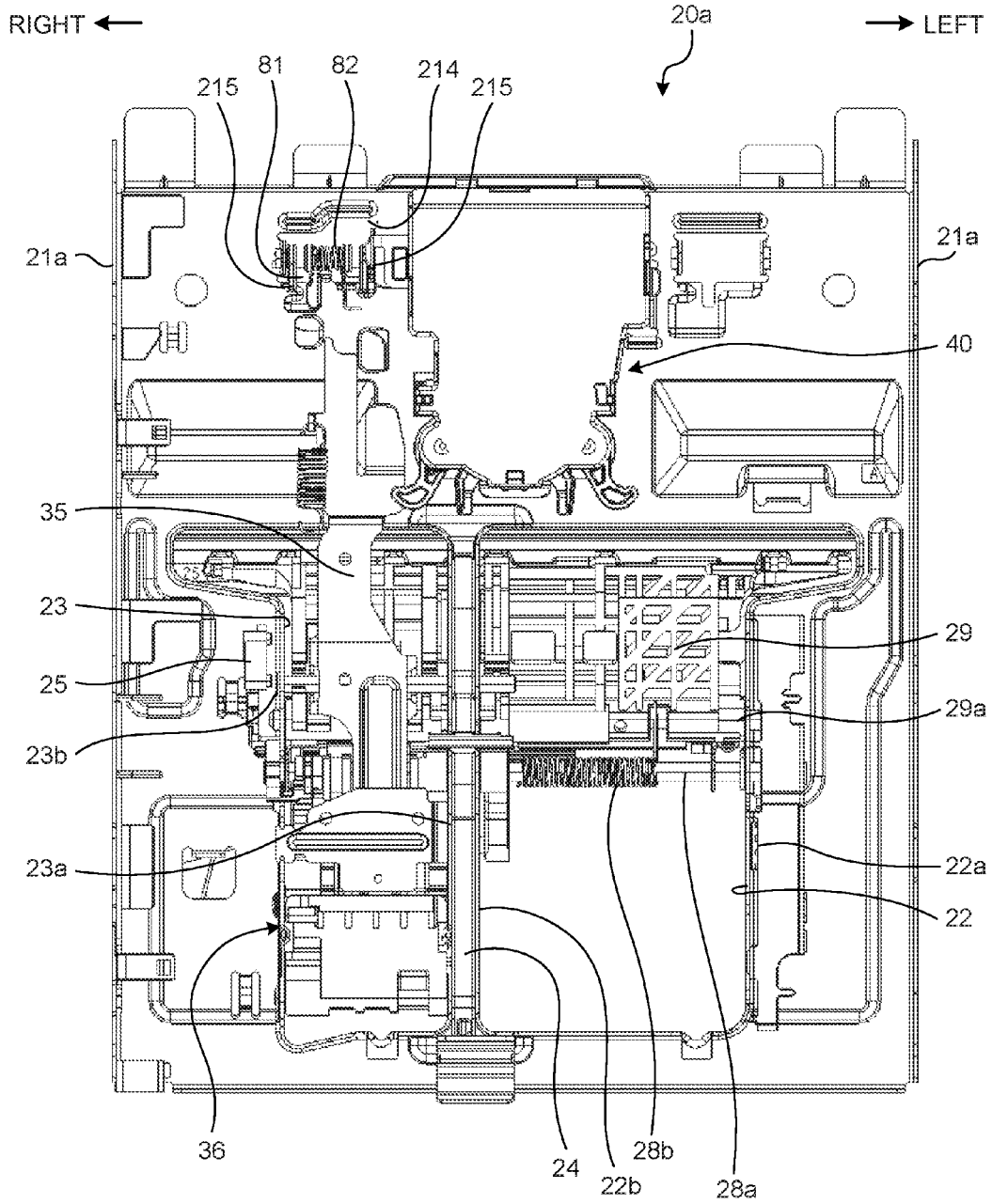
FIG. 37 is a rear view of the first product discharging device illustrated in FIG. 36.

The lever member 80 is swingably disposed to move forward to and backward from the first product storage passage 13*a* in a state in which the lever member penetrates a lever opening 214 at the right top end of the base 21. More specifically, a pair of right and left lever locking pieces 215 protruding backward is formed in both edge portions of the lever opening 214 on the rear side of the base 21, and the lever member 80 is disposed to be swingable about the axis of a shaft portion 81 formed in the lever locking piece 215 as illustrated in FIGS. 36 and 37. A lever spring 82 is interposed between the lever member 80 and the base 21 so as to surround the shaft portion 81. The lever member 80 is biased by the lever spring 82 and is in a posture in which a tip portion 85 thereof moves forward to the first product storage passage 13*a* in the normal state.

Figure 38:
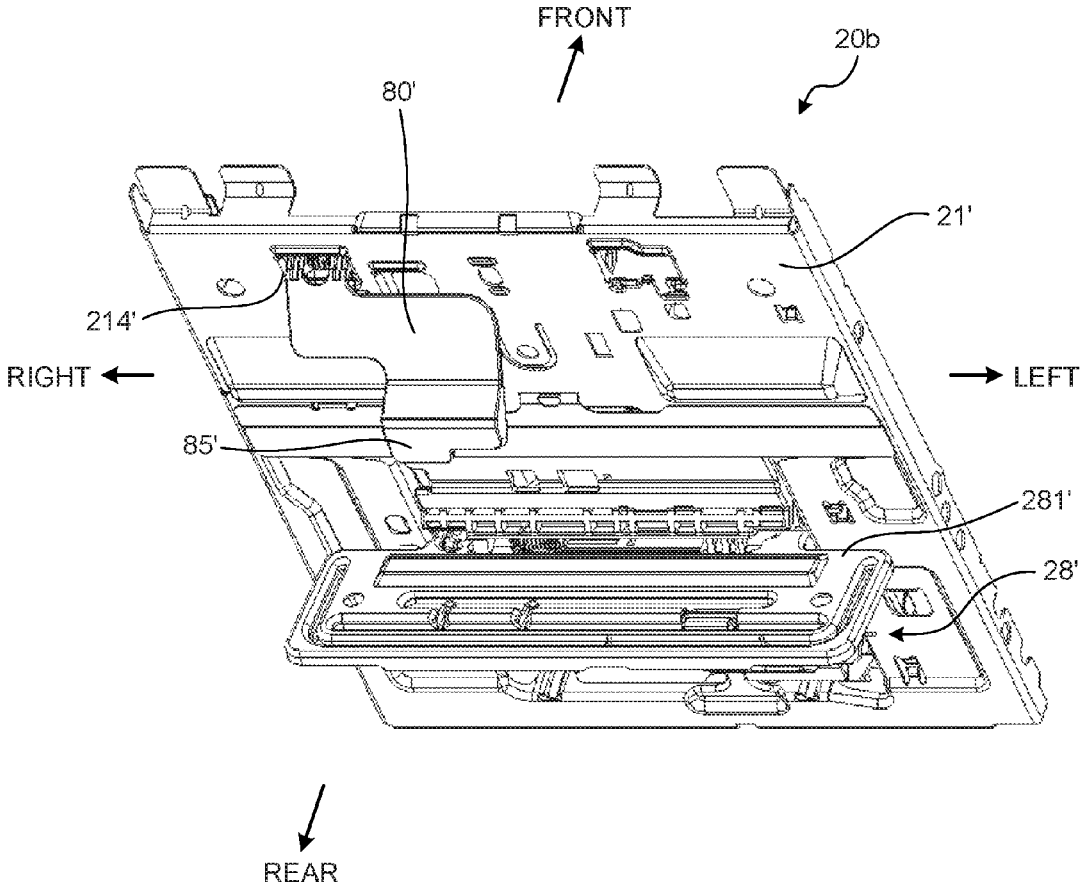
FIG. 38 is a perspective view of a second product discharging device illustrated in FIG. 35.
Figure 39:
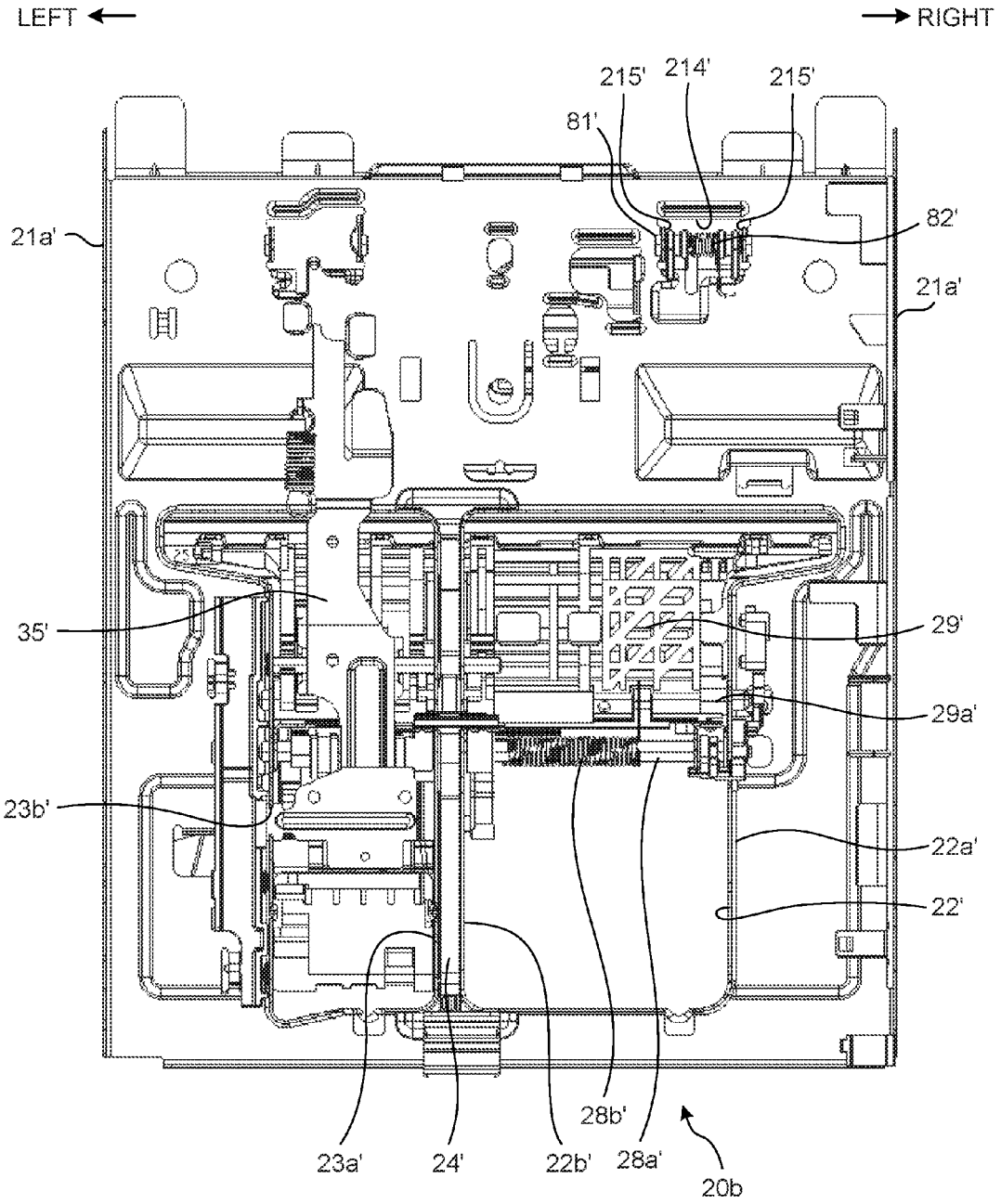
FIG. 39 is a front view of the second product discharging device illustrated in FIG. 38.

As illustrated in FIGS. 38 and 39, the lever member 80' is swingably disposed to move forward to and backward from the second product storage passage 13*b* in a state in which the lever member penetrates a lever opening 214' at the right top end of the base 21'. More specifically, a pair of right and left lever locking pieces 215' protruding backward is formed in both edge portions of the lever opening 214' on the rear side of the base 21', and the lever member 80' is disposed to be swingable about the axis of a shaft portion 81' formed in the lever locking piece 215'. A lever spring 82' is interposed between the lever member 80' and the base 21' so as to surround the shaft portion 81'. The lever member 80' is biased by the lever spring 82' and is in a posture in which a tip portion 85' thereof moves forward to the second product storage passage 13*b* in the normal state.

According to the first product discharging device 20*a* and the second product discharging device 20*b*, the lever members 80 and 80' disposed in the bases 21 and 21' such that the tip portions move forward to and backward from the product storage passages 13 in the areas above the upper pedals 29 and 29' are biased by the lever springs 82 and 82' such that the tip portions 85 and 85' move forward to the product storage passages 13 in the normal state, and move backward from the product storage passages 13 against the biasing force of the lever springs 82 and 82' when the tip portions come in contact with a product passing through the product storage passages. Accordingly, it is possible to stabilize the posture of a product passing through the product storage passages 13.

According to the present disclosure, the output gear is disposed in the base to be rotatable on its own axis, is linked to the drive source via the worm gear, and rotates by the driving force of the drive source transmitted via the worm gear. The link lever is disposed in the base to be rotatable on its own axis, causes the upper pedal to move forward to the product storage passage to come in contact with the second lowest product and causes the lower pedal to move backward from the product storage passage to discharge the lowest product downward by staying in the upward-rotated state and maintaining the pedal link in the upward-moved state when the link lever comes in sliding contact with the cam portion disposed in the output gear, and causes the upper pedal to move backward from the product storage passage and causes the lower pedal to move forward to the product storage passage to regulate downward movement of the products by allowing the pedal link to move downward when the sliding contact with the cam portion is released. In the product discharging device, the worm gear is interposed between the output gear and the drive source even when the supply of power is intercepted due to power outage or the like during driving, and thus the output gear does not rotate reversely but can maintain its state even when the drive source is stopped, whereby the pedal link can be maintained in the upward-moved state. Accordingly, since the upper pedal can be maintained in the forward-moved state, the phenomenon in the related art using the AC solenoid in which the AC solenoid is switched to a non-powered state and the pedal link moves downward due to interception of the supply of power due to power outage or the like does not occur. Accordingly, it is possible to prevent plural products from being discharged when supply of power is intercepted due to power outage or the like at the time of discharging of a product.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A product discharging device comprising:

a lower pedal that is swingably disposed in a base to move forward to and backward from a product storage passage storing input products in a vertical direction;

an upper pedal that is swingably disposed in a base to move forward to and backward from the product storage passage in an area above the lower pedal; and a pedal link that links the lower pedal and the upper pedal, wherein the upper pedal moves backward from the product storage passage by causing the pedal link to move downward and the lower pedal moves forward to the product storage passage to regulate downward movement of the product in a standby state, and the upper pedal moves forward to the product storage passage to come in contact with a second lowest product and the lower pedal moves backward from the product storage passage to discharge a lowest product downward by causing the pedal link to move upward, in an activated state, and the product discharging device further comprises an output gear that is disposed in the base to be rotatable on its axis, is linked to a drive source via a worm gear, and rotates by a driving force of the drive source transmitted via the worm gear, and a link lever that is disposed in the base to be rotatable on its own axis, is maintained in an upward-rotated state to hold the pedal link in an upward-moved state when the link lever comes in sliding contact with a cam portion formed in the output gear, and allows the pedal link to move downward when the sliding contact with the cam portion is released.

2. The product discharging device according to claim 1, wherein a surface of the link lever including a part in sliding contact with the cam portion when the link lever comes in sliding contact with the cam portion is substantially perpendicular to a plane including its own axis and an axis of the output gear.

3. The product discharging device according to claim 1, wherein the drive source is a DC motor.

4. The product discharging device according to claim 1, wherein a posture of the link lever when the sliding contact with the cam portion is released by bringing an elastically-deformable locking portion formed therein into contact with a predetermined portion is determined.

5. The product discharging device according to claim 4, wherein the locking portion is disposed at a base end separated from the axis of the link lever, and a concave portion is formed in the predetermined portion with which the locking portion comes in contact.

6. The product discharging device according to claim 1, wherein a posture of the link lever when the sliding contact with the cam portion is released by a biasing unit is determined.

7. The product discharging device according to claim 1, further comprising a lever member that is disposed in the base such that a tip thereof moves forward to and backward from the product storage passage in an area above the upper pedal, is biased by a biasing unit such that the tip thereof moves forward to the product storage passage in a normal state, and moves backward from the product storage passage against a biasing force of the biasing unit when the lever member comes in contact with a product passing through the product storage passage.

8. The product discharging device according to claim 1, wherein an axial portion protruding in a front-rear direction is formed at a center of the output gear, and the output gear is disposed to be rotatable about a central axis of the axial portion in a storage space between a unit base and a unit cover by inserting the axial portion into concave portions of the unit base and the unit cover.

9. The product discharging device according to claim 1, wherein the pedal link is normally biased downward by a link spring locked to the pedal link, and the link lever allows the pedal link to move downward by the link spring to cause the lower pedal to move forward to the product storage passage while causing the upper pedal to move backward from the product storage passage in a normal state; holds the pedal link in an upward-moved state against a biasing force of the link spring, and causes the lower pedal to move backward from the product storage passage while causing the upper pedal to move forward to the product storage passage when the link lever comes in sliding contact with a cam portion formed in the rotating output gear; and allows the pedal link to move downward by the link spring when the sliding contact with the cam portion is released.

* * * * *